US006003275A

United States Patent [19]

Cornell et al.

[11] Patent Number: 6,003,275

[45] **Date of Patent: *Dec. 21, 1999**

[54] FURNITURE SYSTEM

[75] Inventors: Paul T. Cornell, Grand Rapids, Mich.; Robert J. Luchetti; Gregg R. Draudt, both of Cambridge, Mass.; Kurt S. Bodden, Boston, Mass.; Linda K. Zimmer, Eugene, Oreg.

[73] Assignee: Steelcase Development Inc., Grand Rapids, Mich.

[ * ] Notice: This patent is subject to a terminal disclaimer.

[21] Appl. No.: 09/174,661

[22] Filed: Oct. 19, 1998

Related U.S. Application Data

[60] Continuation of application No. 08/881,802, Jun. 24, 1997, which is a division of application No. 08/450,255, May 25, 1995, Pat. No. 5,724,778, which is a continuation of application No. 07/774,653, Feb. 21, 1990, Pat. No. 5,511,348, which is a continuation-in-part of application No. 07/480, 219, Feb. 14, 1990, abandoned.

[51] Int. Cl.[6] ..... E04B 2/00

[52] U.S. Cl. ..... 52/239; 52/64; 52/481.2; 52/780; 52/781; 52/220.7; 160/351; 160/377

[58] Field of Search ..... 52/64, 239, 243.1, 52/481.2, 144, 145, 309.9, 793.1, 794.1, 797.1, 800.12, 716.3, 717.03, 717.05; 40/605, 606, 611, 617, 488–491

[56] References Cited

U.S. PATENT DOCUMENTS

| | | |
|---|---|---|
| 2,204,880 | 6/1940 | Bell . |
| 2,205,109 | 6/1940 | Rugg et al. . |
| 2,365,255 | 12/1944 | Eager . |
| 2,444,166 | 6/1948 | Lesavoy . |
| 2,453,892 | 11/1948 | Casson . |
| 2,468,513 | 4/1949 | Rider . |
| 2,469,466 | 5/1949 | Herrington . |
| 2,474,011 | 6/1949 | Overly . |
| 2,484,349 | 10/1949 | Kelly . |
| 2,527,031 | 10/1950 | Rambusch . |

(List continued on next page.)

FOREIGN PATENT DOCUMENTS

| | | |
|---|---|---|
| 659030 | 1/1965 | Belgium . |
| 943116 | 3/1974 | Canada . |
| 962425 | 2/1975 | Canada . |

(List continued on next page.)

OTHER PUBLICATIONS

Peter Isherwood Design (2 pages), date unknown—prior to Oct. 8, 1991.

Singer Partitions, Inc., (8 pages), Mar. 1, 1968,—"Sound Stopper" Advertisement.

(List continued on next page.)

*Primary Examiner*—Robert Canfield

*Attorney, Agent, or Firm*—Price, Heneveld, Cooper, DeWitt & Litton

[57] ABSTRACT

A furniture system is particularly adapted to support group activities in open plans, and the like. A plurality of columns support an overhead framework on the floor of a building in a freestanding fashion at a predetermined elevation, generally above average user height. A plurality of individual panels are provided, wherein each panel is constructed to permit easy, manual, bodily translation of the same by an adult user. A hanger arrangement is associated with the overhead framework, and cooperates with connectors on the panels to detachably suspend the panels at various locations along the overhead framework. The panels are manually reconfigurable between many different arrangements to efficiently and effectively support different group activities. Preferably, the panels are capable of providing a partitioning function to visually divide at least a portion of the workspace, and/or a display function to facilitate group communications.

18 Claims, 59 Drawing Sheets

U.S. PATENT DOCUMENTS

| | | |
|---|---|---|
| 2,535,618 | 12/1950 | Williams . |
| 2,587,698 | 3/1952 | Corn, Jr. et al. . |
| 2,616,149 | 11/1952 | de Warrenne Waller . |
| 2,676,433 | 4/1954 | Estey . |
| 2,687,310 | 8/1954 | Goetz . |
| 2,706,306 | 4/1955 | Sheetz . |
| 2,730,421 | 1/1956 | Burst et al. . |
| 2,742,675 | 4/1956 | Robertson . |
| 2,754,535 | 7/1956 | Plemeng . |
| 2,766,855 | 10/1956 | Johnson et al. . |
| 2,814,140 | 11/1957 | Ellis . |
| 2,833,550 | 5/1958 | Frick . |
| 2,848,765 | 8/1958 | Showalter . |
| 2,888,113 | 5/1959 | Schwartz et al. . |
| 2,890,498 | 6/1959 | Bigelow . |
| 2,939,543 | 6/1960 | Zingone . |
| 2,943,716 | 7/1960 | Babcock . |
| 2,959,256 | 11/1960 | Deam . |
| 2,962,132 | 11/1960 | Reinhardt . |
| 3,001,001 | 9/1961 | Bibb . |
| 3,013,644 | 12/1961 | Smith et al. . |
| 3,055,061 | 9/1962 | Dadras . |
| 3,063,496 | 11/1962 | Kessler . |
| 3,111,788 | 11/1963 | Ouellet . |
| 3,115,182 | 12/1963 | Bobbitt . |
| 3,141,207 | 7/1964 | Kahler . |
| 3,146,956 | 9/1964 | Schwartz et al. . |
| 3,178,834 | 4/1965 | Dyer et al. . |
| 3,180,459 | 4/1965 | Liskey, Jr. . |
| 3,181,274 | 5/1965 | Izenour . |
| 3,195,698 | 7/1965 | Codrea . |
| 3,210,534 | 10/1965 | Kump . |
| 3,218,773 | 11/1965 | Heirich . |
| 3,235,915 | 2/1966 | Glaser . |
| 3,251,163 | 5/1966 | Russell . |
| 3,296,760 | 1/1967 | Pavlecka . |
| 3,300,899 | 1/1967 | Haws et al. . |
| 3,302,547 | 2/1967 | Wasserman . |
| 3,312,025 | 4/1967 | Deakins . |
| 3,312,027 | 4/1967 | Lawer . |
| 3,321,003 | 5/1967 | Boerner . |
| 3,321,877 | 5/1967 | Alexieff . |
| 3,326,505 | 6/1967 | Jamar, Jr. . |
| 3,343,205 | 9/1967 | Gogerty . |
| 3,377,756 | 4/1968 | Polhamus . |
| 3,379,468 | 4/1968 | Woodward . |
| 3,388,510 | 6/1968 | Smith et al. . |
| 3,389,246 | 6/1968 | Shemitz . |
| 3,396,497 | 8/1968 | Murphy . |
| 3,410,042 | 11/1968 | Averill . |
| 3,425,171 | 2/1969 | Propst et al. . |
| 3,445,150 | 5/1969 | Zartarian . |
| 3,448,258 | 6/1969 | Vallas . |
| 3,457,698 | 7/1969 | Albers . |
| 3,466,777 | 9/1969 | Wistrand et al. . |
| 3,471,629 | 10/1969 | O'Leary . |
| 3,503,166 | 3/1970 | Nakazawa et al. . |
| 3,503,839 | 3/1970 | Breitwieser et al. . |
| 3,507,079 | 4/1970 | George . |
| 3,513,606 | 5/1970 | Jones . |
| 3,570,200 | 3/1971 | Ritner . |
| 3,570,577 | 3/1971 | Bedrin et al. . |
| 3,570,683 | 3/1971 | Dickgiesser et al. . |
| 3,590,547 | 7/1971 | Molyneux et al. . |
| 3,609,211 | 9/1971 | Van Herk . |
| 3,621,635 | 11/1971 | De Lange . |
| 3,683,100 | 8/1972 | Deal et al. . |
| 3,683,101 | 8/1972 | Liberman . |
| 3,683,573 | 8/1972 | Payraudeau et al. . |
| 3,701,836 | 10/1972 | Ward et al. . |
| 3,702,521 | 11/1972 | Peterson . |
| 3,708,916 | 1/1973 | Karp, Jr. et al. . |
| 3,713,474 | 1/1973 | Orlando . |
| 3,720,254 | 3/1973 | Smart . |
| 3,725,568 | 4/1973 | Stanley . |
| 3,732,633 | 5/1973 | Margolis et al. . |
| 3,733,759 | 5/1973 | Schulte et al. . |
| 3,748,793 | 7/1973 | Tompkins et al. . |
| 3,798,850 | 3/1974 | Ensor . |
| 3,811,454 | 5/1974 | Huddle . |
| 3,813,179 | 5/1974 | Priest . |
| 3,828,937 | 8/1974 | Nash . |
| 3,831,895 | 8/1974 | Schubert . |
| 3,856,029 | 12/1974 | Huddle . |
| 3,862,525 | 1/1975 | Greenspan . |
| 3,871,153 | 3/1975 | Birum, Jr. . |
| 3,918,223 | 11/1975 | Carlsson . |
| 3,945,132 | 3/1976 | Parmelee . |
| 3,967,420 | 7/1976 | Papsco et al. . |
| 3,977,458 | 8/1976 | Kuen . |
| 3,980,267 | 9/1976 | Palmer . |
| 3,984,930 | 10/1976 | Booland . |
| 3,996,458 | 12/1976 | Jones et al. . |
| 3,999,351 | 12/1976 | Rensch . |
| 4,020,604 | 5/1977 | Legler et al. . |
| 4,021,973 | 5/1977 | Hegg et al. . |
| 4,034,535 | 7/1977 | Dustmann . |
| 4,036,244 | 7/1977 | Huddle . |
| 4,081,941 | 4/1978 | Van Ausdall . |
| 4,083,153 | 4/1978 | Sumpter . |
| 4,087,944 | 5/1978 | Mecklenburg . |
| 4,100,709 | 7/1978 | Good . |
| 4,109,429 | 8/1978 | Whisson . |
| 4,137,678 | 2/1979 | Varlonga . |
| 4,165,588 | 8/1979 | Bayley . |
| 4,179,169 | 12/1979 | Daniels et al. . |
| 4,185,422 | 1/1980 | Radek . |
| 4,186,533 | 2/1980 | Jensen . |
| 4,197,923 | 4/1980 | Harris et al. . |
| 4,200,171 | 4/1980 | Seymour et al. . |
| 4,214,392 | 7/1980 | Virsen . |
| 4,224,769 | 9/1980 | Ball et al. . |
| 4,227,355 | 10/1980 | Wendt . |
| 4,302,865 | 12/1981 | Dixon et al. . |
| 4,336,674 | 6/1982 | Weber . |
| 4,375,010 | 2/1983 | Mollenkopf . |
| 4,388,961 | 6/1983 | Schaefer et al. . |
| 4,404,785 | 9/1983 | McCracken et al. . |
| 4,413,457 | 11/1983 | Lahm et al. . |
| 4,420,798 | 12/1983 | Herst et al. . |
| 4,427,244 | 1/1984 | Castagna . |
| 4,433,880 | 2/1984 | Maravelas, Jr. et al. . |
| 4,458,455 | 7/1984 | Tollstoff de Voss . |
| 4,470,232 | 9/1984 | Condevaux et al. . |
| 4,485,599 | 12/1984 | Perradin . |
| 4,493,172 | 1/1985 | Jones . |
| 4,493,174 | 1/1985 | Arens . |
| 4,497,357 | 2/1985 | Labelle . |
| 4,498,262 | 2/1985 | Garcia . |
| 4,535,578 | 8/1985 | Gerken . |
| 4,553,359 | 11/1985 | Potter . |
| 4,555,828 | 12/1985 | Matimura . |
| 4,559,750 | 12/1985 | Scourtelis . |
| 4,571,904 | 2/1986 | Kessler et al. . |
| 4,571,906 | 2/1986 | Ashton . |
| 4,601,146 | 7/1986 | Harter et al. . |
| 4,606,394 | 8/1986 | Bannister . |
| 4,611,448 | 9/1986 | De Long . |
| 4,619,095 | 10/1986 | Johnston . |
| 4,631,881 | 12/1986 | Chaman . |
| 4,633,641 | 1/1987 | Heinbuchner . |
| 4,637,178 | 1/1987 | Nimmo et al. . |

| | | |
|---|---|---|
| 4,642,926 | 2/1987 | Friedman . |
| 4,653,239 | 3/1987 | Randa . |
| 4,677,796 | 7/1987 | Mellot . |
| 4,689,930 | 9/1987 | Menchetti . |
| 4,715,154 | 12/1987 | Baloga . |
| 4,730,633 | 3/1988 | Greenbaum . |
| 4,731,961 | 3/1988 | Bona . |
| 4,738,066 | 4/1988 | Reed . |
| 4,754,583 | 7/1988 | Jenn . |
| 4,771,583 | 9/1988 | Ball et al. . |
| 4,778,487 | 10/1988 | Chenel . |
| 4,785,598 | 11/1988 | Stronach . |
| 4,794,744 | 1/1989 | Young et al. . |
| 4,798,035 | 1/1989 | Mitchell et al. . |
| 4,821,786 | 4/1989 | Johnston . |
| 4,821,787 | 4/1989 | Swanson . |
| 4,833,840 | 5/1989 | Kalischewski et al. . |
| 4,834,161 | 5/1989 | Johnson et al. . |
| 4,837,990 | 6/1989 | Peleg . |
| 4,841,699 | 6/1989 | Wilson et al. . |
| 4,852,317 | 8/1989 | Schiavello et al. . |
| 4,856,242 | 8/1989 | Baloga et al. . |
| 4,876,835 | 10/1989 | Kelley et al. . |
| 4,890,634 | 1/1990 | Dalo et al. . |
| 4,902,852 | 2/1990 | Wuertz . |
| 5,090,171 | 2/1992 | Kano et al. . |
| 5,123,128 | 6/1992 | Hines . |
| 5,163,695 | 11/1992 | Pakowsky . |
| 5,282,341 | 2/1994 | Baloga et al. . |
| 5,362,923 | 11/1994 | Newhouse et al. . |
| 5,394,658 | 3/1995 | Schreiner et al. . |
| 5,511,348 | 4/1996 | Cornell et al. . |
| 5,724,778 | 3/1998 | Cornell et al. . |

FOREIGN PATENT DOCUMENTS

| | | |
|---|---|---|
| 465104 | 1/1914 | France . |
| 521521 | 7/1921 | France . |
| 1408816 | 4/1965 | France . |
| 923235 | 12/1954 | Germany . |
| 2025675 | 9/1971 | Germany . |
| 2149177 | 4/1972 | Germany . |
| 2160513 | 6/1973 | Germany . |
| 2162388 | 6/1973 | Germany . |
| 2258006 | 5/1974 | Germany . |
| 2504476 | 5/1976 | Germany . |
| 2616787 | 6/1977 | Germany . |
| 13207796 | 9/1983 | Germany . |
| 13607365 | 9/1987 | Germany . |
| C23616732 | 1/1989 | Germany . |
| 13730509 | 3/1989 | Germany . |
| 2160216 | 1/1993 | Germany . |
| 678486 | 12/1964 | Italy . |
| 375726 | 6/1932 | United Kingdom . |
| 775841 | 5/1957 | United Kingdom . |
| 960490 | 6/1964 | United Kingdom . |
| 2125083 | 2/1984 | United Kingdom . |
| 2172624 | 9/1986 | United Kingdom . |

OTHER PUBLICATIONS

"DOMUS," Monthly Review of Architecture Interiors Design Art, (2 pages), 1987—"ZERO" Advertisement.

"Staff" by Staff Lighting Corporation, (3 pages), Highland, New York, 1989.

"Egan System" by Egan Visual (6 pages), date unknown—prior to Oct. 8, 1991.

"Man Space Office Environment" by Bossee Office Environment, Stahler Ufer 3 Germany (12 pages), date unknown—prior to Oct. 8, 1991.

"Modern Maturity" Unnumbered pp. 25 and 26 of Apr./May 1990 issue.

Wire Mesh/Electrical World, (1 page), Apr. 7, 1952.

Leitner USA, Leitner_10, The Large–Scale System, (44 pages), date unknown, but prior to May 25, 1995.

Leitner USA, Leitner_10, Planning Document, 93 pages, date unknown—prior to May 25, 1995.

FURNITURE SYSTEM

CROSS-REFERENCES TO RELATED APPLICATIONS

The present application is a continuation of commonly assigned U.S. patent application Ser. No. 08/881,802, filed Jun. 24, 1997, entitled FURNITURE SYSTEM which is a division of U.S. patent application Ser. No. 08/450,255, filed May 25, 1995, now U.S. Pat. No. 5,724.778 entitled FURNITURE SYSTEM, which is a continuation of U.S. patent application Ser. No. 07/774,653, filed Feb. 21, 1990, now U.S. Pat. No. 5,511,348 entitled FURNITURE SYSTEM, which is a continuation-in-part of U.S. patent application Ser. No. 07/480,219, filed Feb. 14, 1990, entitled PARTITION ARRANGEMENT DESIGN ("Commons" Informal Photocase), abandoned, each of which is hereby incorporated herein by reference.

BACKGROUND OF THE INVENTION

The present invention relates to furnishings, and in particular to a furniture system that is particularly adapted to support group activities in open plans, and the like.

Open office plans are well known in the art, and generally comprise large, open floor spaces in a building that are furnished in a manner that is readily reconfigurable to accommodate the ever changing needs of a specific user, as well as the divergent requirements of different tenants. One arrangement typically used for furnishing open plans includes movable partition panels that are detachably interconnected to partition off the open space into individual workstations and/or offices. Some such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are interconnected in a side-by-side relationship, with upstanding privacy screens attached to at least some of the furniture units to create individual, distinct workstations and/or offices.

Such prior art partitioning arrangements create relatively permanent, multi-function workstations for the users, which workstations are required to support both individual work activities, as well as some types of group activities, such as inter-office conferences, and the like. However, these types of conventional workstation arrangements are not particularly adapted to support workers engaged in group work, such as self-managing teams, or others involved in team problem solving techniques, wherein a relatively large number of workers from different disciplines, such as engineering, design, manufacturing, sales, marketing, purchasing, finance, etc., meet together as a group to define and review issues, and set general policy, and then break out into a number of smaller sub-groups or individuals to resolve those specific problems relating to their particular discipline. Team projects typically have a rather specific objective and are of a limited duration, such that the individual workers are temporarily assigned to the group for the life of the project, and are then reassigned to a new group when the project is completed. Group work is steadily gaining importance as a way of improving productivity and time-to-market, thereby emphasizing the need to support such activities more efficiently and effectively.

Conventional conference rooms, meeting halls, and the like have heretofore been required to handle such group meetings, but are typically expensive to construct and maintain, and are not usually considered an efficient use of space in open plan environments. When such conventional rooms are constructed in rented office space, they become permanent leasehold improvements, which must be depreciated over a lengthy time period, and can not be readily moved upon the expiration of the lease. The reconfiguration of such spaces is quite messy, and very disruptive to conducting day-to-day business. Furthermore, with conventional conference room arrangements, breakout meetings among the various sub-groups of workers often prove inconvenient, since the workstations of the participant workers are seldom located in close proximity to the conference room.

Another objective of furnishings for modern office environments is to promote the establishment of an optimum balance between worker privacy and worker interaction. Throughout a given workday, an office worker normally oscillates between interaction with others and time spent alone. Each such worker actively seeks out or avoids others based upon their ever changing tasks, objectives, and goals. Furnishings can serve to help these workers better regulate involvement with or isolation from coworkers. For example, full height offices are known for privacy. Their surrounding walls and door provide privacy by consistently controlling unwanted distractions, but often limit opportunities for spontaneous interaction. On the other hand, open offices precipitate an awareness of coworkers. Furniture and partition based workstations encourage participation and convenient access, but often lack sufficient controls for individual quiet work. Both private workspace, and convenient access to coworkers for the completion of work involving group or team efforts are quite important to the overall success of such projects.

The use of displays to communicate information to large groups in office environments and the like, is also generally well-known, and includes such devices as marker boards, tackable surfaces, electronic displays, reflective projector screens, etc. Such displays are normally incorporated into conventional style conference rooms, meeting halls, and other similar facilities. However, as previously noted, such conventional meeting spaces are typically expensive, and are not usually considered a cost effective use of floor space in most modern offices. Rather, modern office layouts are typically of the open plan type, and do not include large, conventional types of conference rooms.

Information displays in modern, open plan workstations, such as those created by movable partition panels, modular furniture, or the like, are usually quite limited, and not particularly adapted to support workers engaged in group or team problem solving techniques. Due to the inherent nature of group problem solving techniques, the effective display of information is quite important to the effective management of the team's human resources.

SUMMARY OF THE INVENTION

One aspect of the present invention is a furniture system that is particularly adapted to effectively and efficiently support group work activities in open plans, and the like. A plurality of columns support an overhead support on the floor of a building in a freestanding fashion at a predetermined elevation, generally above average user height. A plurality of panels are provided, wherein each panel is constructed to permit easy, manual, bodily translation of the same by an adult user. A hanger arrangement is associated with the overhead framework, and cooperates with connectors on the panels to detachably suspend the panels at various locations along the overhead support. The panels are manually reconfigurable between many different arrangements to provide effective support for various group activities.

Preferably, the partition panels are capable of visually dividing or partitioning at least a portion of the floor space to support both group and breakout activities, and/or displaying information to facilitate group communications. The furniture system may have a knock-down type of construction which permits easy disassembly and reassembly at new locations, so as to efficiently support the temporary needs of problem solving teams or groups, as well as other similar activities. The shape of the overhead support may be varied to better mate with the architecture of the building space in which the furniture system is erected and used. Also, as the needs of a problem solving team or group change, the overhead support can be easily reconfigured to efficiently and effectively meet these new needs. Removable covers for the columns and overhead support are available to vary the exterior appearance of the furniture system, without altering its structural configuration.

Another aspect of the present invention is a method for partitioning open office plans, and the like, to effectively support group activities. A rigid framework with associated support columns is provided with the upper ends of the columns connected with the framework, and the lower ends of the columns abuttingly supported on the floor surface of the building room. A plurality of partition panels are provided, each being shaped to at least visually divide one portion of the building room from another, and are constructed to permit easy, manual bodily translation of the same by an adult user. The partition panels are detachably connected with the framework in a manner in which each of the partition panels hangs downwardly from the framework in a generally vertical orientation, and is readily and easily manually removable therefrom by the user. The partition panels are manually positioned on the framework to define a group workspace portion of the floor surface, which is at least spatially and visually distinct from the rest of the floor surface, and sufficiently large to comfortably accommodate a plurality of adult users therein for communal communications and actions. Thereafter, the partition panels are manually reconfigured on the framework to subdivide the group workspace into at least two, sub-groups workspaces, which are at least spatially and visually distinct from one another, and are sufficiently large to accommodate at least one adult user therein for breakout-type communications and actions.

Yet another aspect of the present invention is a method for displaying information in open office plans, and the like to support group activities. A rigid framework with associated support columns is provided with the upper ends of the columns connected with the framework, and the lower ends of the columns abuttingly supported on the floor surface of the building room. A plurality of display panels are provided, each being adapted to present information thereon, and are constructed to permit easy, manual, bodily translation of the same by an adult user. The display panels are detachably connected with the framework in a manner in which each of the display panels hangs downwardly from the framework in a generally vertical orientation, and is readily and easily manually removable therefrom by the user. The partition panels are manually positioned on the framework to best meet the needs of group activities, and are readily reconfigurable thereon, and may also be transported by the user to a location outside the furniture system.

The principal objects of the present invention are to provide a furniture system which is particularly adapted to effectively and efficiently support group work activities in open plans, and the like. An overhead framework and column arrangement supports the system freestanding on the floor of a building, such that the system is completely portable, and can be moved about a selected location. The overhead framework and columns preferably have a knock-down type of construction to facilitate disassembly and reassembly at new locations. The overall shape of the furniture system can be varied to mate with the architectural layout of the building room in which the furniture system is erected and used, and is particularly adapted to be temporarily deployed for team or group problem solving projects. Panels that are detachably hung from the overhead framework can be easily reconfigured to accommodate both communal and breakout-type activities. The panels may be provided with acoustic and/or display capabilities to further assist in group problem solving activities. Both power and signal capabilities are routed throughout the overhead framework and the columns to support electronic equipment, such as lighting, computers, communication devices and the like. Both the overhead framework and the columns may be provided with removable covers to vary the exterior appearance of the system. Mobile carts assist in the temporary storage and/or transport of the panels, and can also serve as portable partitions and/or displays. Detachable connectors on the panels have an uncomplicated design that securely mount the same on either straight or curved sections of the framework, yet permits easy movement and removal of the panels, as well as reattachment by even unskilled personnel in a quick and efficient manner. Panels with display capabilities can be composed and retained outside of the furniture system for information storage and retrieval. The furniture system is extremely flexible and dynamic to meet the ever changing needs of various users, is economical to manufacture, capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
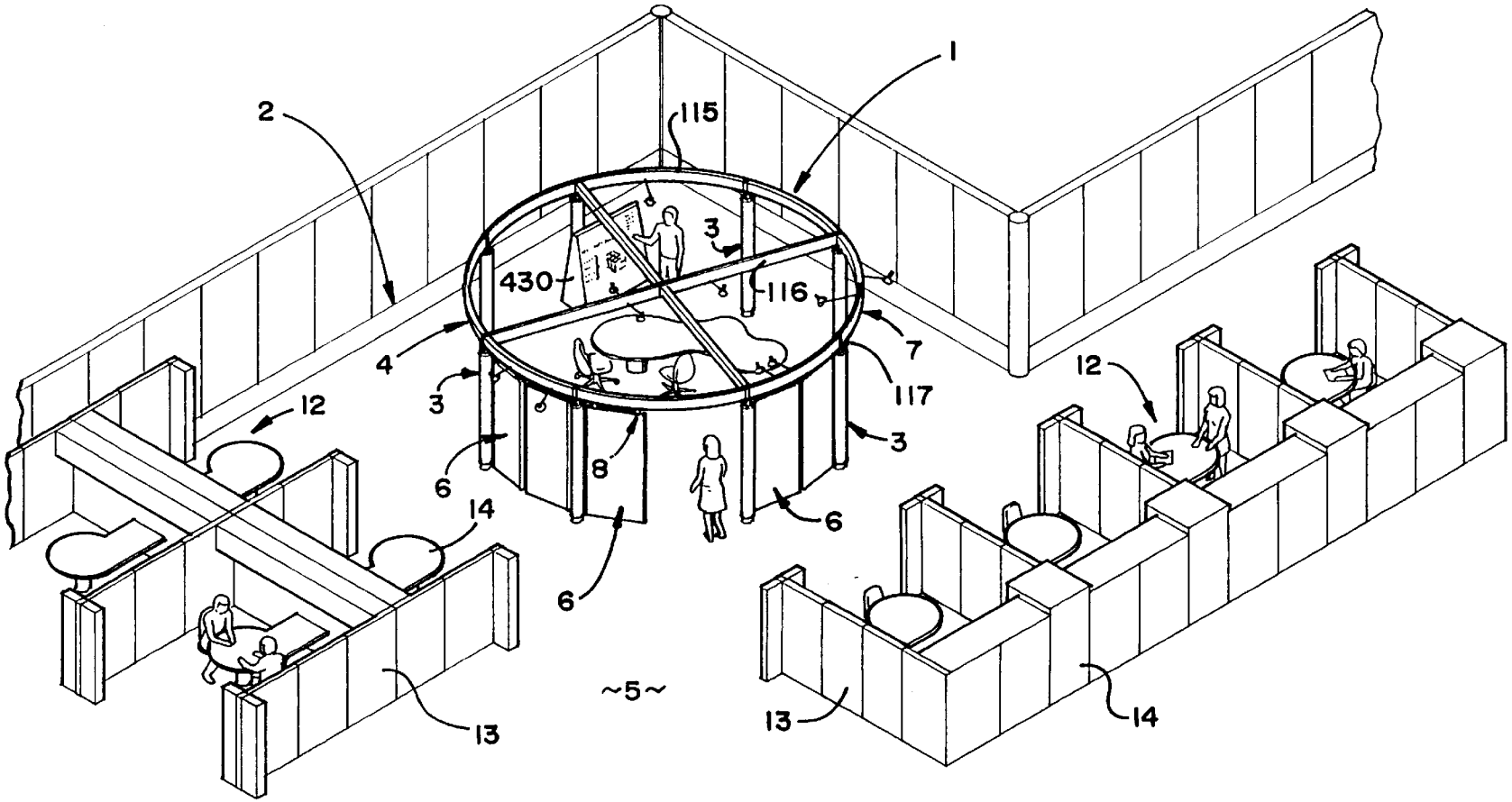
FIG. 1 is a perspective view of a furniture system embodying the present invention, shown deployed in an open office plan, with removable panels arranged to define a large, group workspace.
Figure 2:
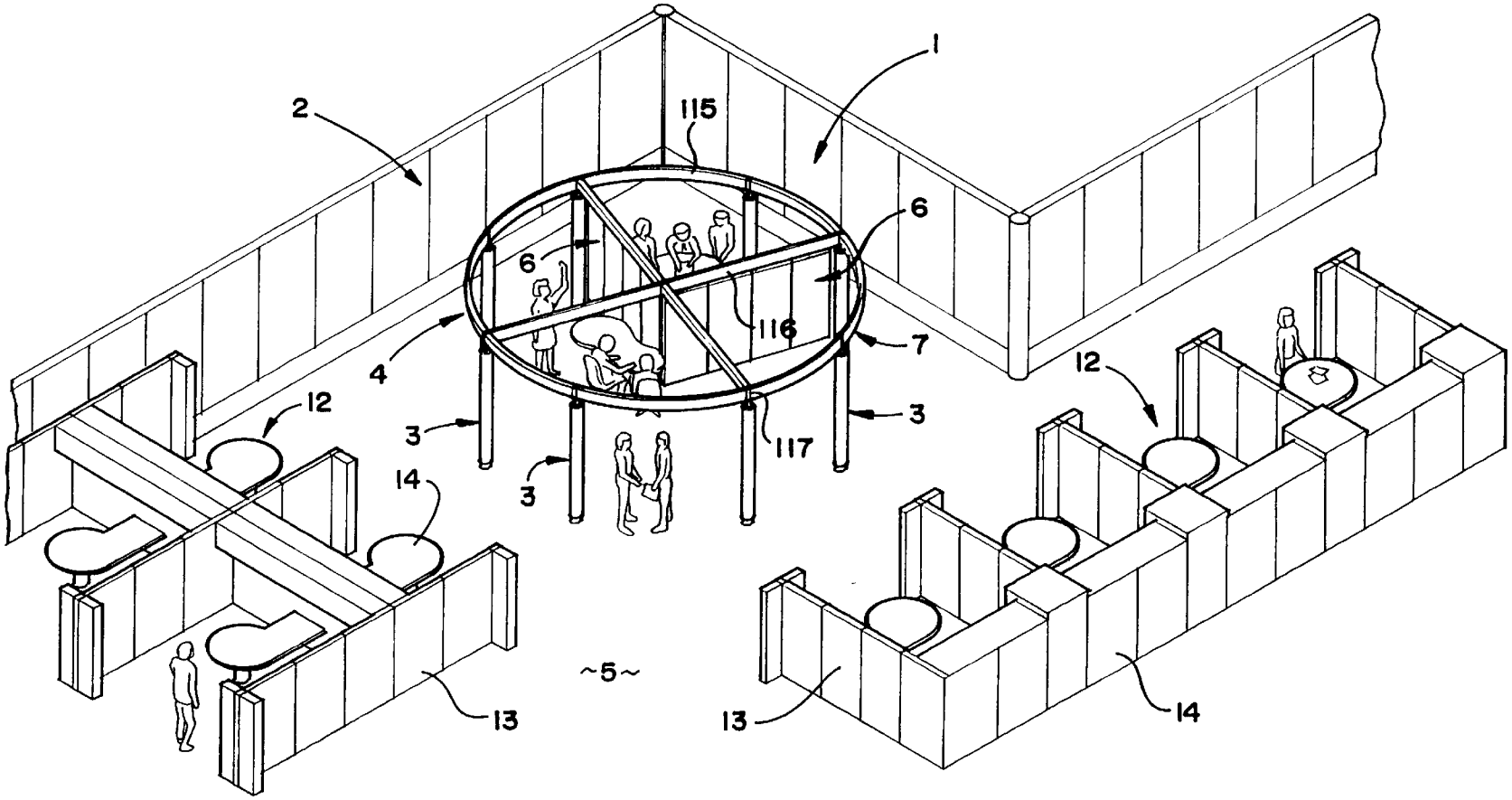
FIG. 2 is a perspective view of the furniture system shown in FIG. 1, wherein the panels have been rearranged to define two, smaller, sub-group workspaces for breakout-type activities.
Figure 3:
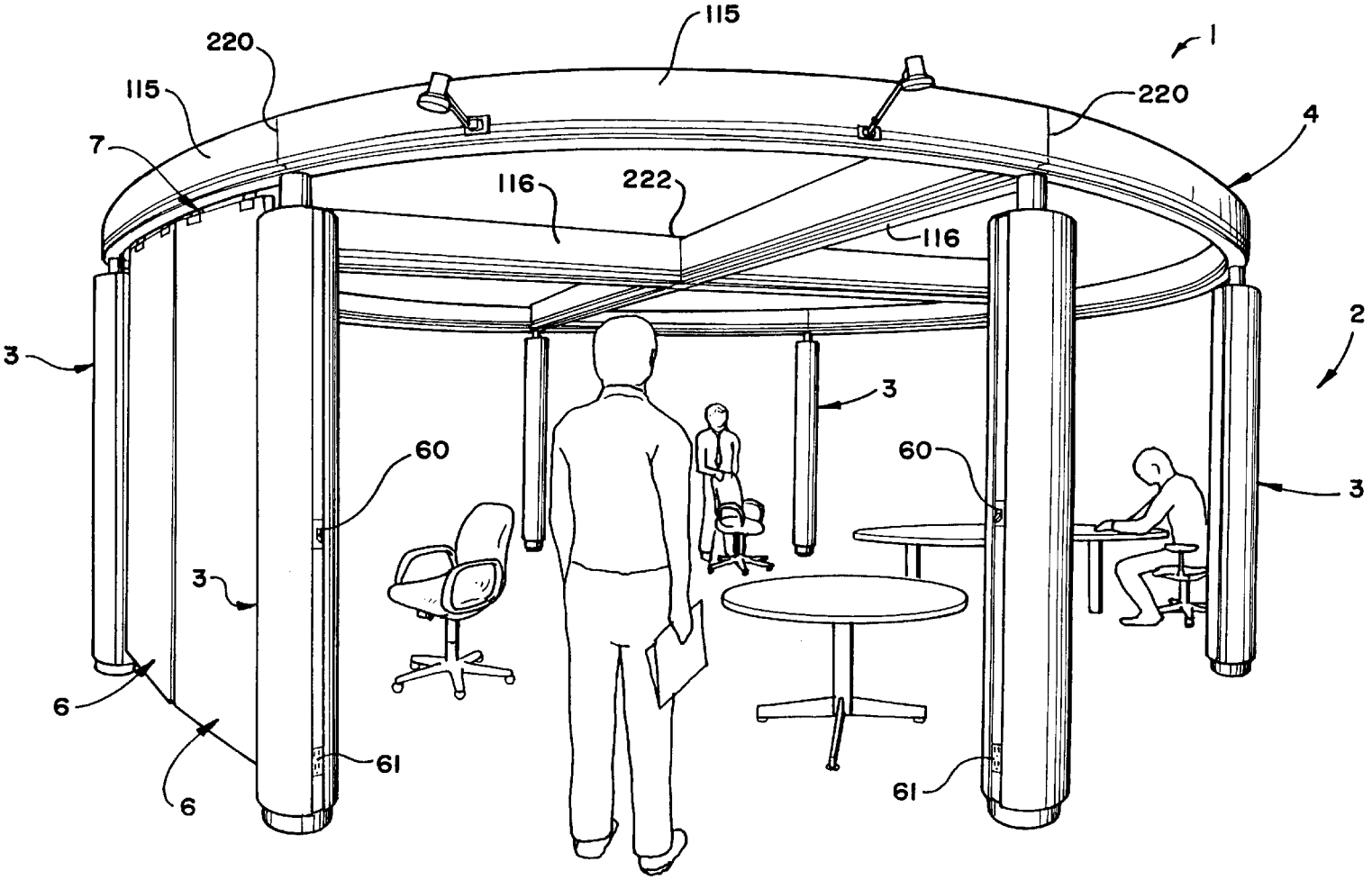
FIG. 3 is a perspective view of the furniture system, taken from a generally eye level elevation.

For purposes of description herein, the terms "upper", "right", "left", "rear", "front" "vertical", "horizontal", and derivatives thereof shall relate to the invention as oriented in FIGS. 1–3. However, it is to understood that the invention may assume various alternative orientations and step sequences, except where expressly specified to the contrary. It is also to be understood that the specific devices and processes illustrated in the attached drawings, and described in the following specification are simply exemplary embodiments of the invented concepts defined in the appended claims. Hence, specific dimensions and other physical characteristics relating to the embodiments disclosed herein are not to be considered as limiting, unless the claims expressly state otherwise.

The reference numeral 1, (FIG. 1) generally designates a furniture system embodying the present invention. Furniture system 1 is particularly adapted to support group work activities in open plans, and the like, such as the illustrated open office space 2. In the illustrated furniture system 1, a plurality of posts or columns 3 support an overhead support or framework 4 on the floor 5 of the open office space 2 in a freestanding fashion at a predetermined elevation, generally above average user height. A plurality of individual panels 6 are provided, wherein each panel 6 is constructed to permit easy, manual bodily translation of the same by an adult user. A hanger arrangement 7 is associated with overhead framework 4, and cooperates with connectors 8 on panel 6 to detachably suspend panels 6 at various locations along overhead framework 4. Panels 6 are manually reconfigurable between many different arrangements, such as the configurations shown in FIGS. 1–3, to efficiently and effectively support different group and/or individual work activities. Preferably, panels 6 are capable of providing a partitioning function to visually divide at least a portion of the workspace, and/or a display function to facilitate group communications.

In the illustrated example, open office space 2 (FIG. 1) is located in an open corner area of an associated building, immediately adjacent to a plurality of conventional workstations 12, which may be formed by arrangements such as the illustrated partition panels 13, and/or modular furniture units 14. In the arrangement shown in FIGS. 1 & 2, at least some of the conventional workstations 12 are preferably oriented so that they open outwardly to the open space 2 in which furniture system 1 is located, so as to provide convenient access to any participant workers.

Figure 4:
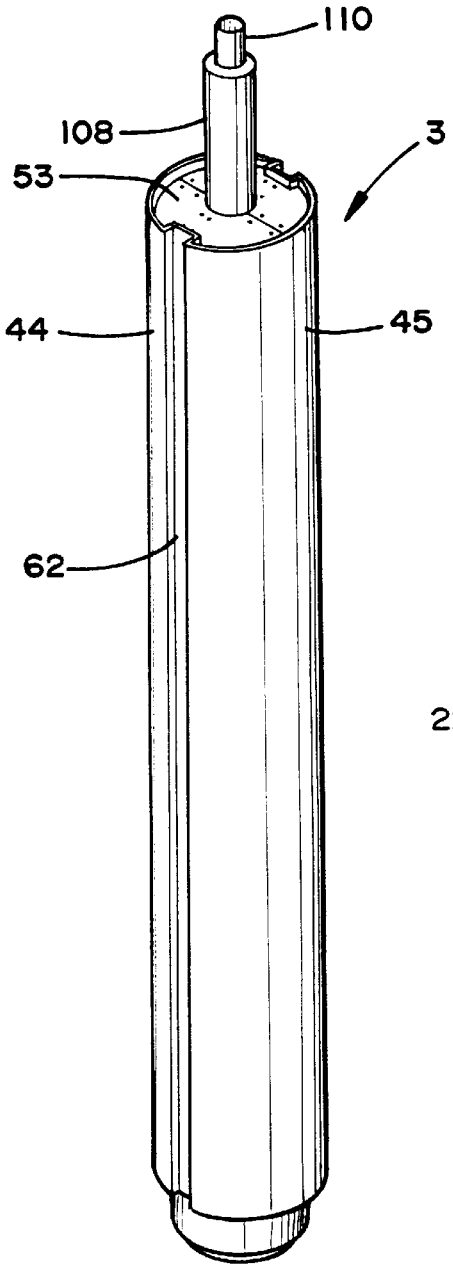
FIG. 4 is a perspective view of a column portion of the furniture system.
Figure 6:
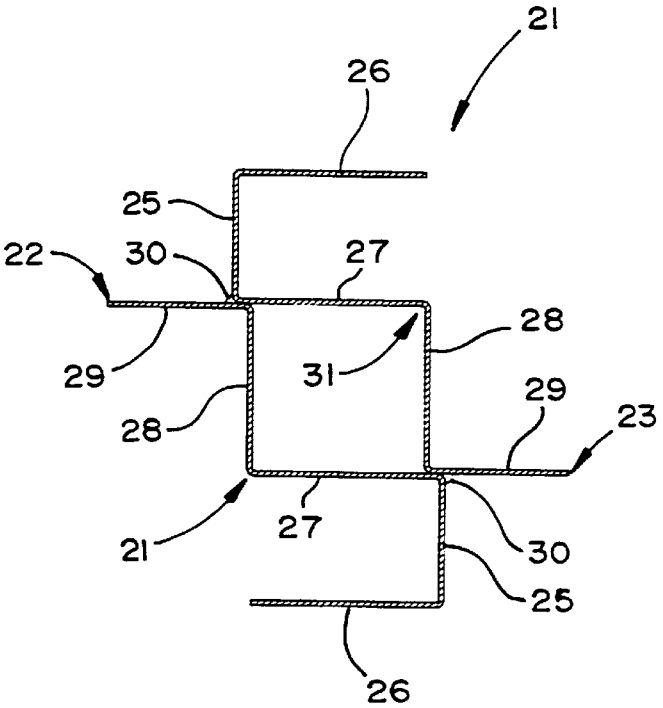
FIG. 6 is a top plan view of an inner core portion of the column.
Figure 5:
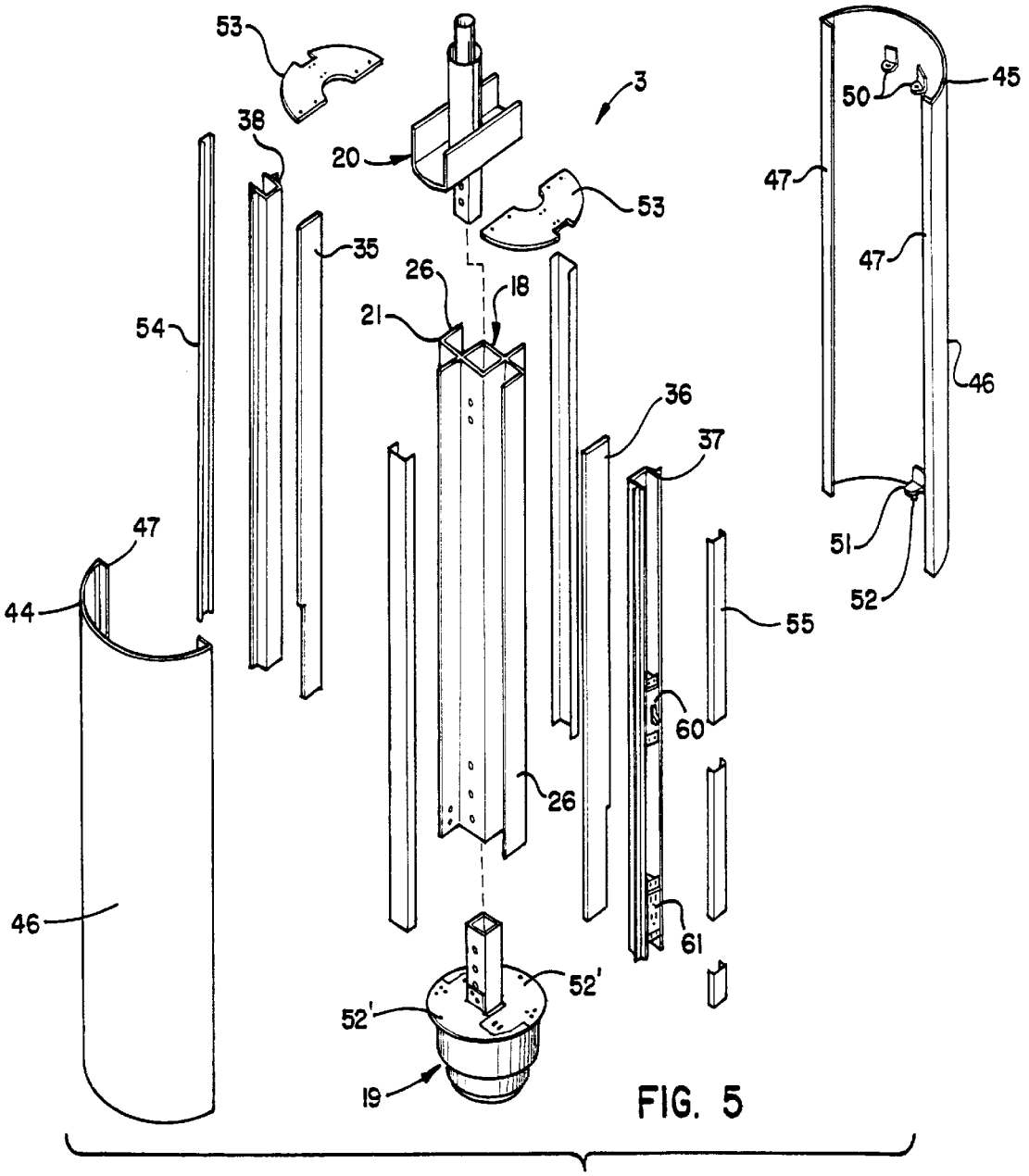
FIG. 5 is an exploded, perspective view of the column.

As best illustrated in FIGS. 4 and 5, columns 3 have a substantially identical construction, wherein each comprises a core assembly 18, a foot assembly 19, and a beam connector assembly 20. Core assembly 18 (FIG. 5) includes an elongated, rigid weldment 21, which extends continuously between foot assembly 19 and beam connector assembly 20. As best illustrated in FIG. 6, weldment 21 comprises two, substantially identical, formed channel segments 22 and 23, each of which has a U-shaped portion, comprising a web 25 and outwardly extending flanges 26 and 27, and an L-shaped portion, comprising perpendicularly disposed flanges 28 and 29. Channel segments 22 and 23 are positioned in a back-to-back fashion, with the edges between flanges 25 & 27 and 28 & 29 respectively, abutting and fixedly interconnected by means such as the illustrated weld beads 30. The resultant structure forms a central tube 31 having a substantially square lateral cross-sectional shape, with two pairs of flanges 25 & 26, and 29, respectively, extending outwardly from central tube 31.

Core assembly 18 (FIG. 5) also includes a pair of external raceway blocks 35 and 36, which extend along and are fastened to the exterior surfaces of core flanges 26. Raceway blocks 35 and 36 perform a spacing function, and in the illustrated example, are electrically insulative, being constructed of plastic, wood, or the like. A pair of external raceways 37 and 38 are attached to the exterior surfaces of raceway blocks 35 and 36 respectively, and are adapted to mount various electrical units therein, as described in greater detail hereinafter. The illustrated external raceways 37 and 38 are substantially identical, and each has a general U-shaped top plan configuration, comprising a central web 39 (FIG. 7) with a pair of outwardly extending flanges 40. Each raceway flange 40 includes a barb-shaped hook 41 which projects laterally outwardly from an external, medial portion of the flange, and a pair of inwardly facing grooves 42 and 43 located adjacent the free end of the flange 40.

A pair of removable column covers 44 and 45 (FIGS. 4 & 5) are provided to enclose the opposite sides of core assembly 18. Column covers 44 and 45 have a substantially identical construction, each including a generally, semi-circularly shaped exterior panel 46 with a pair of inwardly facing, L-shaped flanges 47 extending along the opposite sides thereof. The outer edges 48 (FIG. 7) of column cover flanges 47 are bent rearwardly toward the interior of the associated exterior panel 46, and form fastener edges 49 that are closely received within the associated hooks 41 on raceways 37 and 38 to form a snap-lock therebetween, which assists in securely, yet detachably mounting column covers 44 and 45 on core assembly 18. Each column cover 44 and 45 also includes a pair of upper registration plates 50 (FIG. 5) mounted on the interior surface of panel 46 adjacent the upper end thereof, and a lower registration plate 51 and associated depending pin 52 adjacent the lower end of panel 46. Column cover registration pin 52 is shaped to be received in a mating aperture 52' in foot assembly 19, and upper registration plates 50 and 51 are fastened to a split, top cover 53 of core assembly 18, as described in greater detail below.

Figure 7:
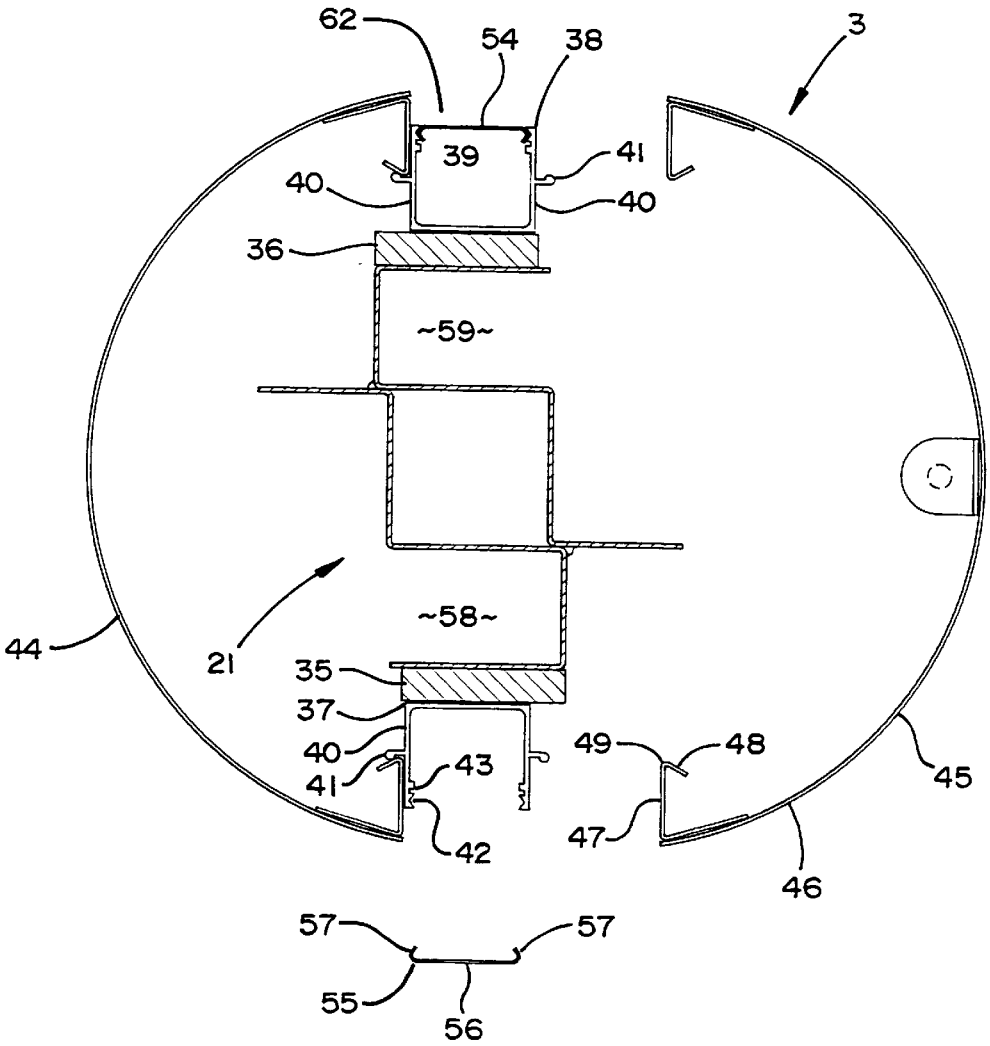
FIG. 7 is a top plan view of the column, shown with one side cover thereof, and one channel cover thereof exploded away to reveal internal construction.
Figure 8:
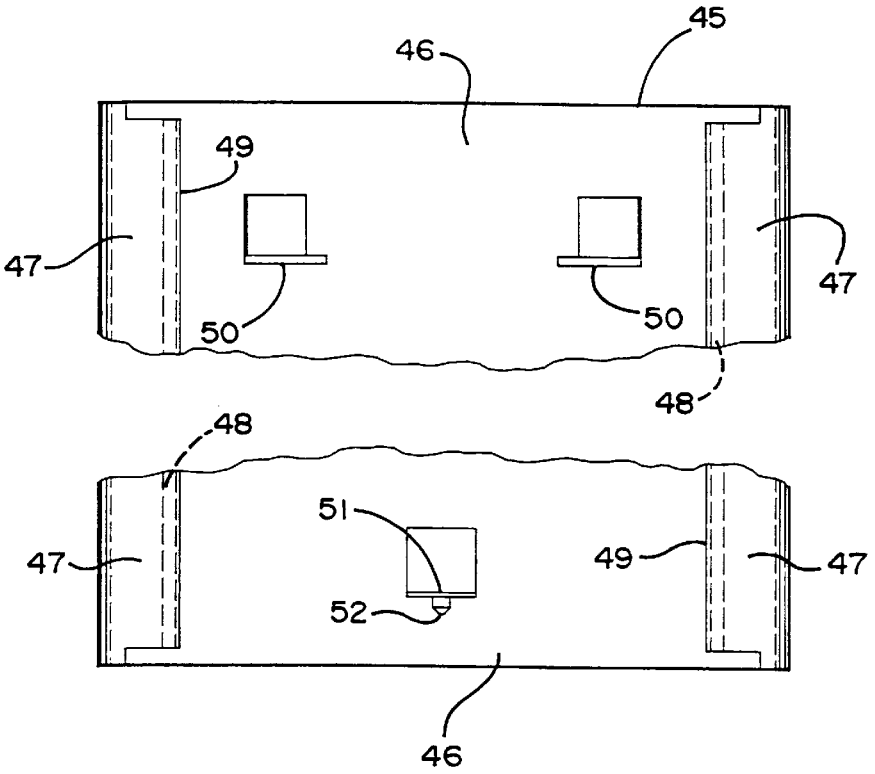
FIG. 8 is a fragmentary, side-elevational view of the interior side of the column cover.

A pair of external raceway access covers 54 and 55 (FIG. 7) are also included in core assembly 18, and have a shallow, U-shaped configuration, comprising a flat exterior plate 56, and inwardly turned, opposite side edges 57 that are received in the exteriormost grooves 42 of external raceways 37 and 38 to form a snap-lock therebetween. Raceway covers 54 and 55 are shaped to enclose that portion of the external raceways 37 and 38 in which associated electrical units are not mounted. For example, in the example illustrated in FIG. 5, a power switch 60 and receptacle 61 are mounted within external raceway 37. Power switch 60 is positioned to protrude slightly from external raceway to facilitate ready access, while receptacle 61 is positioned so that it is generally flush with the exterior of the raceway covers 54 and 55. Raceway cover 54 is split into three separate sections to extend between the bottom of switch 60 and the top of receptacle 61, between the top of switch 60 and top cover 53, as well as between the bottom of receptacle 61 and foot assembly 19. As best illustrated in FIGS. 4 and 7, external raceways 37 and 38, as well as their associated covers 54 and 55 respectively, are inset from the exterior surfaces of column covers 44 & 45, thereby forming a pair of external grooves 62 which extend longitudinally along diametrically opposed sides of column 3. External grooves 62 are interrupted by the outwardly protruding electrical units mounted within the external raceways 37 and 38, such as the switch 60 and receptacle 61 shown in FIG. 5.

Core weldment 21 defines a pair of internal raceways 58 and 59 (FIGS. 6 & 7) between both sets of flanges 25, 26 and 27 to facilitate the routing of power and cable wires through columns 3, as described in greater detail below. Preferably, each one of the internal raceways 58 and 59 is closely associated with one of the external raceways 37 and 38, so that wires can be routed therebetween, and the wires in each set remain physically separated from the other set to avoid both mechanical and/or electrical interference therebetween. In the illustrated example, internal raceway 58 and external raceway 37 are associated with one another, and are preferably dedicated to power wiring, such as 110 volt AC lines, 220 volt AC lines, and the like, while internal raceway 59 and external raceway 38 are associated with each other, and are preferably dedicated to low voltage cabling, such as telephone lines, data lines, etc.

Figure 9:
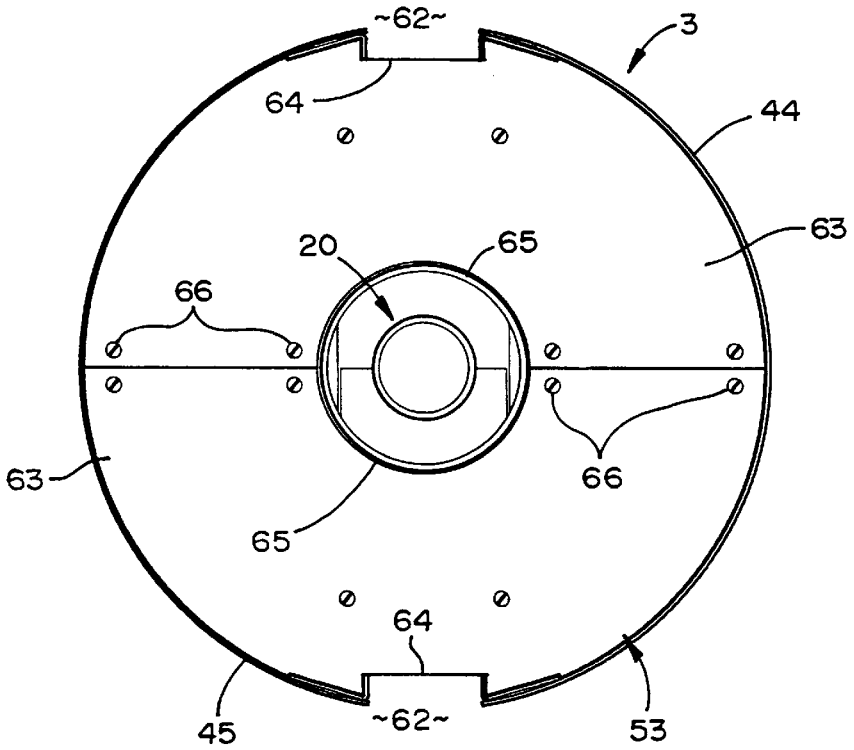
FIG. 9 is a top plan view of the column.

Top cover 53 (FIG. 9) includes two, substantially identical halves 63, each of which has a generally semi-circular, top plan configuration, and includes a central, circumferential notch 64, which mates with associated exterior groove 62 along column 3, between adjacent column covers 44 and 45. Top plate halves 63 also include a central, semi-circularly shaped cutout 65 to receive an associated portion of the beam connector assembly 20 therethrough. Fasteners 66 securely mount top plate halves 63 to column covers 44 and 45, as well as underlying core assembly 18.

Figure 11:
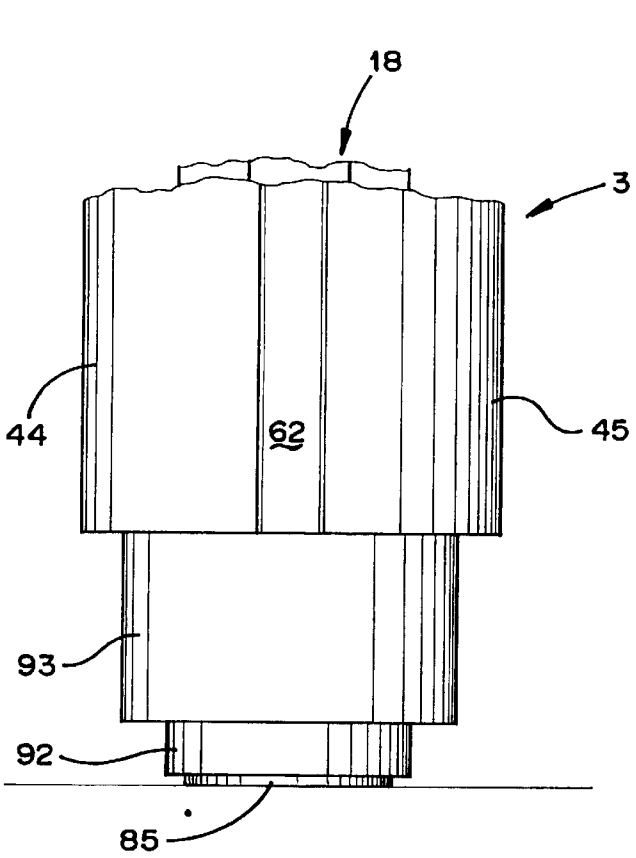
FIG. 11 is a fragmentary, side elevational view of the column foot.
Figure 10:
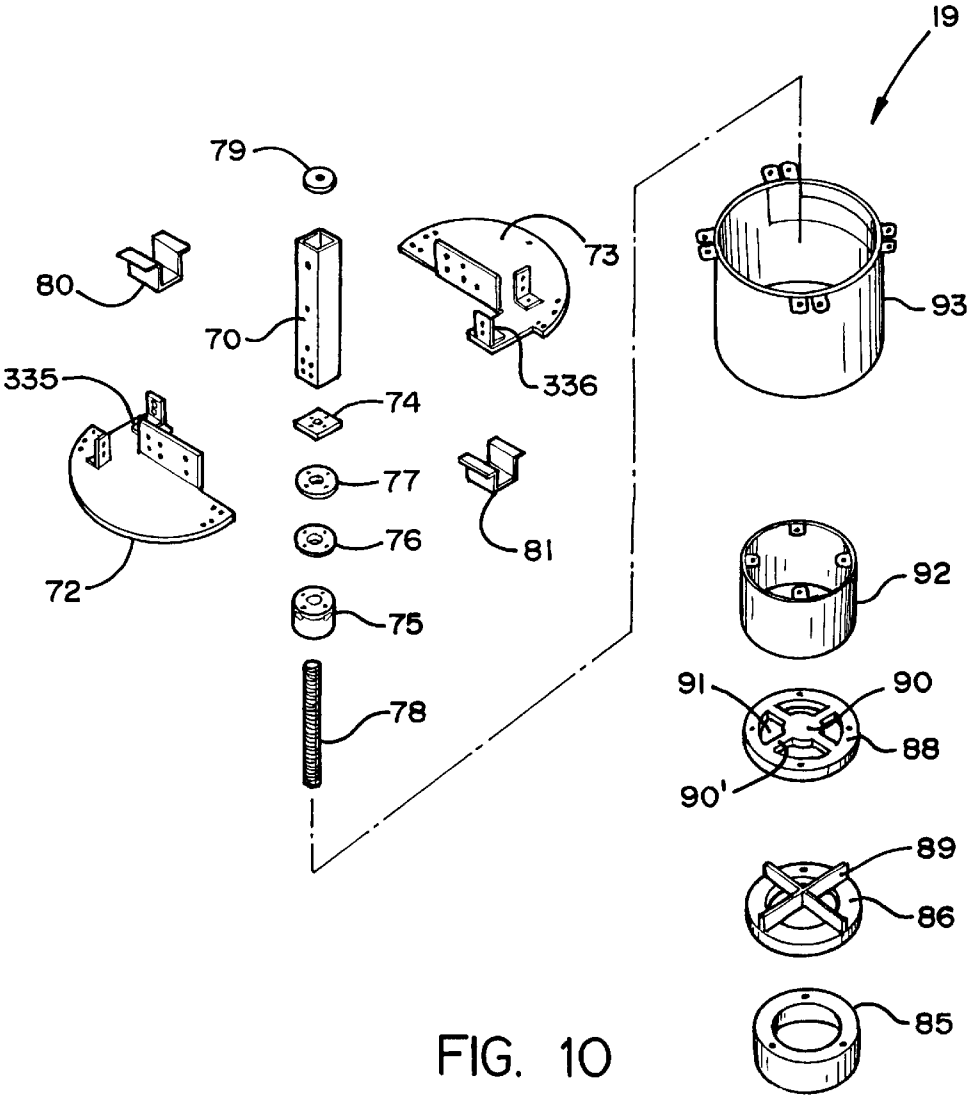
FIG. 10 is an exploded, perspective view of a foot portion of the column.
Figure 12:
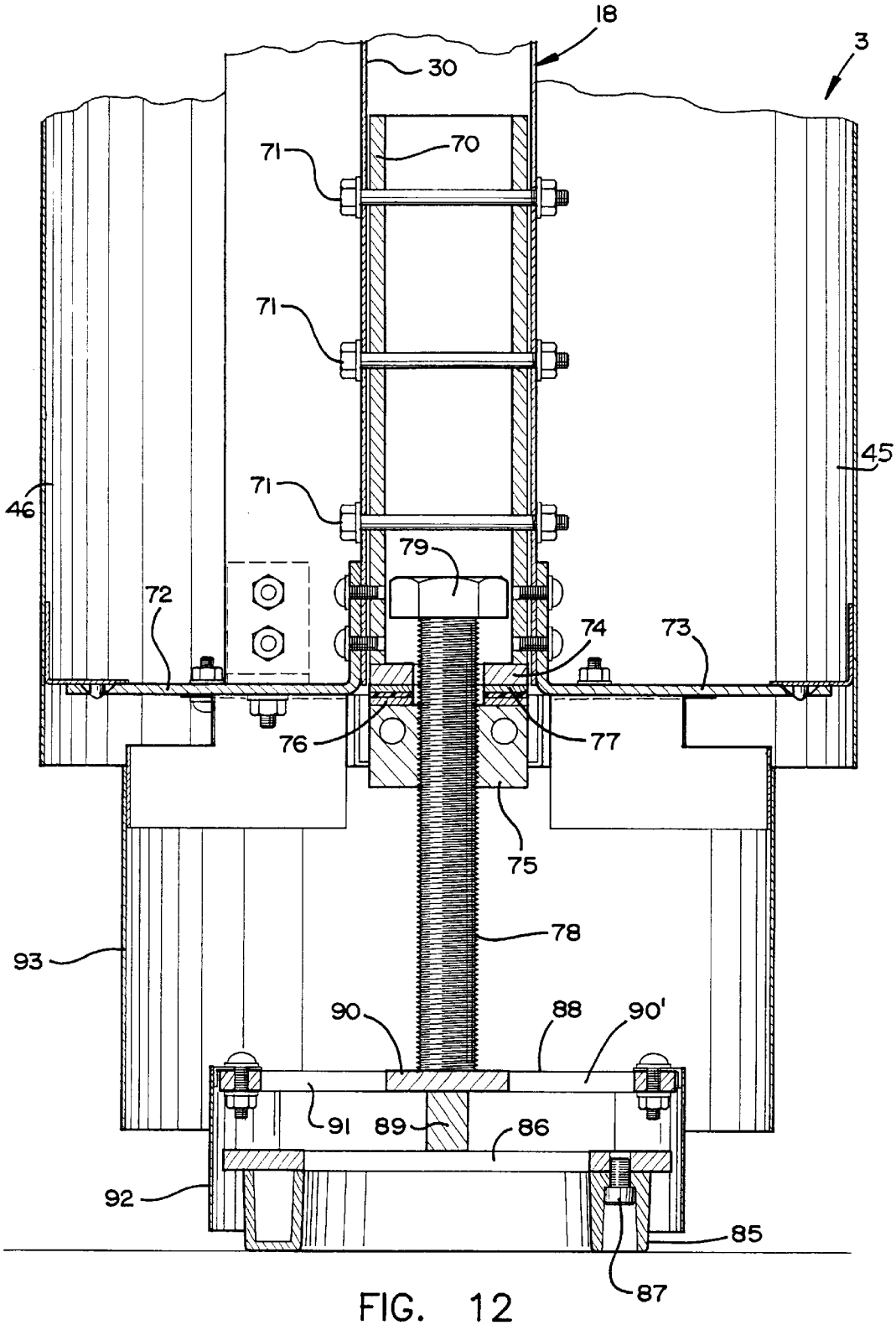
FIG. 12 is a fragmentary, vertical cross-sectional view of the column foot.

Foot assembly 19 (FIGS. 10–12) is connected with the lower end of core assembly 18, and provides vertical adjustment for column 3 to accommodate for any undulations or unevenness in the floor 5 of the building room. In the illustrated foot assembly 19, a structural tube joint 70 is provided, having a substantially square, top-plan configuration shaped to be closely received within the lower end of tube 31 in core assembly 18. As best illustrated in FIG. 12, laterally extending through bolts 71 securely interconnect structural tube joint 70 and core assembly 18. A pair of structural base plates 72 and 73 (FIG. 10) are attached to the lower end of structural tube joint 70. A structural tube joint base 74 is securely mounted within the interior of structural tube joint 70 at the lower end thereof, and serves to support a height adjustment nut 75, and a pair of height adjustment pads 76 and 77. Adjustment pads 76 and 77 serve to alleviate friction and corrosion between nut 75 and base 74, and in the illustrated example, adjustment pad 77 is fastened to base 74, and adjustment pad 76 is fastened to nut 75. A height adjustment bolt 78 has the upper portion thereof threadedly engaged in height adjustment nut 75, with a limit nut 79 attached to its uppermost end. A pair of U-shaped, external raceway base plates 80 and 81 are attached to an associated one of the structural base plates 72 and 73, and serve to close the lower ends of external raceways 37 and 38.

Foot assembly 19 (FIG. 10) also includes a foot base 85 adapted to abuttingly engage the floor 5 of the building room, without marring the same. Foot base 85 is attached to an associated lower foot base plate 86 by suitable fasteners, such as the illustrated screws 87 (FIG. 12). Lower foot base 86 is fixedly attached to the lower end of height adjustment bolt 78 by a upper foot base plate 88, and an X-shaped connector 89. Upper foot base plate 88 (FIG. 10) includes a center portion 90 with four radially extending spokes 90' which overlay X-connector 89, so as to form openings 91 therethrough to permit the routing of both power and cable wires through the interior of column 3. Lower foot base plate 86 and foot base 85 both have an annular configuration with open center portions, which communicate with the radial openings in upper foot base plate 88 to permit power and cable wires to be routed completely through foot assembly 19, and into the floor 5 of the building.

A lower foot cover 92 (FIGS. 10–12) is attached to upper foot base plate 88, and extends downwardly therefrom to telescopingly enclose lower foot base 86 and foot base 85. An upper foot cover 93 is attached to the lower surface of structural base plates 72 and 73, and extends downwardly therefrom to telescopingly enclose the height adjustment bolt 78, as well as the upper portion of lower foot cover 92. Rotation of foot base 85 with respect to column 3 raises and lowers the elevation of column 3 to accommodate for any undulations or unevenness in the building floor 5, such that overhead framework 4 can be made level. Foot covers 92 and 93 serve to create an aesthetically pleasing exterior appearance for the foot assembly 19, which mates with the exterior of column 3.

Figure 14:
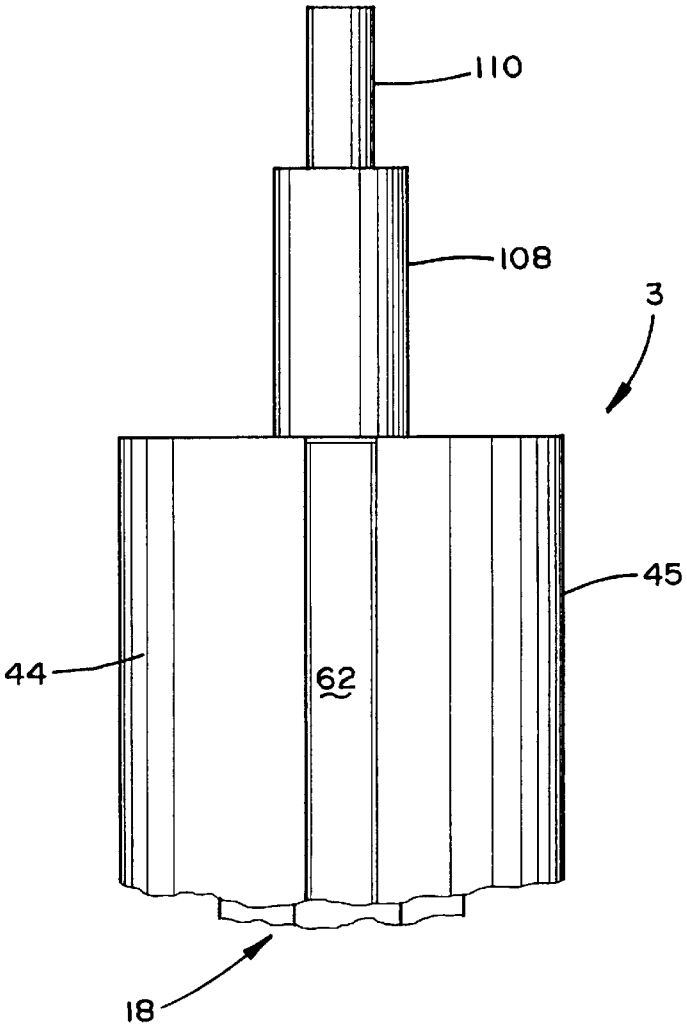
FIG. 14 is a fragmentary, side elevational view of the column top.
Figure 13:
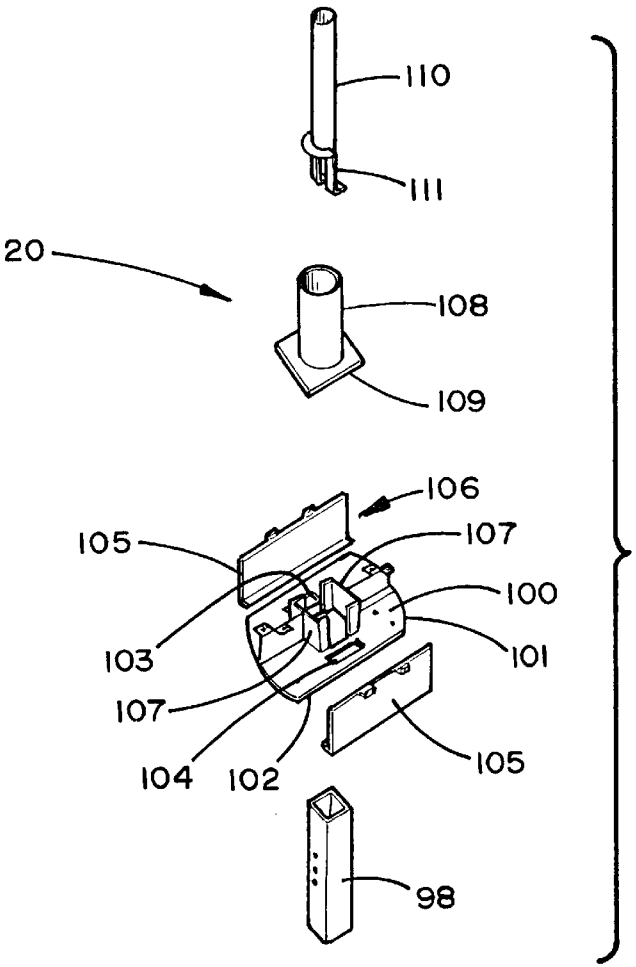
FIG. 13 is an exploded, perspective view of a top portion of the column.
Figure 15:
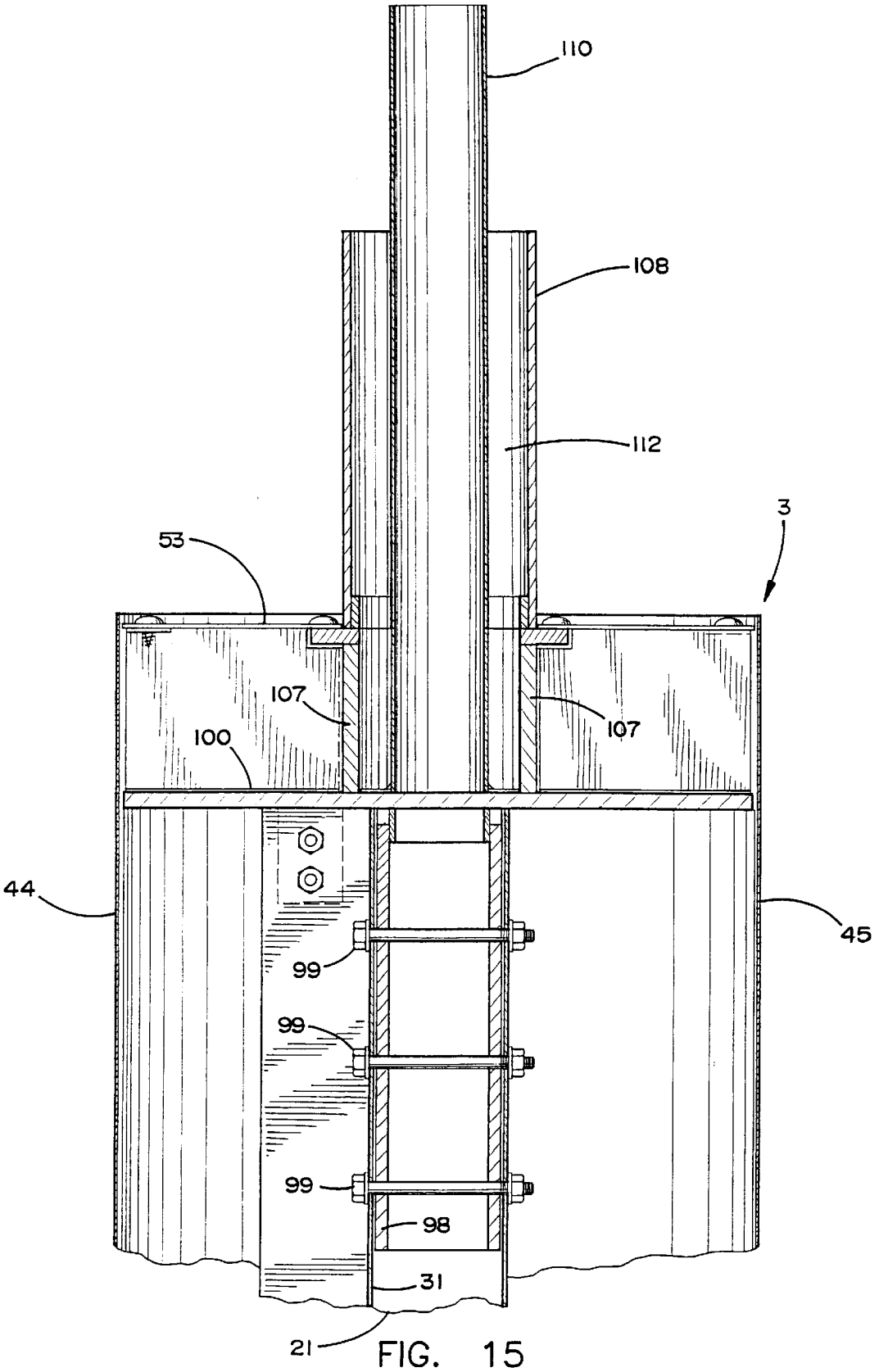
FIG. 15 is a fragmentary, vertical cross-sectional view of the column top.

Each column 3 also includes beam connector assembly 20 (FIGS. 13–15) disposed at the upper end of core assembly 18, which is adapted to connect column 3 with an associated portion of the overhead framework 4. The illustrated beam connector assembly 20 includes a structural tube joint 98 in the form of a rigid post, having a substantially square transverse cross-sectional shape, adapted to be closely received into the interior of core assembly tube 31 (FIG. 15) at the uppermost end of core weldment 21. In the example illustrated in FIG. 15, through bolts 99 extend transversely through the lower end of structural tube joint 98, and securely mount the same within core weldment 21. A top plate 100 (FIG. 13) is fixedly attached to the upper end of structural tube joint 98 by means such, as welding or the like, and has an oblong configuration, with opposite arcuate edges 101, and opposite straight edges 102. A pair of slots or windows 103 and 104 extend through top plate 100 adjacent straight edges 102, and are in vertical alignment with the underlying internal power raceway 58 and internal cable raceway 59 in core assembly 18. A pair of side plates 105 are attached to the straight edges 102 of top plate 100 and extend upwardly therefrom, and in conjunction with top plate 100, form a transition box assembly 106 for both power and cable wiring. A pair of inwardly facing U-shaped brackets 107 are mount on the upper face of top plate 100, interior of windows 1 and 104, and form interior walls for transition box assembly 106.

A connector tube 108 (FIG. 13) is supported on the upper edges of transition box brackets 107 by a tube plate 109. A cable extender tube 110 is provided, having a Z-shaped flange 111 at its lower end. The lower surface of Z-shaped flange 111 is attached to top plate 100 adjacent an associated transition box bracket 107, such that the axial opening in cable extender tube 110 is generally aligned with the center of top plate 100. Cable extender tube 110 has an exterior diameter that is substantially less than the inside diameter of column connector tube 108, and is telescopingly received within the interior of connector tube 108, thereby defining an annularly shaped raceway 112 therebetween.

Figure 62:
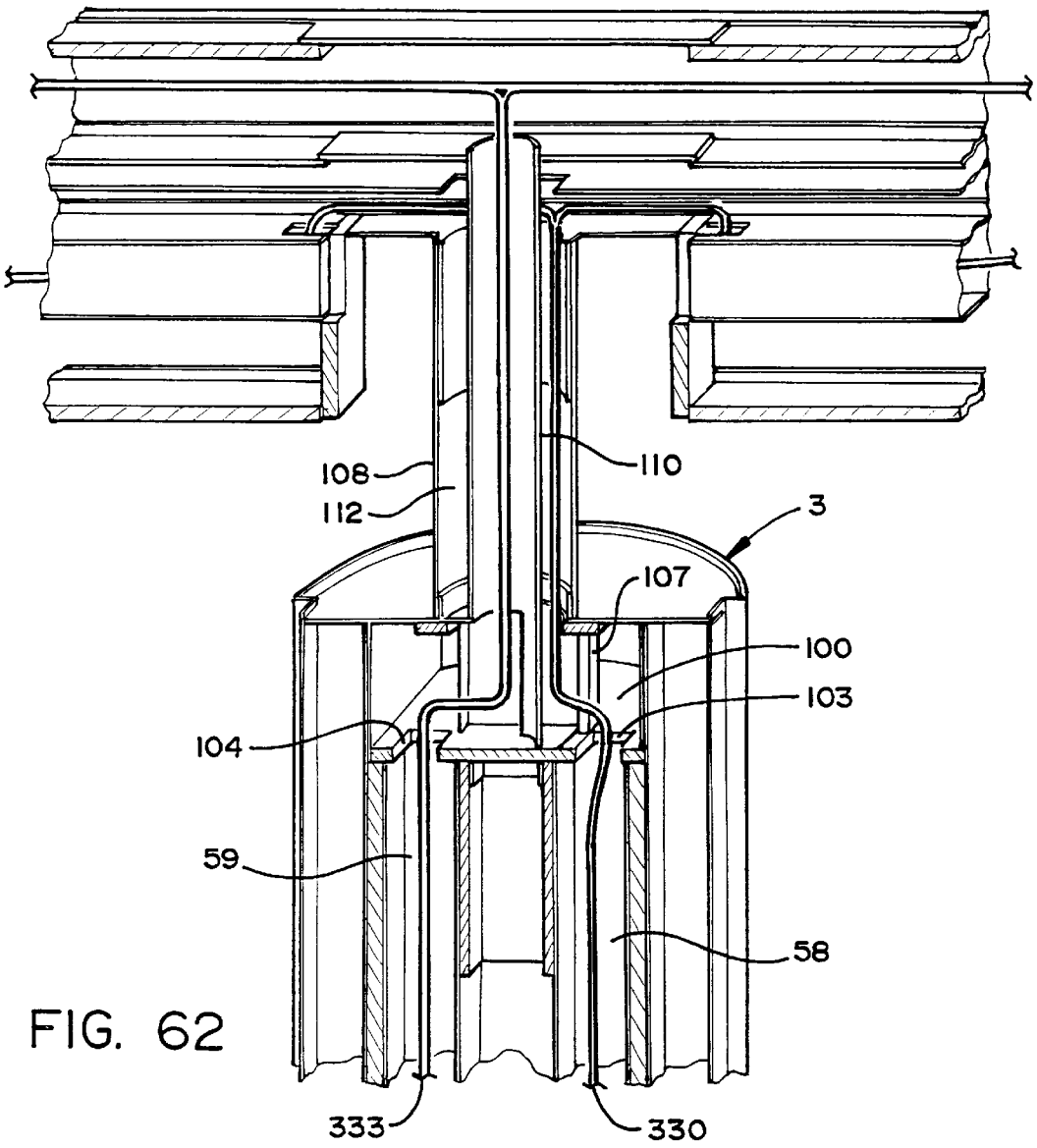
FIG. 62 is a vertical cross-sectional view of an in-line connection shown with power and cable wires routed therethrough.

As best illustrated in FIG. 62, power cables 330 can be routed from the internal power raceway 58 in core assembly 18 through top plate window 103, then laterally inbetween the brackets 107 of transition box 106, and upwardly through the annular raceway 112 formed between connector tube 108 and cable extender tube 110. In like fashion, cable wiring 333 from the interior cable raceway 59 in core assembly 18 can be routed through top plate window 104, then inwardly inbetween the sides of transition box brackets 107, and then upwardly through the center of cable extender tube 110. Power wires 330 and cabling wires 333 are thereby kept physically separated from each other, so as to avoid both mechanical and electrical interference therebetween.

In the furniture system 1 illustrated in FIGS. 1 and 2, overhead framework 4 has a circular top plan configuration, comprising a plurality of arcuately shaped perimeter beam segments 115, and generally straight cross beam segments 116. The illustrated overhead framework 4 comprises eight, substantially identical perimeter beam segments 115, and four, substantially identical cross beam segments 116, all of which are interconnected, and in turn attached to eight columns 3 by various type of connectors 117, as described in greater detail hereinafter.

With reference to FIGS. 16–21, each perimeter beam segment 115 has a substantially I-shaped, lateral cross-sectional configuration, comprising a central web 121 (FIGS. 17–21), with upper and lower flanges 122 and 123 respectively, fixed along opposite upper and lower edges thereof. Upper flange 122 includes a pair of depending side flanges 124, having downwardly inclined free edges 125 which face toward the exterior of the beam segment. Lower flange 123 includes a pair of upstanding side flanges 126, with squared-off, upwardly facing free edges 127. Perimeter beam segment 115 also includes three intermediate flanges 128–130 which project laterally outwardly from both sides of web 121. The uppermost or top intermediate flange 128 includes a pair of upstanding side flanges 131, having downwardly inclined free edges 132 which face toward the exterior of the beam segment. Middle intermediate flange 129 also includes a pair of side flanges 133, wherein the same extend both upwardly and downwardly of middle flange 129, and each includes an inclined, upper free edge 134 which faces toward the exterior of the beam 70, and a squared-off lower free edge 135. The lowermost or bottom intermediate flange 130 includes a pair of upstanding side flanges 137, each with a squared off upwardly facing free edge 137. Bottom intermediate flange 130 also includes two pairs of upstanding auxiliary ribs 138, which in conjunction with two pairs of similar auxiliary ribs 139 depending from middle intermediate flange 129, and a pair of horizontal ribs 140 on web 121, facilitate mounting electrical bus strips 158 (FIG. 66) on opposite sides of beam segment 115 ribs for task lighting fixtures 159 and the like, as described below.

The opposite ends of perimeter beam segments 115 (FIGS. 19–21) are equipped to detachably interconnect adjacent beam segments 115. Each end of the illustrated perimeter beam segment 115 includes two pairs of fastener apertures 142 which extend horizontally through web 121 between intermediate flanges 128 & 129 and 129 & 130, respectively. A pair of threaded top cover plate apertures 143 extend vertically into a flattened terminal area on the upper surface of top flange 122, and three, threaded lower cover plate apertures 144 extend horizontally into lower flange 123, and a lower portion of web 121 between flanges 123 and 130.

Snap-on, removable beam covers 145 (FIGS. 18 & 19) are provided to selectively enclose the space between upper flanges 122 and middle intermediate flanges 129. Each of the illustrated beam covers 145 comprises a substantial flat strip 146 with spaced apart grooves or reveals 147 extending longitudinally along the exterior surface thereof for ornamental purposes. Two, U-shaped hooks 148 and 149 protrude laterally from the interior surface of strip 146. The upper hook 148 has a downwardly extending leg 150 which locks behind the inclined edge 132 of upper intermediate flange 128. The lower hook 149 also has a downwardly protruding leg 151 which locks behind the inclined edge 134 of middle intermediate flange 129. A top flange 152 extends laterally inwardly from the upper edge of strip 146, and covers an associated upper surface of upper flange 122. Preferably, beam cover 145 is slightly flexible along its longitudinal axis to conform with the arcuate shape of the perimeter beam segments 115, and may be constructed from an extruded aluminum, vinyl, or the like.

Each perimeter beam segment 115 has associated therewith both an inner and an outer one of the beam covers 145 associated therewith to enclose the upper portions of both sides of the beam segment 115. Each illustrated beam cover 145 is slightly longer than the length of the side face of the beam segment 115 it is covering, and extends generally to the centerline of the associated column 3 at which the ends of the perimeter beam segments 115 are interconnected, so as to provide a substantially continuous enclosure or cover over the exterior of overhead framework 4.

The multi-flanged configuration of perimeter beam segments 115 (FIGS. 19–21), particularly in conjunction with beam covers 145, form utility ways or channels which assist in the operation of furniture system 1. In the illustrated example, the two spaces between upper flange 122 and top intermediate flange 128 define a pair of raceways 155 that are particularly adapted to route cabling, or similar low voltage wires therethrough, such as wiring for communications equipment, data lines, signal lines, and the like. Cable raceways 155 are easily accessed from either side of perimeter beam segment 115 by simply removing the associated beam cover 145. The cable raceways 155 in perimeter beam segments 115 also communicate with the interior cable raceways 59 in the columns 3, in the manner described in greater detail hereinafter.

The two spaces between top intermediate flange 128 and middle intermediate flange 129 also define a pair of raceways 156, which in the illustrated example, are particularly adapted to route power wires through the furniture system 1. Electrical power wires 330 connected with conventional building sources, or the like, are routed through the power raceways 156 to provide electrical power to various locations throughout the furniture system. Power raceways 156 communicate with the interior power raceways 58 in columns 3, as described below.

Figure 66:
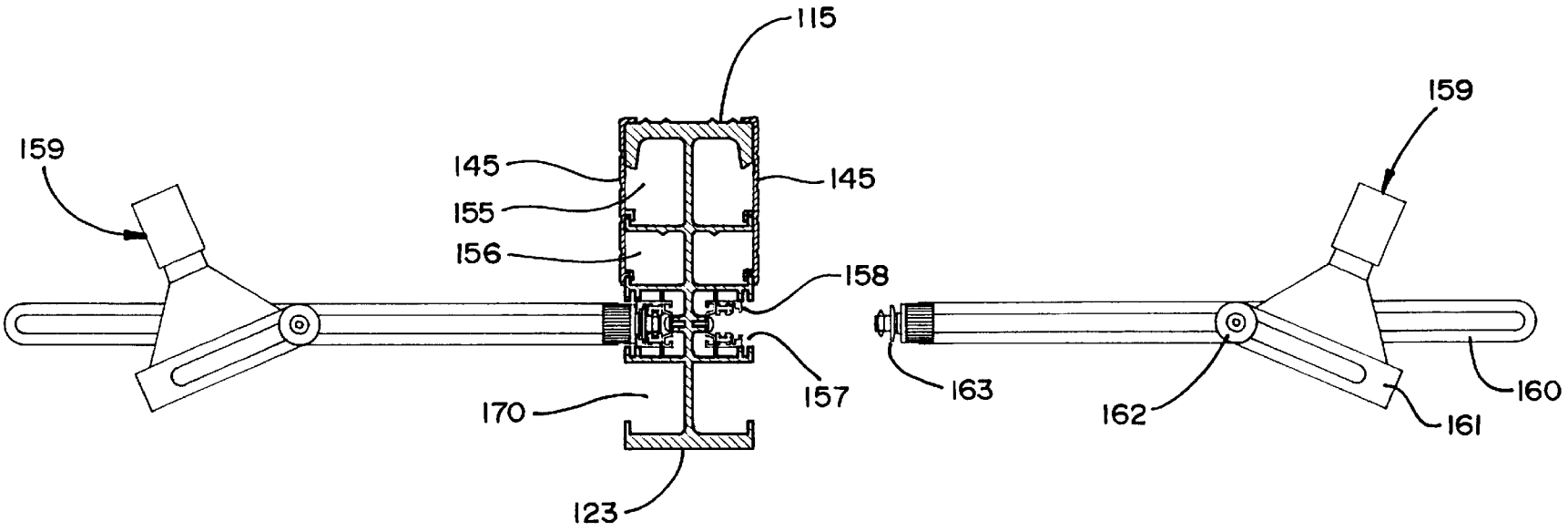
FIG. 66 is a vertical cross-sectional view of a perimeter beam segment, shown with associated task lighting mounted thereon.

As previously noted, the spaces between middle intermediate flange 129 and bottom intermediate flange 130 form a pair of raceways 157 in which two electrical lighting bus strips are mounted. As best illustrated in FIG. 66, an elongate, electrical bus strip 158 is mounted in each of the two bus raceways 157. The illustrated electrical bus strips 158 have a conventional construction, and are adapted to mount associated lighting fixtures 159 therein, such as the track system marketed under the brand "STAFF" by Staff Sales, Inc. of Highland, N.Y. Lighting fixtures 159 each include a loop-shaped arm 160 on which a focused tasklamp 161 is mounted by an adjustable connector knob 162, which permits both horizontal and rotational adjustment of lamp 161. Each lighting fixture 159 includes a snap-lock connector 163 at its inner end which mates with electrical bus 158 by axially rotating lighting fixture 159, thereby mechanically attaching lighting fixture 159 to electrical bus 158, and simultaneously making an electrical connection therebetween.

Figure 17:
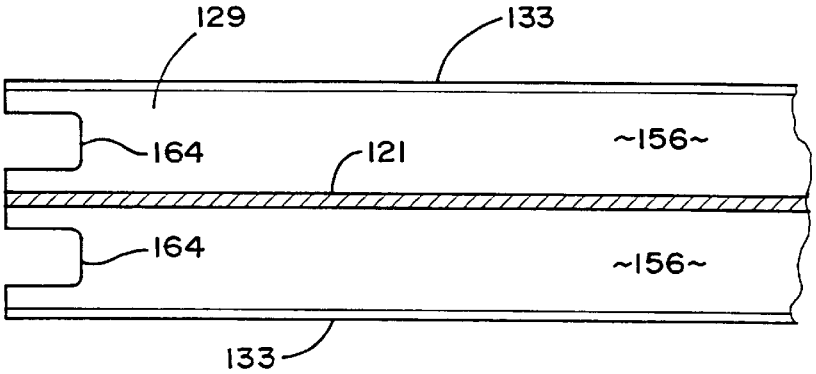
FIG. 17 is a fragmentary, horizontal cross-sectional view of a perimeter beam segment, taken along the line XVII—XVII, FIG. 19.
Figure 18:
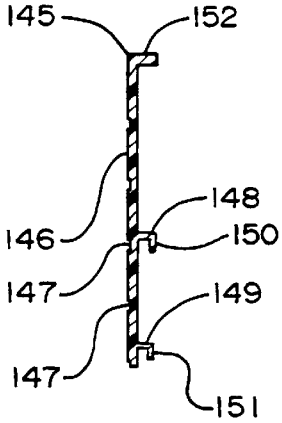
FIG. 18 is a vertical cross-sectional view of a cover for the perimeter beam segment.
Figure 19:
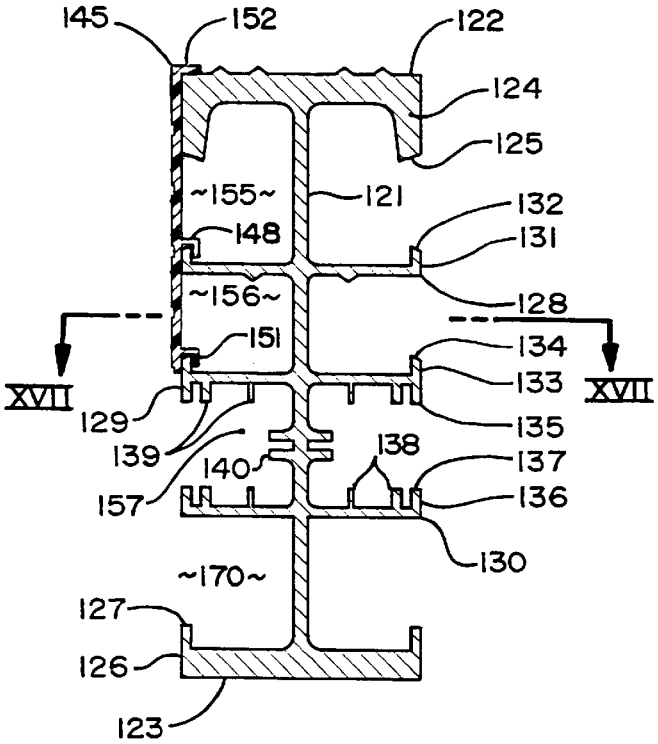
FIG. 19 is a vertical cross-sectional view of the perimeter beam segment, shown with the cover installed on one side thereof.
Figure 20:
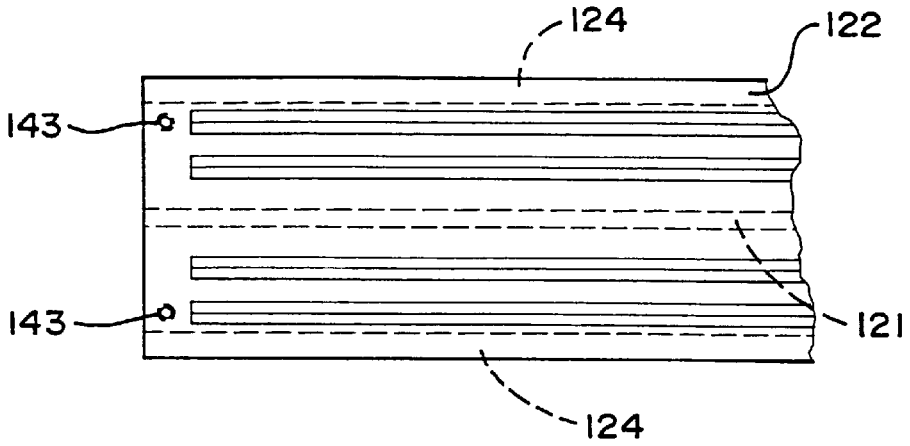
FIG. 20 is a fragmentary, top plan view of the perimeter frame segment.
Figure 21:
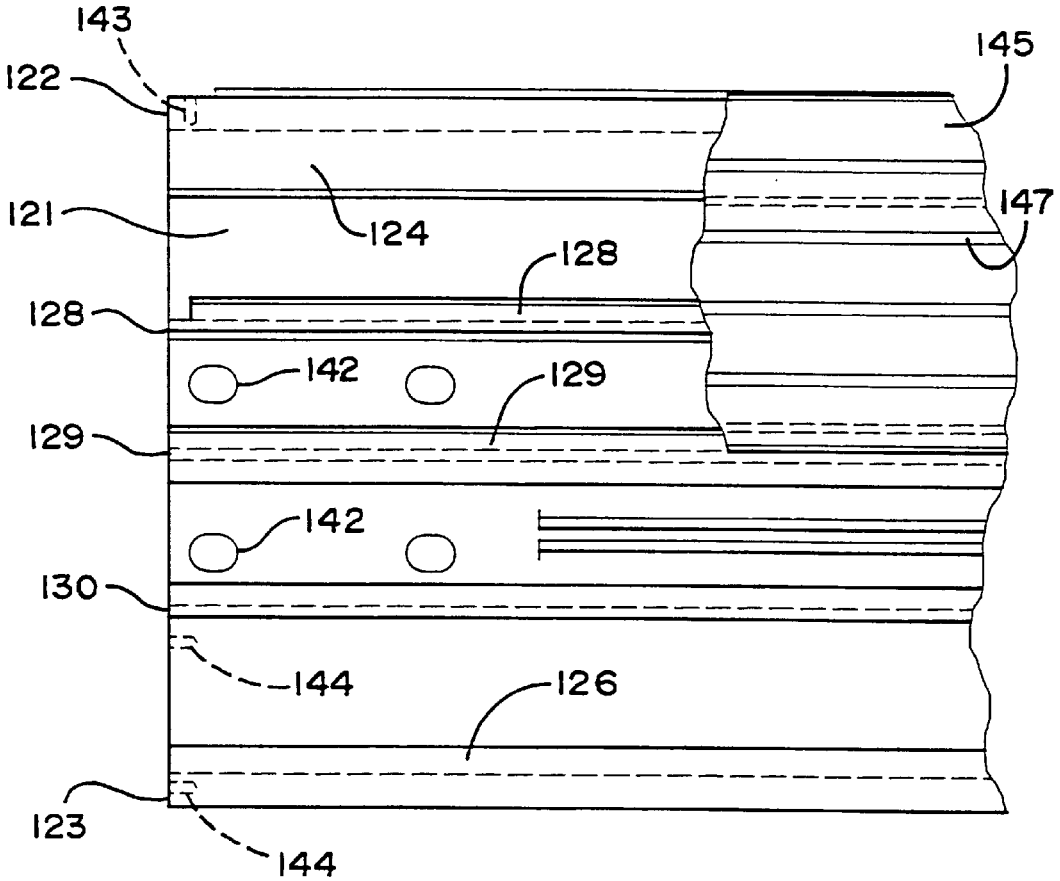
FIG. 21 is a fragmentary, side elevational view of the perimeter frame segment, shown with the cover installed thereon, and wherein a portion of the cover has been broken away to reveal internal construction.

As best illustrated in FIG. 17, the ends of each perimeter beam segment 115 include two U-shaped cutouts 164, through the middle intermediate flange 129 which provide access for wires in the beam power raceways 156 to extend into the bus raceway 157 for connection with bus strips 158. The space between lower flange 123 (FIGS. 19–21) and bottom intermediate flange 130 defines a panel hanger way or channel 170 in which panel 6 are detachably suspended, as explained more fully below.

Figure 22:
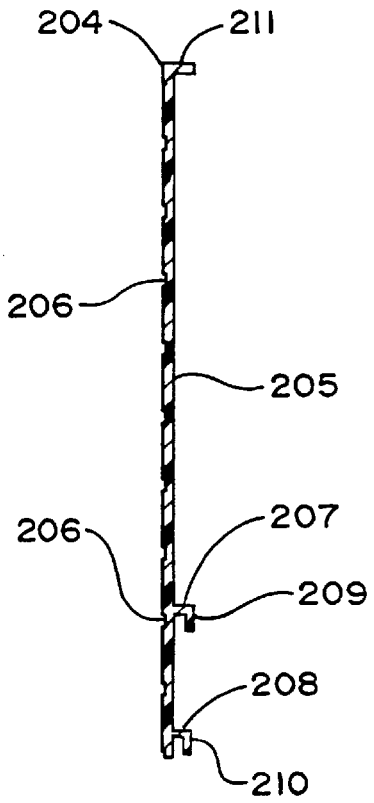
FIG. 22 is a vertical cross-sectional view of a cover for a cross beam segment of the overhead framework.
Figure 23:
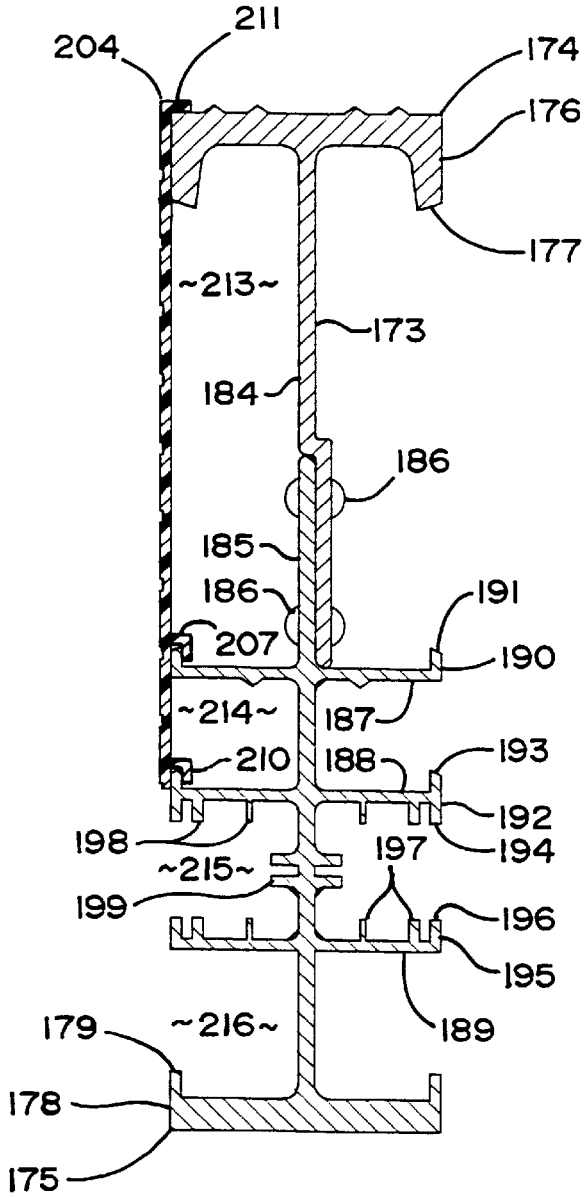
FIG. 23 is a vertical cross-sectional view of the cross-beam segment, shown with the cover installed on one side thereof.
Figure 24:
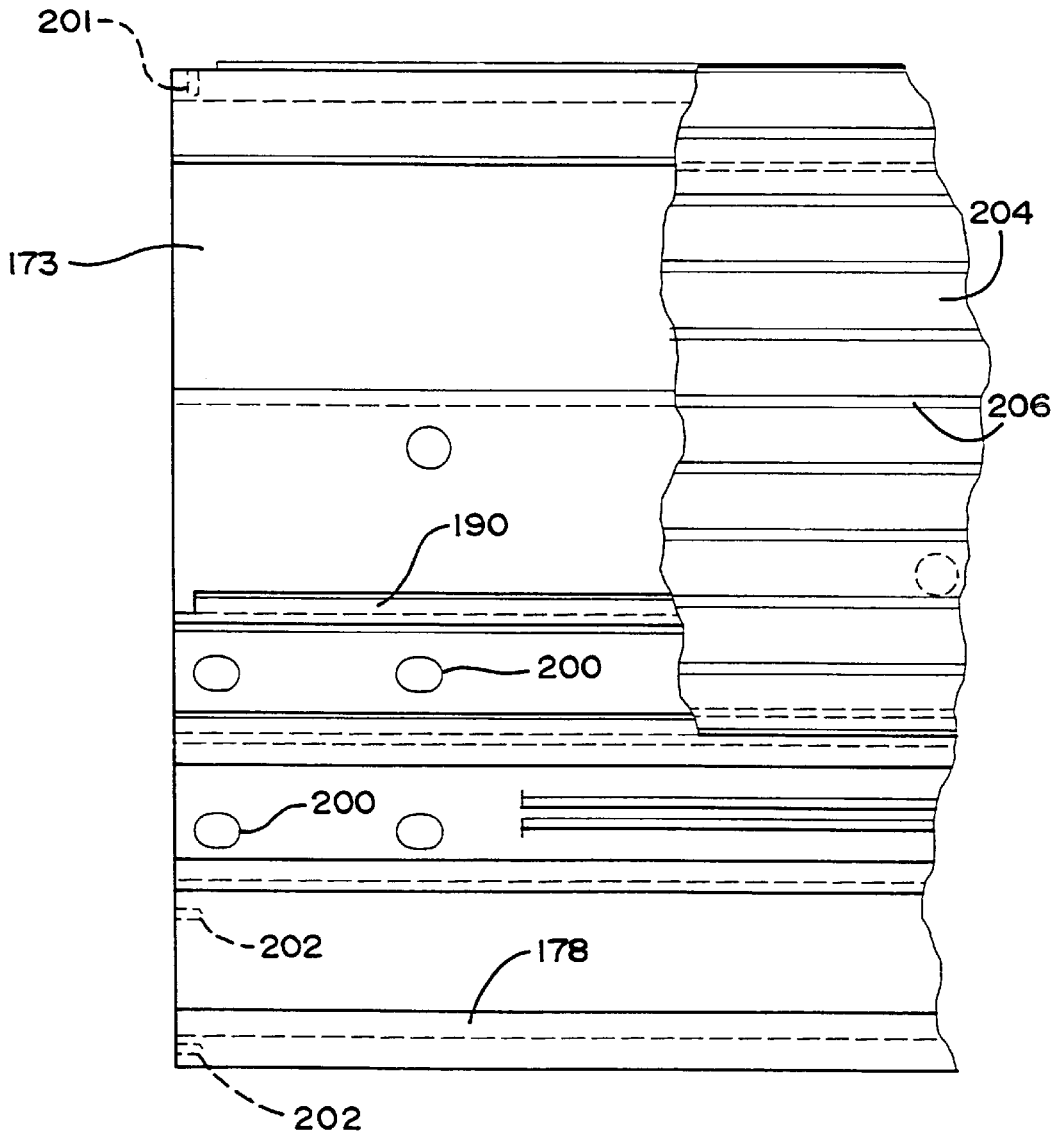
FIG. 24 is a fragmentary, side elevational view of the cross-beam segment, shown with the cover installed thereon, and wherein a portion of the cover is broken away to reveal internal construction.

With reference to FIGS. 22–24, cross beam segments 116 are substantially identical, and each has a vertical cross-sectional shape somewhat similar to that of a perimeter beam segment 115, except that cross beam segments 116 are slightly taller or thicker in the vertical direction to provide increased structural support to span the interior of overhead framework 4 without sagging. Cross beam segments 116 each have a generally I-shaped vertical cross-sectional configuration, comprising a web 173, with upper and lower flanges 174 and 175 respectively, extending along opposite top and bottom edges thereof. Upper flange 174 includes a pair of depending side flanges 176, having downwardly inclined free edges 177 which face toward the exterior of cross beam segment 116. Lower flange 175 includes a pair of upstanding side flanges 178, each of which has a squared-off, upwardly facing free edge 179.

Unlike perimeter beam segment 115, each cross beam segment 116 has a two-piece construction, comprising a T-shaped upper portion 184, and a flanged lower portion 185. The flanged lower portion 185 of cross beam segment 116 is substantially identical to the lower portion of perimeter beam segment 115, and is defined by perimeter beam flanges 123, 130, 129 and 128. The lower portion of T-shaped beam segment 184 is fixedly attached to the upper portion of flanged beam segment 185 by means such as the illustrated rivets 186.

The flanged lower portion 185 of cross beam segment 116 includes three, intermediate flanges 187–189, which extend laterally outwardly from opposite sides of web 173. Top intermediate flange 187 includes a pair of upstanding side flanges 190 with inclined free edges 191 which face toward the exterior of cross beam segment 116. Middle intermediate flange 188 includes a pair of side flanges 192, which extend both upwardly and downwardly of middle intermediate flange 188, with a pair of upper, inclined free edges 193 which face toward the exterior of cross beam segment 116, and a pair of squared off, downwardly facing lower edges 194. Bottom intermediate flange 189 includes a pair of upstanding side flanges 195 with upstanding squared off free edges 196. Bottom intermediate flange 189 also includes two pairs of upstanding auxiliary ribs 197, which in conjunction with two pairs of similarly shaped auxiliary ribs 198 depending from middle intermediate flange 188, and a pair of horizontal ribs 199 on web 173, serve to mount electrical bus strips 158 therein.

The opposite ends of cross beam segments 116 are equipped to detachably interconnect adjacent beam segments. Each end of the illustrated cross beam segment 116 includes two pairs of fastener apertures 200 which extend horizontally through web 173 between intermediate flanges 187 & 188 and 188 & 189, respectively. A pair of threaded top cover plate apertures 201 extend vertically into a flattened terminal area on the upper surface of top flange 122, and three, threaded lower cover plate apertures 202 extend horizontally into lower flange 175, and a lower portion of web 173 between flanges 175 and 189.

Snap-on, removable beam covers 204 (FIGS. 22–24) are provided to enclose the spaces disposed between upper flanges 174 and middle intermediate flanges 188. Beam covers 204 are similar to perimeter beam covers 145, and each comprises a substantially flat elongate strip 205, having a plurality of longitudinal extending reveals or grooves 206 extending along the exterior surface thereof for improved aesthetics. Two U-shaped hooks 207 and 208 protrude laterally from the interior surface of strip 205 to attach cover 204 to the opposite sides of an associated cross beam segment 116. The upper hook 207 includes a downwardly extending leg 209 which locks behind the inclined edge 191 of upper intermediate flange 187. The lower hook 208 also includes a downwardly extending leg 210 which locks behind the inclined edge 193 of middle intermediate flange 188. A top flange 211 extends laterally inwardly from the upper edge of strip 146, and covers and associated upper surface of upper flange 174. Beam covers 204 are preferably constructed from the same material as perimeter beam covers 145 to provide a consistent, finished appearance to furniture system 1. The illustrated beam covers 204 are somewhat flexible along their longitudinal axis, and have a length slightly longer than that of the associated cross beam segment 116 to abuttingly mate with the covers 145 on perimeter beam segments 115.

Like perimeter beam segments 115 (FIGS. 23–24), the flanged arrangement of cross beam segments 116, in conjunction with covers 204 forms utility channels which facilitate the operation and use of furniture system 1. In the illustrated example, the spaces between each upper flange 174 and top intermediate flange 187 define a pair of cable raceways 213, which communicate not only with the interior cable raceways 59 in columns 3, but also with the cable raceways 155 of perimeter beam segments 115. The spaces between top intermediate flange 187 and middle intermediate flange 188 define a pair of power raceways 214, which communicate with the interior power raceways 58 in columns 3, as well as the power raceways 156 in perimeter beam segments 115. The spaces between middle intermediate flange 188 and bottom intermediate flange 189 define a pair of bus raceways 215 in which electrical bus strips 158 are mounted. The spaces between lower flange 175 and bottom intermediate flange 189 define a pair of panel hanger channels 216 in which panels 6 are detachably suspended in the manner described below. As is apparent by comparing the beam segments illustrated in FIGS. 19 and 23, the power raceways 156 & 214, bus raceways 157 & 215, and panel hanger channels 170 & 216 of perimeter beam segments 115 and cross beam segments 116 respectively, are substantially identical, so that related parts of furniture system 1 can be used universally throughout. Due to the greater vertical thickness of cross beam segments 116, the cable raceway 213 in cross beam segments 116 is substantially larger than the cable raceway 155 in perimeter beam segments 115.

Figure 16:
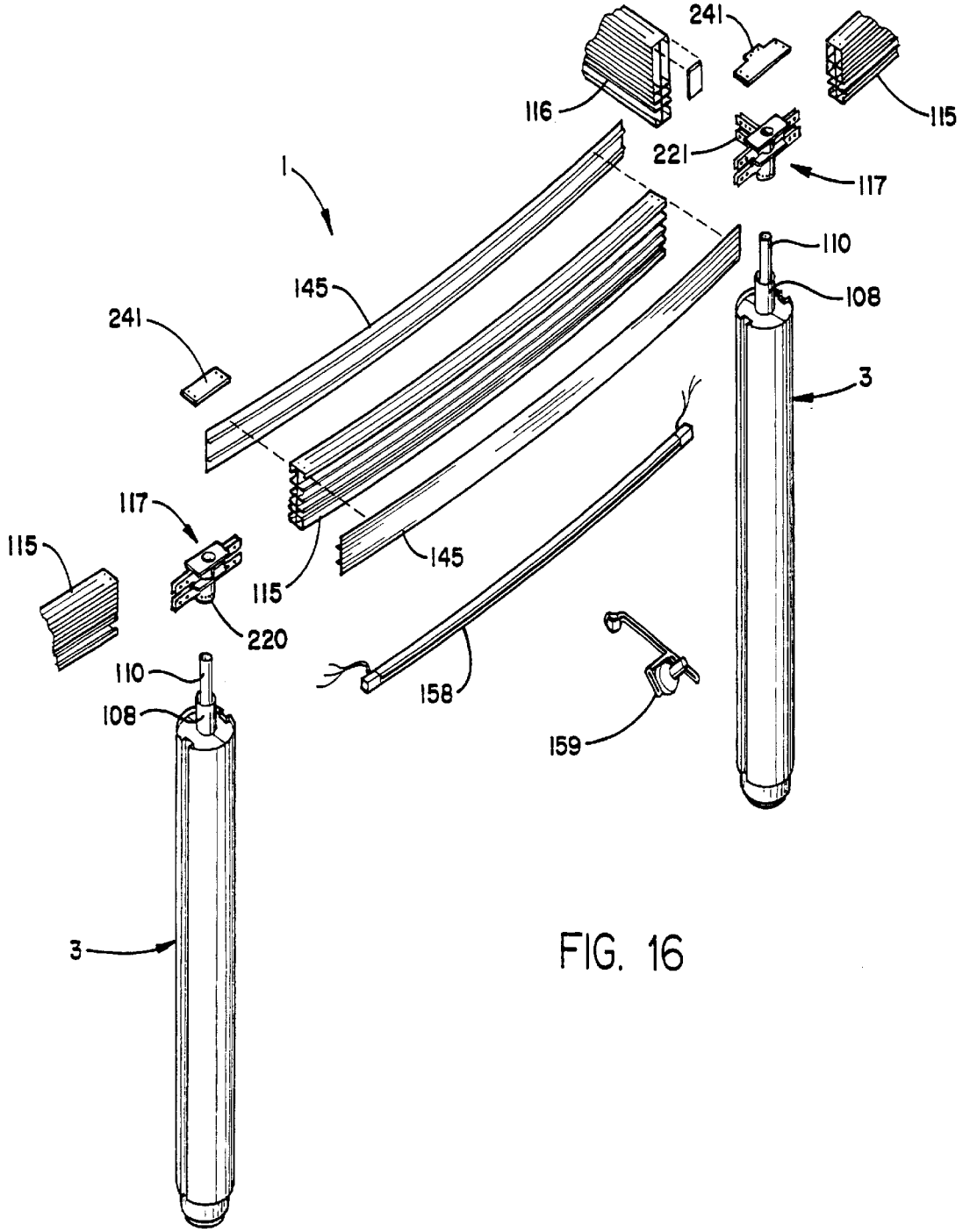
FIG. 16 is an exploded, perspective view of the furniture system, showing connectors attaching beam segments of an overhead framework to the columns.

With reference to FIG. 16, different style connectors 117 are provided to interconnect perimeter beam segments 115, cross beam segments 116, and columns 3 into different configurations. The furniture system 1 shown in FIGS. 1–3 has a column 3, and an associated connector 117, at each end of each perimeter beam segment 115. Cross beam segments 116 are arranged in an "X" top plan configuration, wherein each cross beam segment 116 is disposed approximately 90 degrees from the next adjacent cross beam segment 116. The exterior ends of cross beam segments 116 are connected with associated perimeter beam segments 115 at every other column 3. The interior ends of cross beam segments 116 are interconnected with one another, so as to span the entire width or interior of overhead framework 4 to avoid interference with free movement within furniture system 1.

Figures 31, 32, 33:
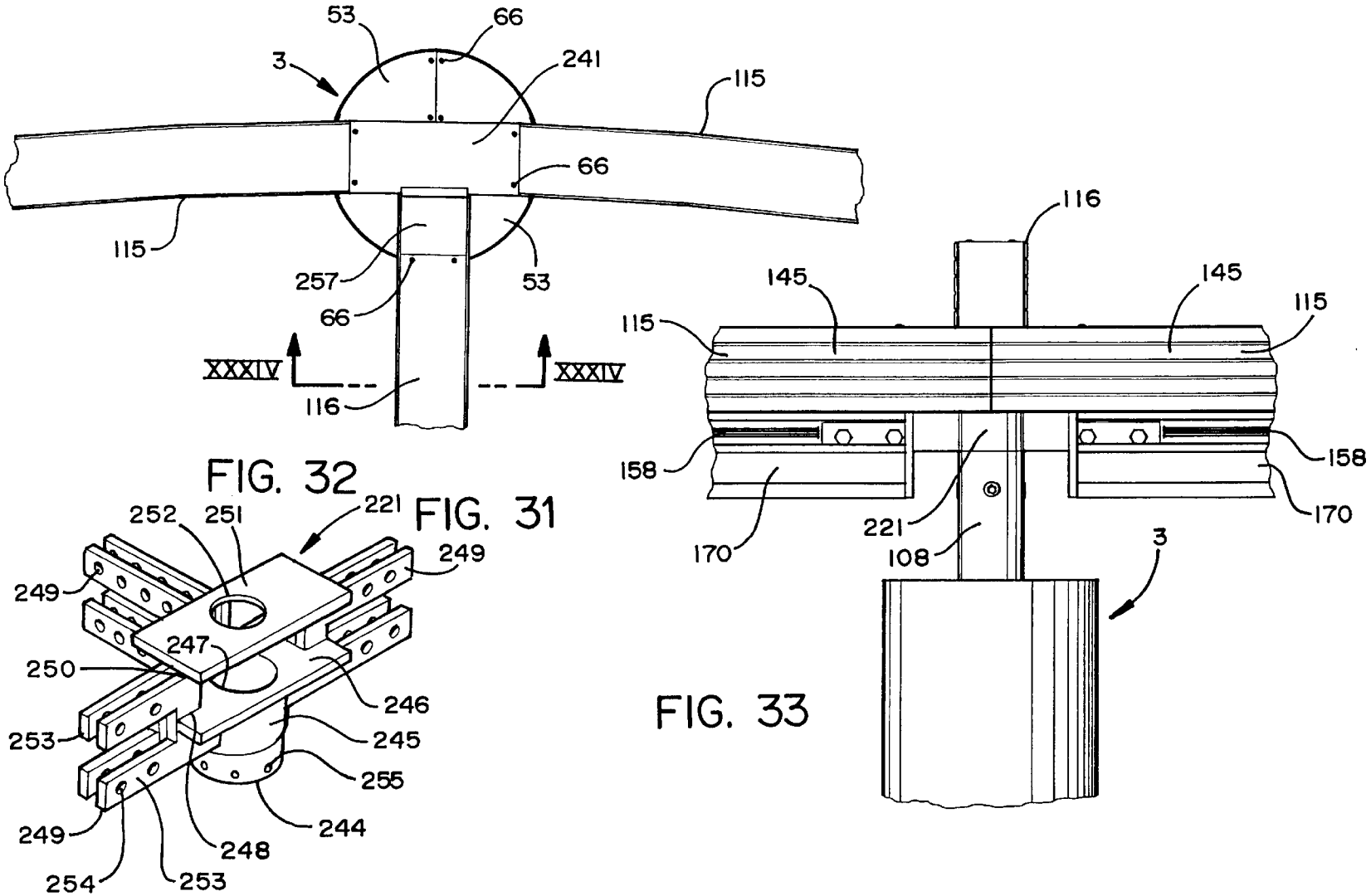
FIG. 31 is a perspective view of a T-connector.
FIG. 32 is a top plan view of a T-connection between two perimeter beam segments, and an associated cross beam segment.
FIG. 33 is a side elevational view of the T-connection shown in FIG. 32, taken from an exterior side of the furniture system.
Figure 34:
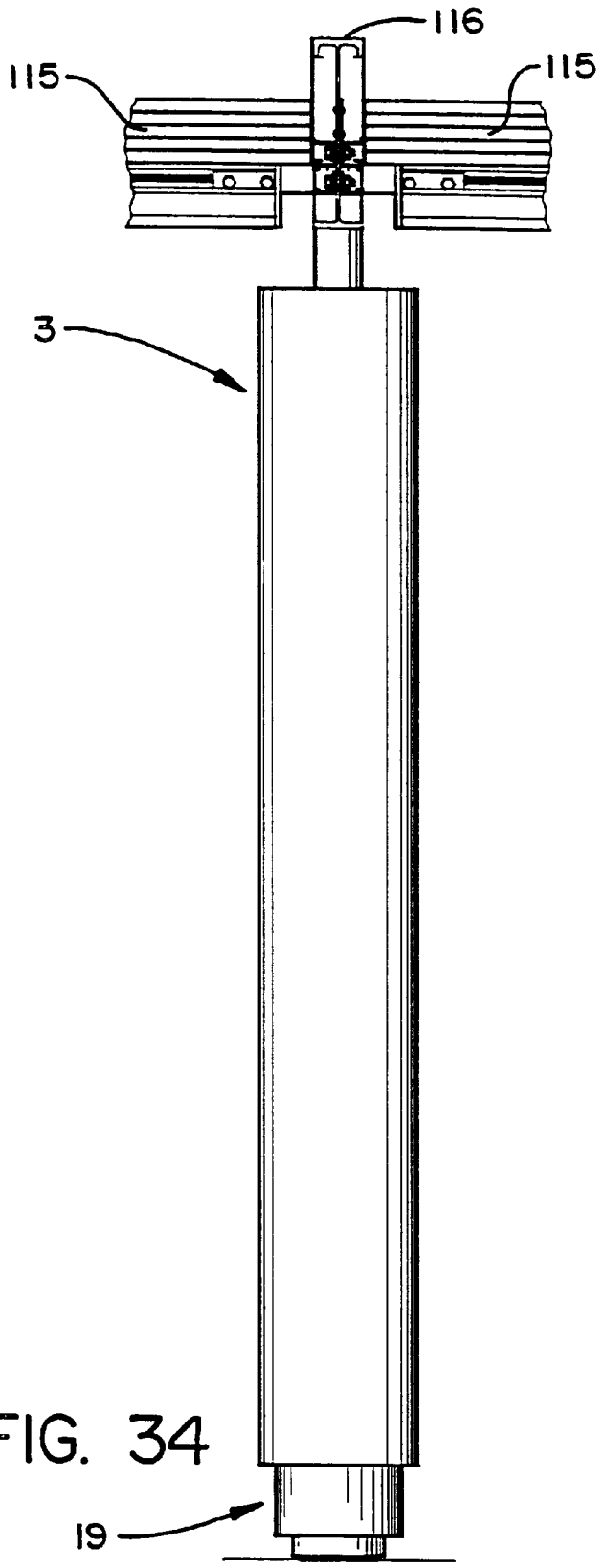
FIG. 34 is a vertical cross-sectional view of the T-connection, taken along the line XXXIV—XXXIV, FIG. 32.
Figure 35:
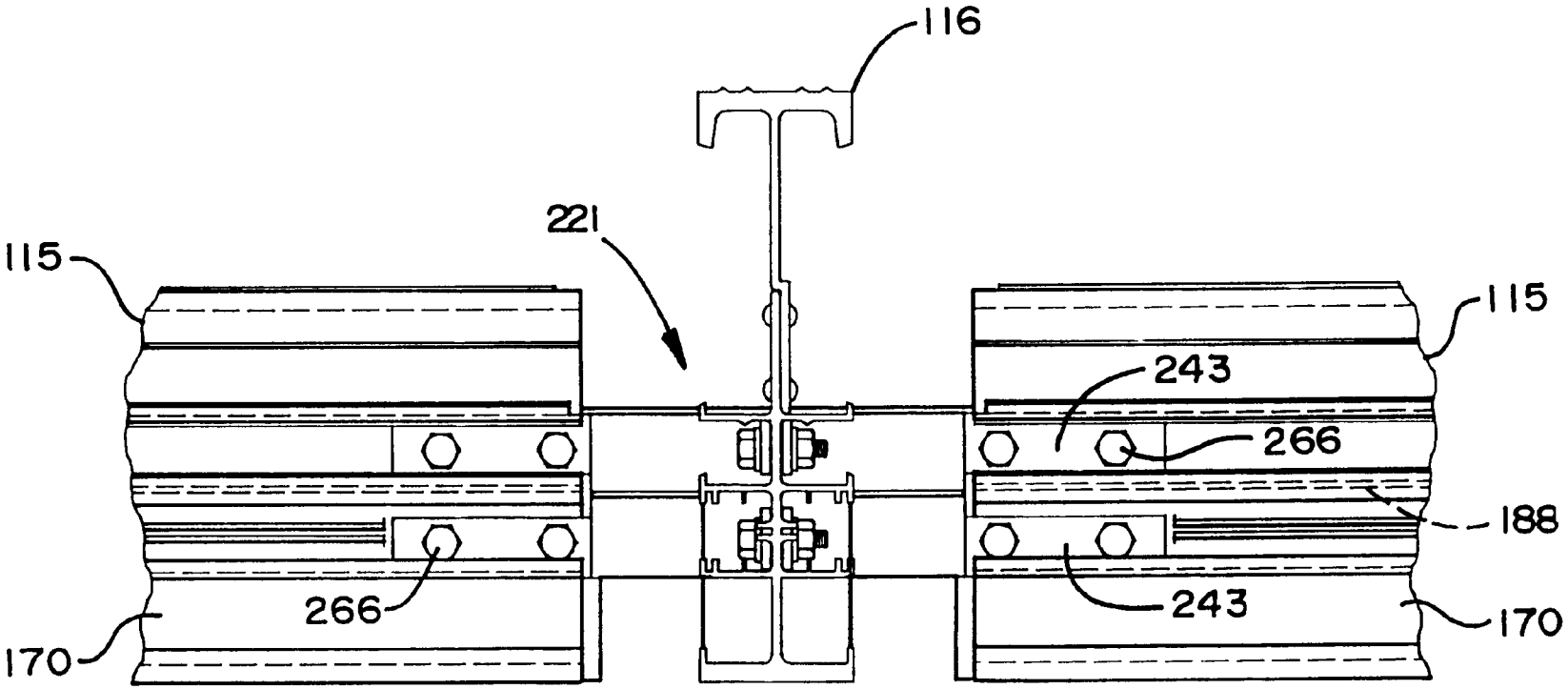
FIG. 35 is a vertical cross-sectional view of the T-connection, taken along the line XXXIV—XXXIV, FIG. 32, with the beam covers removed.
Figure 36:
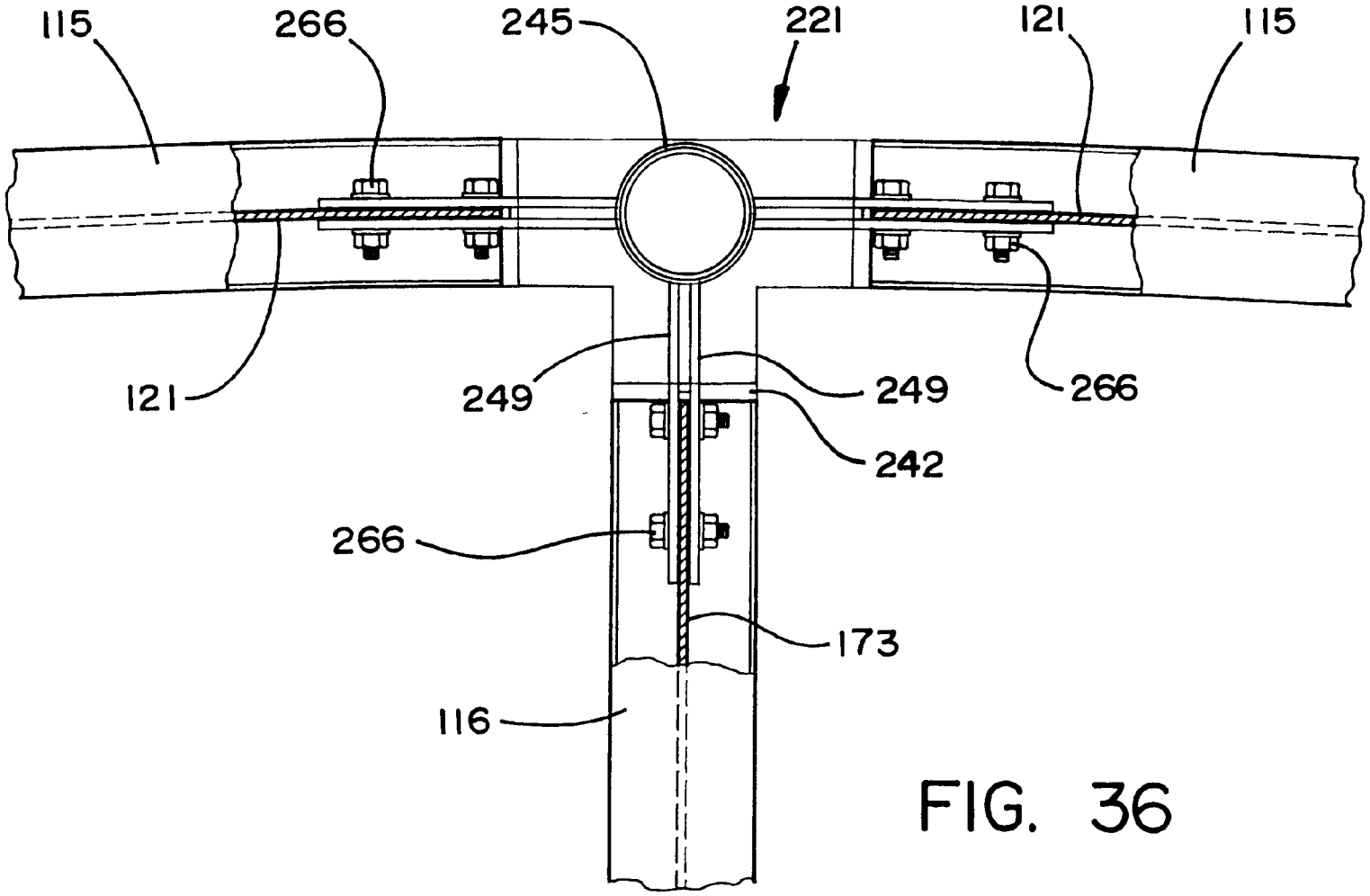
FIG. 36 is a top plan view of the T-connection illustrated in FIG. 32, with portions thereof broken away to reveal internal construction.
Figure 37:
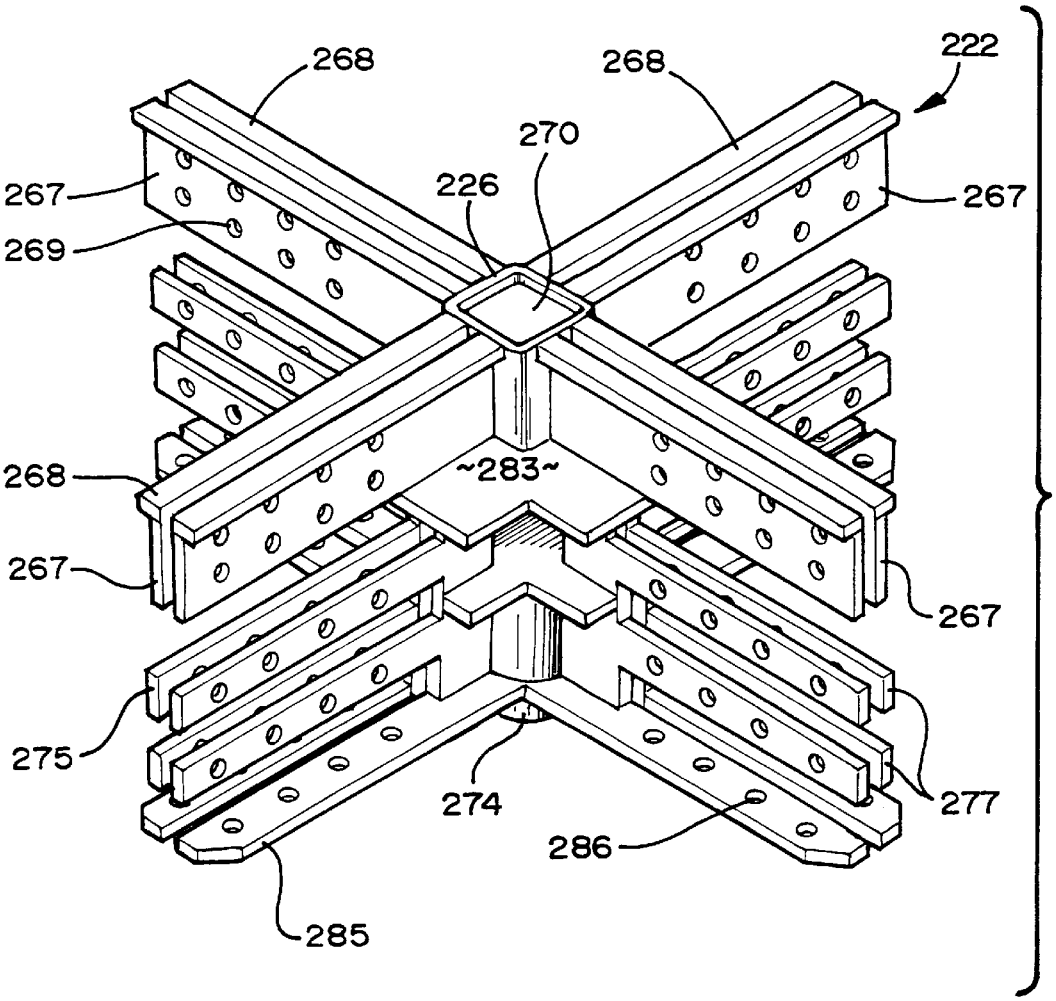
FIG. 37 is a perspective view of an X-connector.
Figure 80:
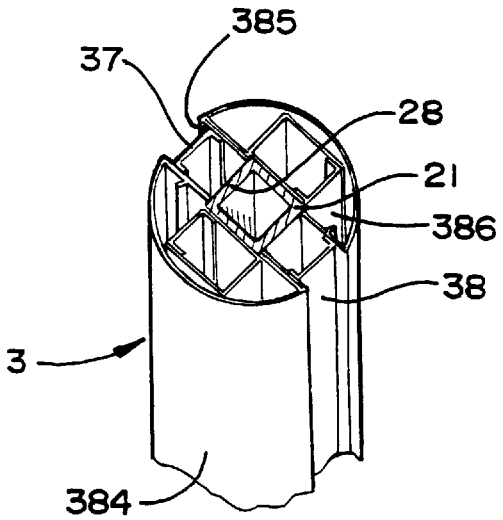
FIG. 80 is a fragmentary, perspective view of a column with a small circular cover mounted thereon.
Figure 81:
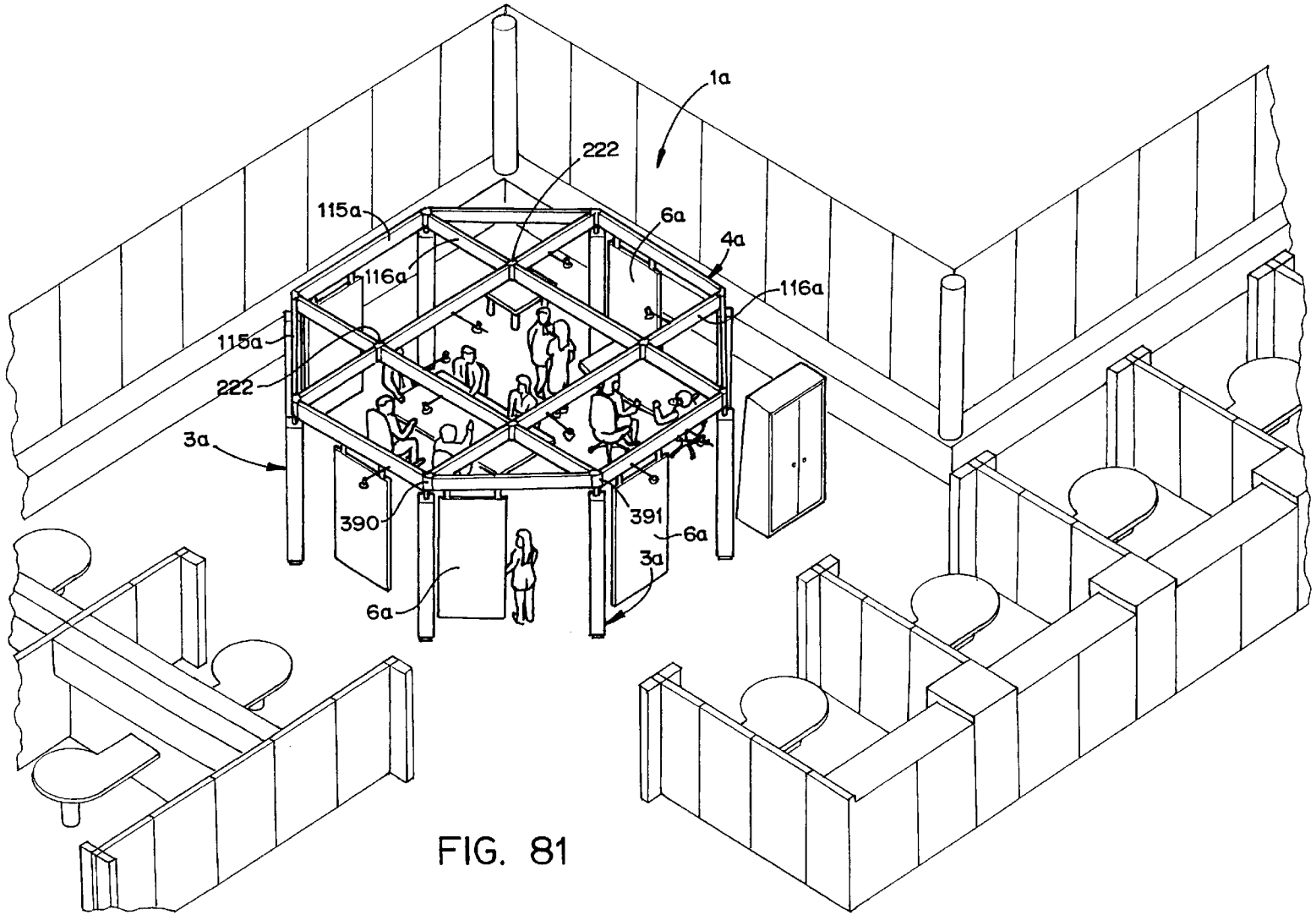
FIG. 81 is a perspective view of another embodiment of the present invention, comprising an octagonal framework, and shown deployed in an open office plan, with removable panels arranged to define a large, group workspace.

In the furniture system 1 illustrated in FIGS. 1–80, three different types of connectors 117 are provided, comprising an in-line connector 220 (FIG. 25), which is adapted to interconnect two adjacent perimeter beam segments 115 in an end-to-end fashion, a T-connector 221 (FIG. 31), which is designed to interconnect two adjacent perimeter beam segments 115 and an associated cross beam segment 116 in a "T" configuration, and an X-connector 222 (FIG. 37), which is adapted to interconnect the four interior ends of cross beam segments 116 in a mutually perpendicular relationship. Connectors 220–222 have a somewhat similar type of construction, and are detachably connected with the associated ends of beam segments 115 and 116 by threaded fasteners or the like, such that the entire furniture system 1 can be readily disassembled and reassembled at new locations.

Figure 25:
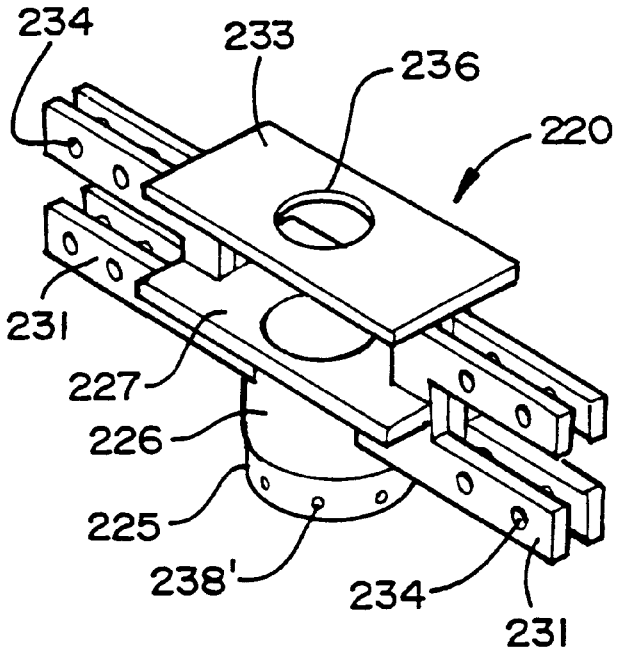
FIG. 25 is a perspective view of an in-line connector.
Figure 26:
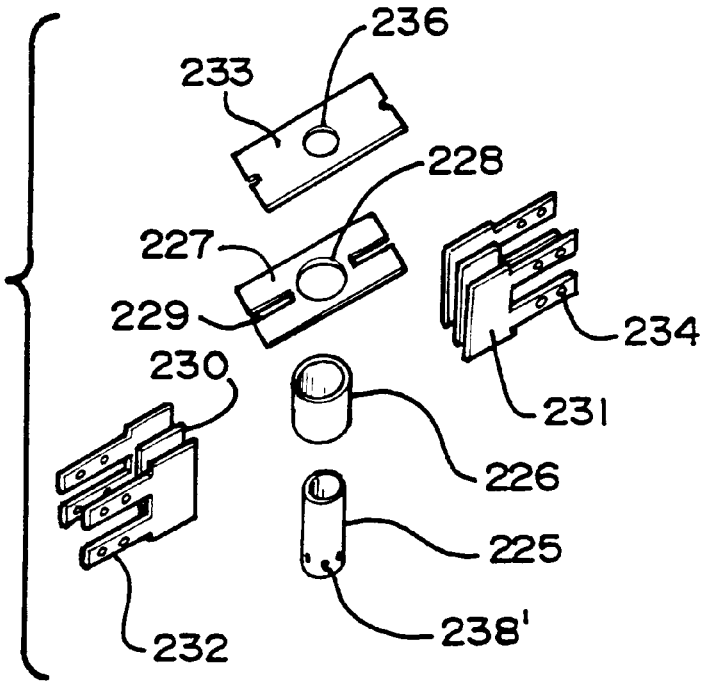
FIG. 26 is an exploded, perspective view of the in-line connector.
Figure 27:
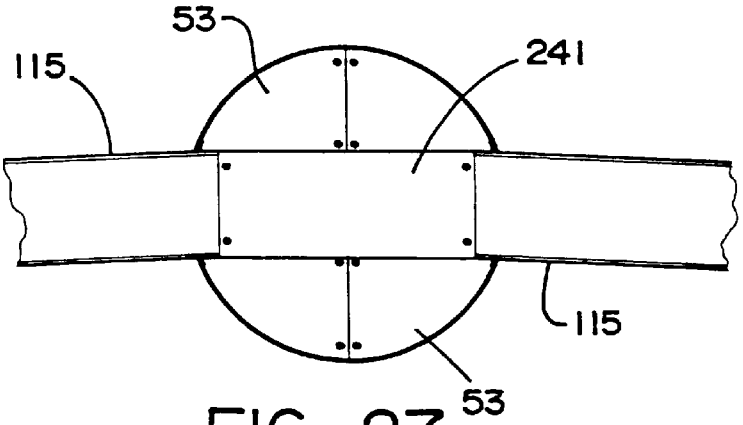
FIG. 27 is a fragmentary, top plan view of an in-line connection between adjacent perimeter beam segments.
Figure 28:
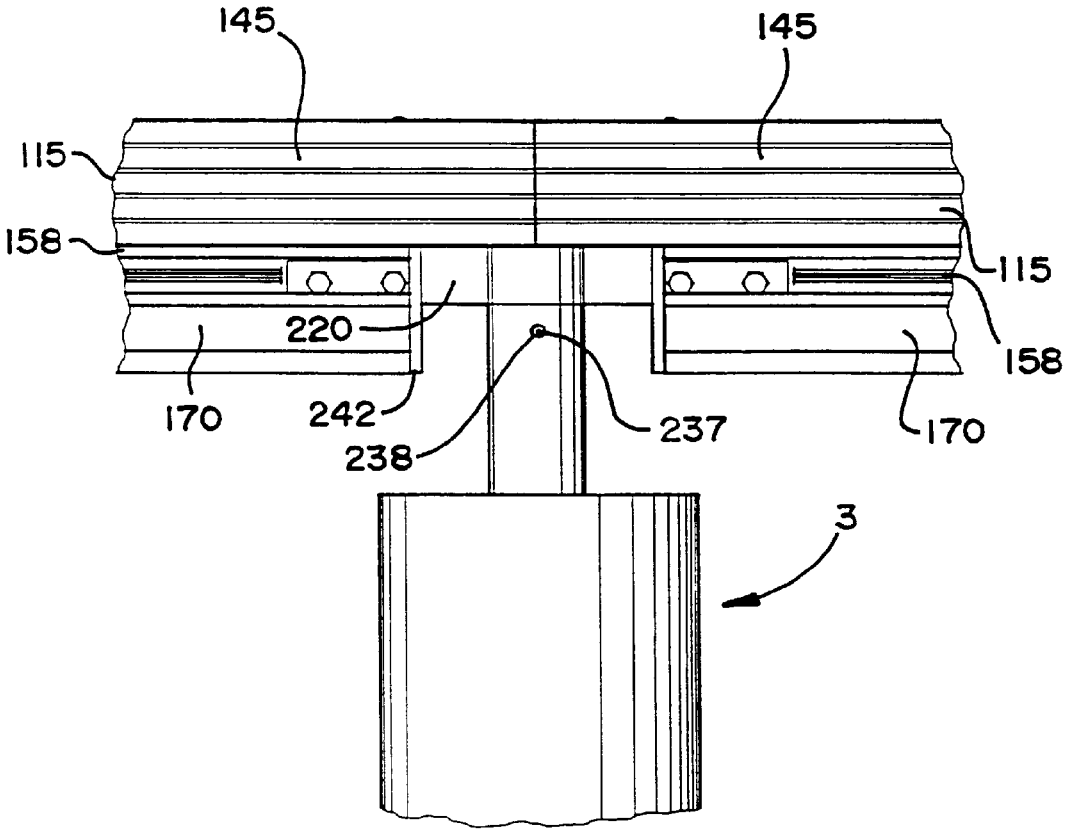
FIG. 28 is a fragmentary, side-elevational view of the in-line connection illustrated in FIG. 27.
Figure 28A:
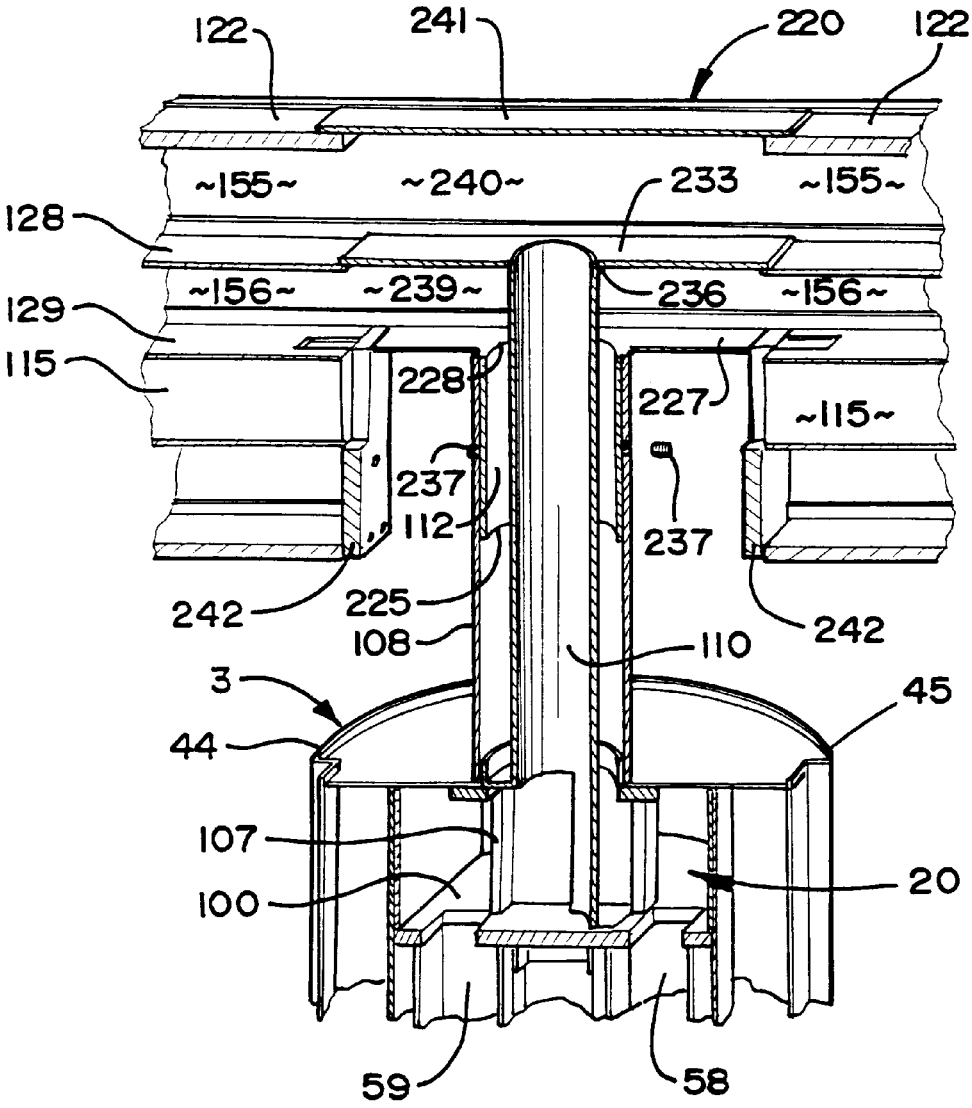
FIG. 28A is a fragmentary, vertical cross-sectional view of the in-line connection illustrated in FIG. 28.

In-line connector 220 (FIGS. 25–28*a*) comprises a rigid, cylindrically shaped joint tube 225, shaped with an outside diameter that is slightly less than the inside diameter of the connector tube 108 on column 3. A connector collar 226 is telescopingly received over the upper end of joint tube 225, and is securely fastened thereto. A rectangular power level plate 227 is provided, having a central, circular opening 228, and a pair of longitudinally extending notches 229 through opposite ends thereof. Two pairs of substantially identical fletch plates 231, with intermediate spacer plates 230, are arranged in a laterally stacked pack, and inserted into the notches 229 in power level plate 227 at a general medial portion of fletch plates 231. The lower portions of the interior end edges of fletch plates 231 and spacer plates 230 abut an associated flat on connector collar 226, and are fixedly attached to connector collar 226, and power level plate 227 by means such as welding. Each fletch plate 231 includes a pair of outwardly extending fingers 232, which are spaced laterally apart by spacer plate 230 a horizontal distance sufficient to closely receive therebetween the web 121 of a perimeter beam segment 115, with each pair of fingers 232 spaced vertically apart a distance adapted to closely receive therebetween the middle intermediate flange 129 on the end of one of the perimeter beam segments 115. Each stack of fletch plates 231 and spacer plates 230 extends upwardly from power level plate 227. A cable level plate 233, with central opening 236, is positioned directly above power level plate 227, and is attached to the upper edges of fletch plates 231 and associated spacer plates 230, so as to create a one-piece, unitary weldment, as illustrated in FIG. 25. The vertically stacked relationship between the power and cable level plates 227 and 233 creates within the interior of the connector 220 a power wire space 239 (FIG. 28A) between plates 227 and 233, and a cable wire space 240 above plate 233. Wire spaces 239 and 240 combine with the central openings 228 and 236 in power and cable level plates 227 and 233 to facilitate the routing of power and cable wires through in-line connector 220, as outlined in greater detail below. Each of the fingers 232 on fletch plates 231 includes a pair of laterally extending fastener apertures 234 through which bolts 235 (FIGS. 29 & 30) are inserted to securely connect in-line connector 120 with the adjacent ends of two perimeter beam segments 115, which is also described below.

As best illustrated in FIGS. 27–30, in-line connector 220 is attached to the beam connector assembly 20 of an associated column 3 in the following manner. The lower end of the joint tube 225 is inserted into the upper end of the connector tube 108 in column 3, until the bottom edge of in-line connector collar 226 abuts the upper edge of connector tube 108. In-line connector 22 is then securely attached to the connector tube 108 of column 3 by suitable fasteners, such as the illustrated allen screws 237, which are received into mating threaded apertures 238 and 238' respectively in column connector tube 108 and joint tube 225. Preferably, alien screws 237 are spaced regularly about the periphery of column connector tube 108, so as to securely, yet detachably mount in-line connector 220 on the beam connector assembly 20 of beam 3.

Figure 29:
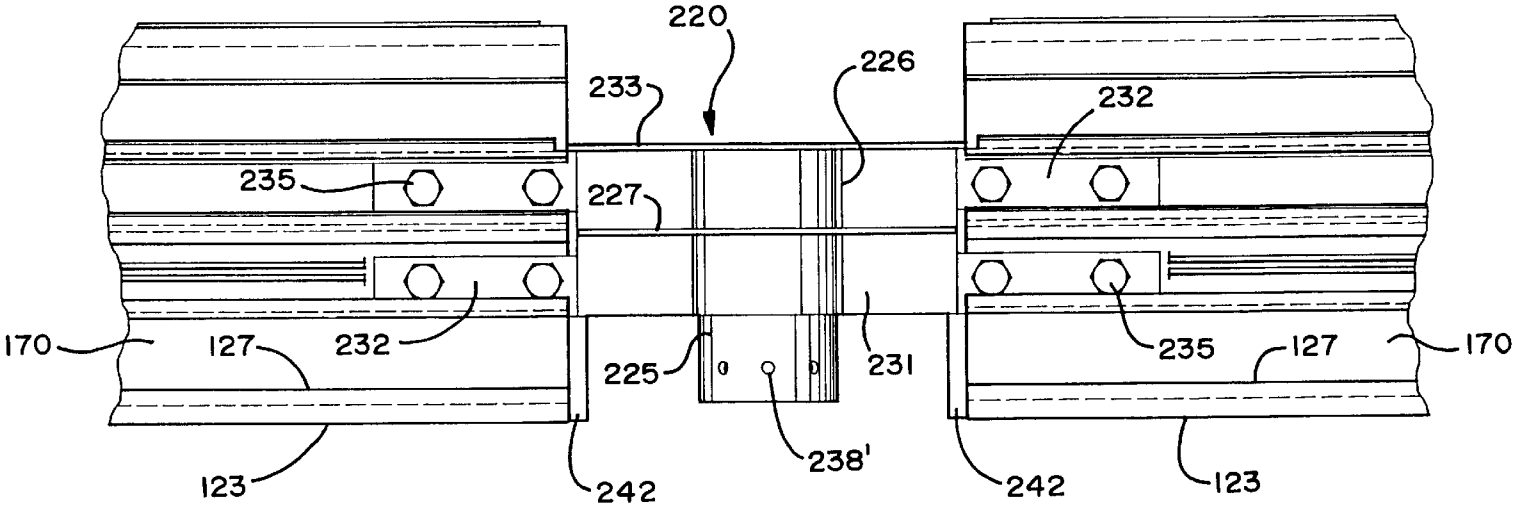
FIG. 29 is a side elevational view of the in-line connection shown in FIG. 28, with the beam covers removed.
Figure 30:
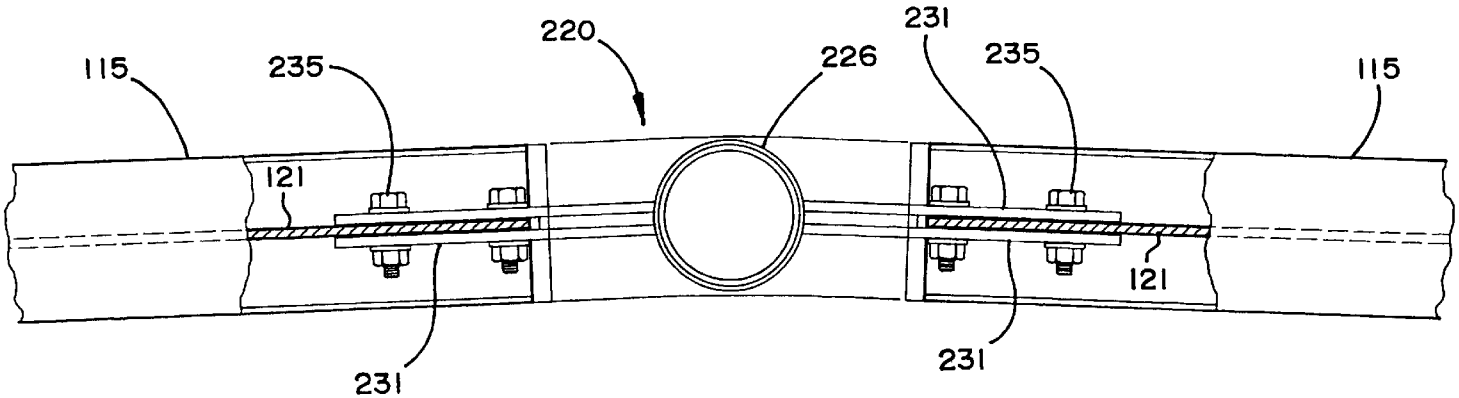
FIG. 30 is a top plan view of the in-line connection illustrated in FIG. 28, with portions thereof broken away to reveal internal construction.

After in-line connector 220 has been mounted on the beam connector assembly 20 of the associated column 3, as described above, the ends of two adjacent perimeter beam segments 115 are then each attached to in-line connector 220, by inserting the ends of the beams between the associated pairs of fletch plates 231, as shown in FIGS. 29 and 30. Bolts 235 are then inserted through the fastener apertures 234 in the fingers 232 of fletch plates 231, and the associated fastener apertures 142 in the ends of perimeter beam segments 115. Top cover 241 is then installed to complete the upper portion of the assembly by inserting fasteners 66 through top cover 241 into the underlying fastener apertures 143 adjacent the ends of perimeter beam segments 115. A pair of bottom covers 242 (FIGS. 28 & 28A) are attached to the open, lower ends of adjacent perimeter beam segments 115 by inserting fasteners 66 therethrough into the associated beam apertures 144.

When in-line connector 220 is thusly attached to column 3, the upper end of cable extender tube 110 (FIG. 28A) extends through the central openings 228 and 236 in plates 227 and 233, and protrudes into the cable wire space 240, which in turn communicates with the cable raceways 155 of adjacent perimeter beam segments 115. An arcuately shaped top cover 241 spans the gap between the ends of the upper flanges 122 of adjacent perimeter beam segments 115 to close cable wire space 240, and form a pair of substantially continuous cable raceways along the perimeter of overhead framework 4.

In like manner, the annular power raceway 112 (FIG. 28A) between the interior surface of joint tube 225 and the exterior surface of cable extender tube 110, opens into the power wire space 239 of in-line connector 220, which in turn communicates with the power raceways 156 of adjacent perimeter beam segments 115. The cable level plate 233 and power level plate 227 of in-line connector 220 span the gap between the ends of top intermediate flange 128 and middle intermediate flange 129, so as to form a pair of substantially continuous power raceways along the perimeter of overhead framework 4.

With reference to FIGS. 31–36, T-connector 221 has a construction conceptually similar to in-line connector 220, except that it includes a third pair of fletch plates that attach a cross beam segment 116 to a pair of adjacent perimeter beam segments 115. In the illustrated example, T-connector 221 comprises a joint tube 244, which is substantially identical to in-line joint tube 225, and has its lower end shaped to be telescopingly inserted into the upper end of a column connector tube 108. The upper end of joint tube 244 is closely received within, and fixedly attached to a T-connector collar 245. A T-connector power level plate 246 is fixedly attached to the upper end of T-connector collar 245, and includes a central opening 247 aligned with T-connector collar 245 and joint tube 244. T-connector power level plate 246 has a substantially T-shaped top plan configuration, and includes three notches 248 which extend longitudinally into each of the three legs of power level plate 246. Three pairs of fletch plates 249, and associated spacer plates 250 are received within the notches 248 of power level plate 246, along a medial portion thereof, and have the lower portions of their interior end edges abutting mating flats on T-connector collar 225, and fixedly attached thereto, as well as to power level plate 246 by welding or the like. A T-connector signal level plate 251 is provided to complete the assembly, and includes a central vertical opening 252 therethrough, which is vertically aligned with the opening 247 in power level plate 246. Signal level plate 251 is fixedly attached to the upper edges of each pair of fletch plates 249 and associated spacer plates 250. Fletch plates 249 are substantially identical to the previously described in-line fletch plates 242, and include two, outwardly protruding fingers 253 with a pair of laterally extending fastener apertures 254 therethrough. The lower end of joint tube 244 also includes threaded fastener apertures 255, which are radially oriented, and spaced regularly about the circumference of joint tube 244.

T-connector 221 is mounted on a column 3 in a fashion identical to the in-line connector 220, as described above. A cross beam segment 116 is then attached to the perpendicularly extending set of fletch plates 249 (FIGS. 35 & 36) by inserting the web 173 of cross beam segment 116 between the free set of fletch plates 249, with the associated fingers 243 straddling the middle intermediate flange 188. Bolts 266 extend through the fastener apertures 254 in fletch plate fingers 253, and the associated apertures 200 in the ends of cross beam segment 116. An arcuate top cover plate 241 (FIGS. 31–34) is attached to the uppermost surface of adjacent, cross beam segments 116 by fasteners 66 in the previously described fashion to partially enclose the underlying portion of the T-connection, and a T-joint top plate 257 is attached to the upper surface of cross beam segment 116 by inserting fasteners 66 into beam apertures 201. T-joint top plate 257, includes a lip 258 along its free edge, which engages top cover plate 241 to fully enclose the T-connection. A bottom cover 242 (FIG. 36) is attached to the open, lower exterior end of cross beam segment 116 by inserting fasteners 66 therethrough into the associated beam apertures 202.

Figure 38:
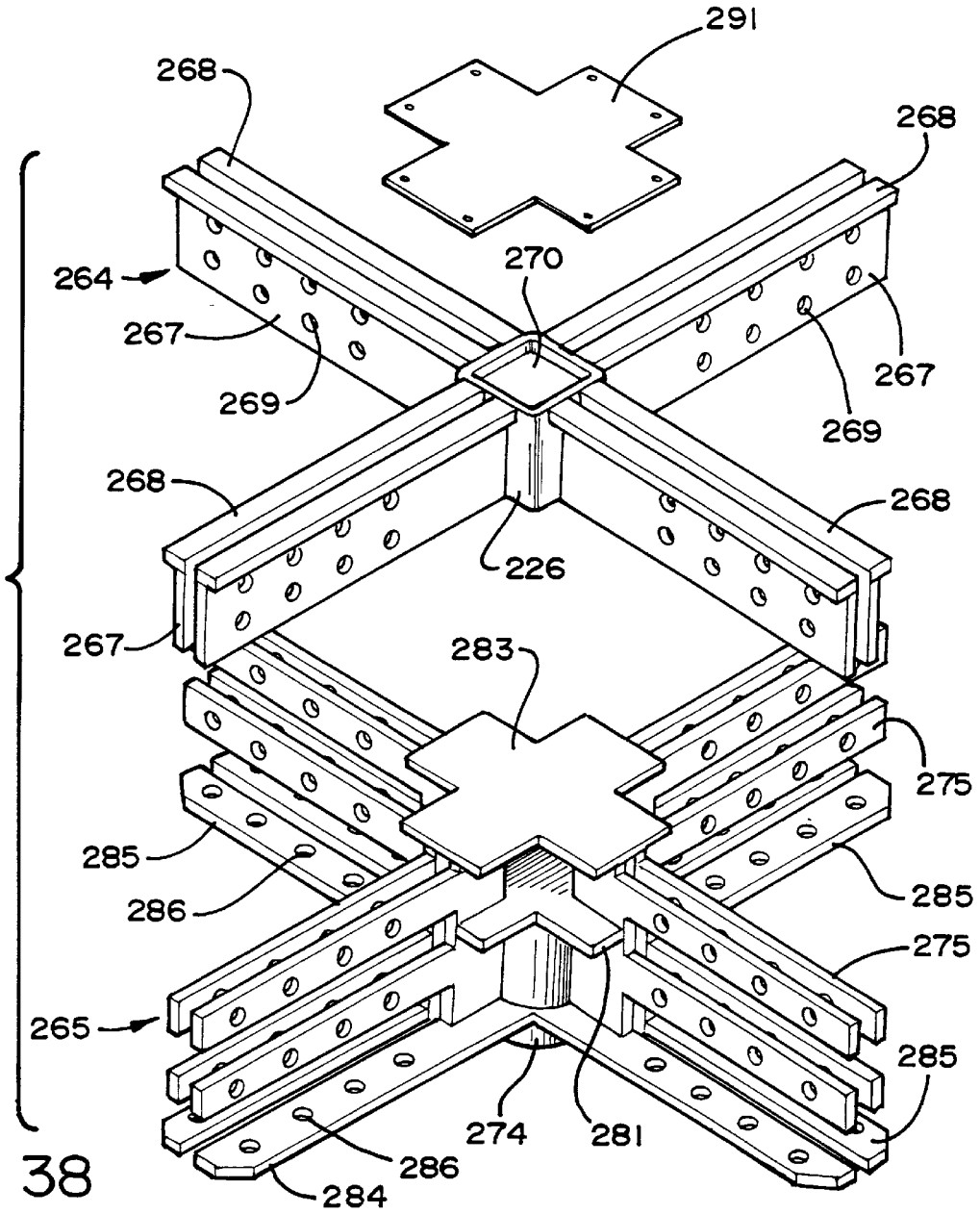
FIG. 38 is an exploded, perspective view of the X-connector.
Figure 38A:
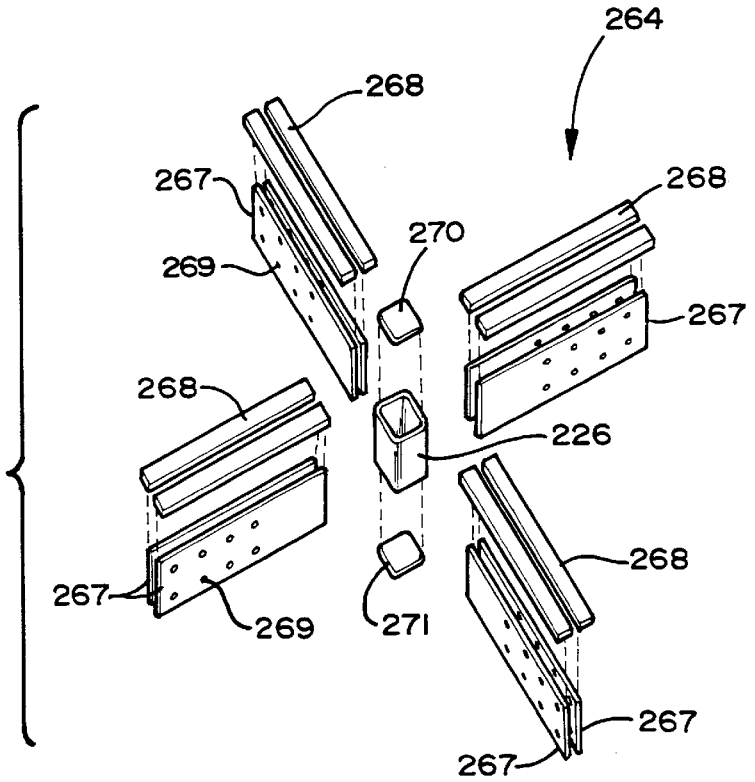
FIG. 38A is an exploded, perspective view of an upper weldment portion of the X-connector.
Figure 40:
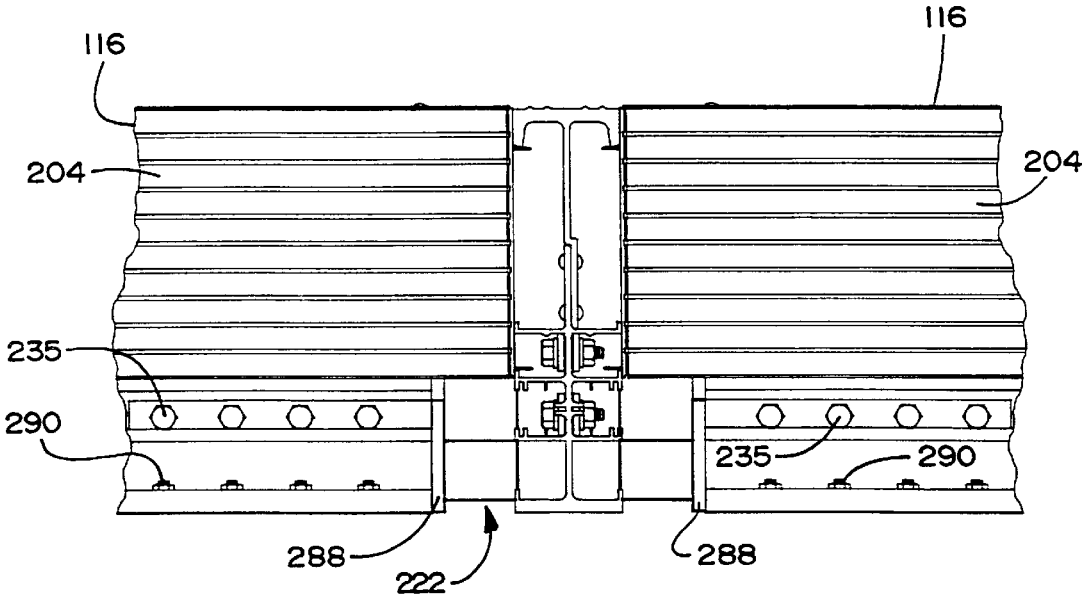
FIG. 40 is a vertical cross-sectional view of the X-connection, taken along the line of XXXIX—XXXIX, FIG. 39.
Figures 38B, 39:
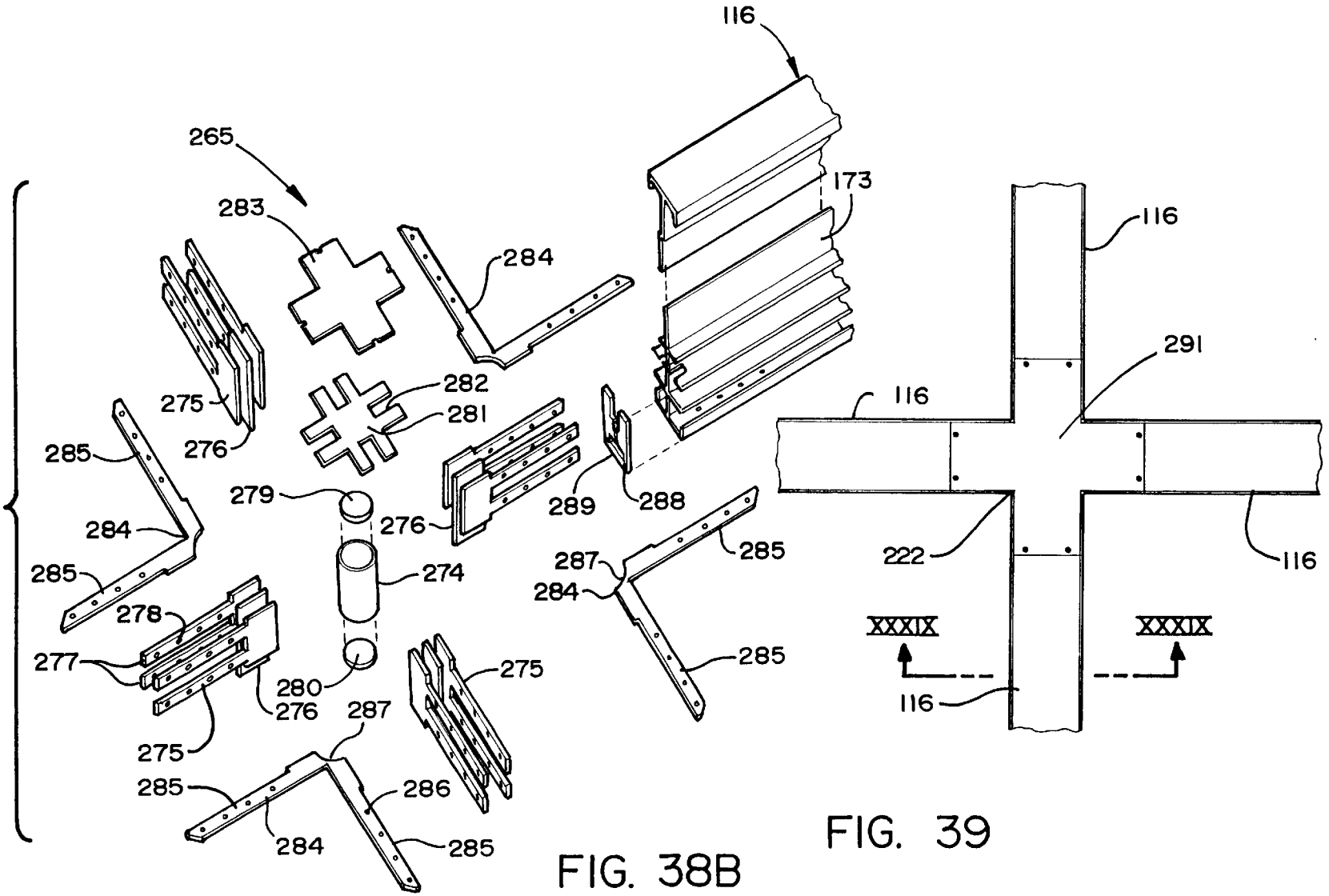
FIG. 38B is an exploded, perspective view of a lower weldment portion of the X-connector.
FIG. 39 is a top plan view of an X-connection between the interior ends of four adjacent cross-beam segment.
Figure 41:
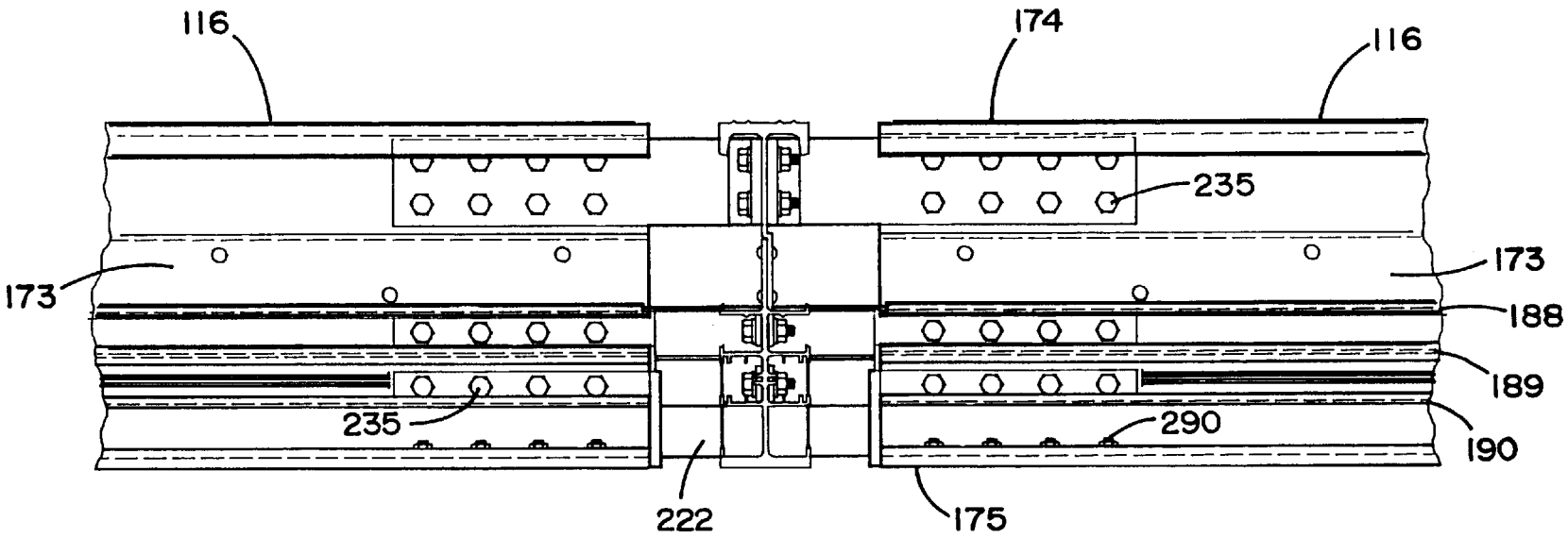
FIG. 41 is a vertical cross-sectional view of the X-connection, taken along the line XXXIX—XXXIX, FIG. 39, with the beam covers removed.
Figure 42:
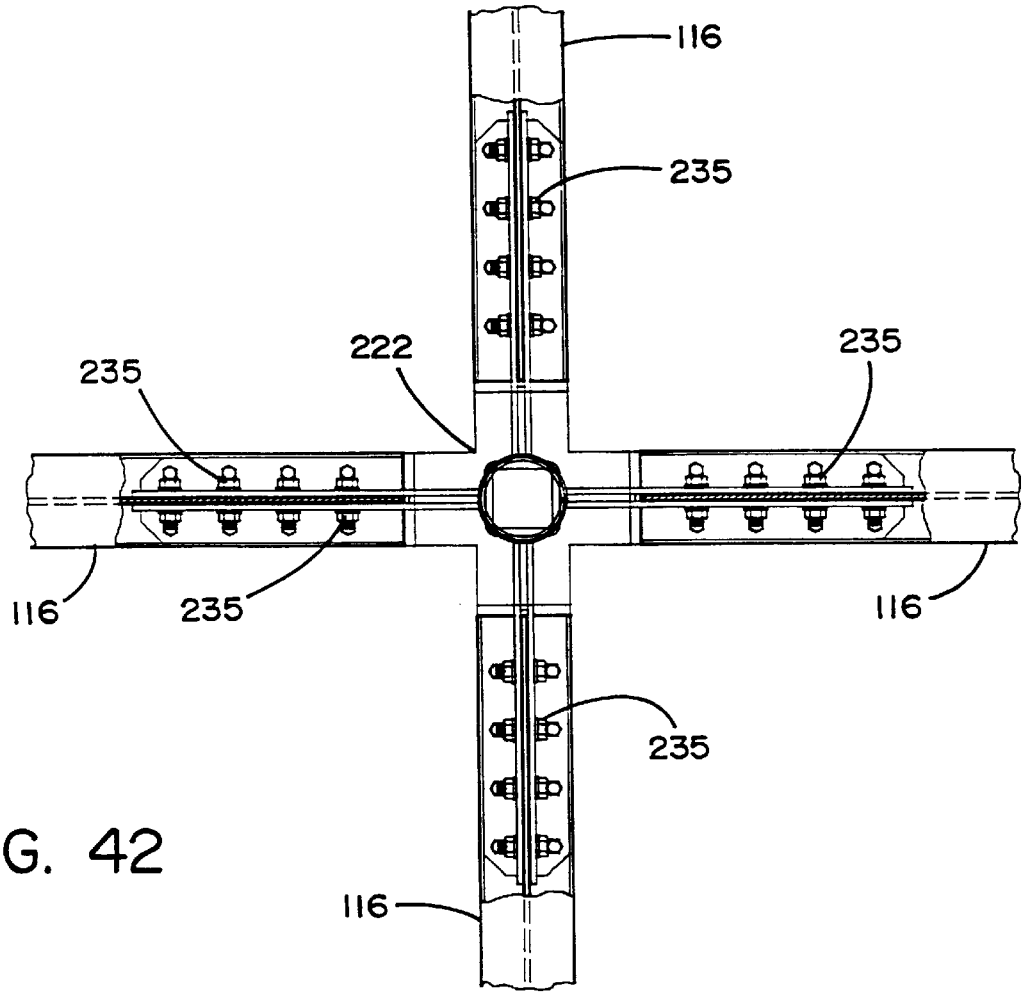
FIG. 42 is a top plan view of the X-connection illustrated in FIG. 39, wherein portions thereof have been broken away to reveal internal construction.

With reference to FIGS. 37–42, X-connector 222 is conceptually similar to in-line connector 220 and T-connector 221, and is adapted to interconnect the four interior ends of cross beam segments 116 at the vertical center line of furniture system 1. X-connector 222 comprises an upper weldment 264 and a lower weldment 265, which are vertically aligned at the X-joint. Upper weldment 264 (FIG. 38A) comprises a central connector tube 266 having a substantially square lateral cross-sectional configuration. Four pairs of upper fletch plates 267 are provided, each having a laterally extending flange 268 attached along the upper edge thereof which projects laterally outwardly, and a plurality of horizontally oriented fastener apertures 269. Each pair of upper fletch plates 267 is spaced apart a predetermined distance sufficient to closely receive the web 173 of an associated cross beam segment 116 therebetween. The innermost ends of upper fletch plates 267 are fixedly attached to the exterior surfaces of central connector tube 266 on each of the four sides thereof, and are arranged in a mutually perpendicular orientation. Top and bottom caps 270 and 271 respectively are recessed into the upper and lower ends of central connector tube 266, and fastened thereto to complete the upper weldment 264.

Lower weldment 265 (FIG. 38B) includes a central connector tube 274 having a substantially circular transverse cross-sectional shape. Four pairs of lower fletch plates 275 are provided with spacer plates 276 disposed between each pair of lower fletch plates, so as to permit the web 173 of cross beam segments 116 to be inserted inbetween lower fletch plates 275. Lower fletch plates 275 have a configuration similar to the fletch plates 249 of in-line connector tube 20, and comprise a pair of outwardly extending fingers 277 with laterally extending fastener apertures 278 therethrough. Top and bottom caps 279 and 280 are recessed into the interior of central connector tube 274 at the opposite ends thereof, and are fixedly mounted in place.

An X-shaped power level plate 281 is attached to the upper end of central connector tube 274, and includes four notches 282 extending longitudinally through each of the four plate legs. The interior edges of fletch plates 275 and associated spacer plates 276 are inserted into plate notches 282, and securely fastened to both associated flats on central connector tube 274, and to power level plate 281 by welding, or the like. An X-shaped, signal level plate 283 is welded to the top edges of fletch plates 275 and spacer plates 276. Four angle braces 284 are provided for attachment to the lower portion of lower weldment 265, and comprise two perpendicularly oriented legs 285, with a plurality of vertical fastener apertures 286 therethrough. Each angle brace 284 has an arcuate cutout 287 at its exterior corner, wherein the associated edge mates with the exterior surface of central connector tube 274. Spacer plates 276 are vertically elongated, and protrude downwardly from the associated bottom edges of fletch plates 275, and abut the upper surfaces of angle braces 284 to position the same in lower weldment 265. Angle braces 284 are securely welded to central connector tube 274, and spacer plates 276 to complete the unitary lower weldment 265.

As best illustrated in FIGS. 39–42, X-connector 222 is connected with cross beam segments 116 in the following fashion. The web 173 at the interior end of each cross beam segment 116 is inserted inbetween lower fletch plates 275, with the fingers 277 of lower fletch plates 275 straddling the middle intermediate beam flange 189. Through bolts 235 are inserted through the fastener apertures 278 in fletch plates 275, and the interior ends of cross beam segments 116. Interior beam end covers 288 are mounted on the inside ends of each of the four cross beam segments 116 by fasteners inserted into mating beam apertures 202, and include a keyhole shape slot 289 through which the free ends of angle braces 284 are received. Fasteners 290 (FIGS. 41 & 42) extend vertically through the fastener apertures 286 in angle braces 284, and engage mating fastener apertures in the lower flanges 175 of cross beam segments 116.

The upper weldment 274 of X-connector 222 is similarly attached to the interior ends of cross beam segments 116 at the upper portions thereof. The web 173 of each cross beam segments 116 is inserted inbetween the fletch plates 276 of upper weldment 264. Through bolts 235 are inserted through the fastener apertures 269 in fletch plates 267, and into the associated fastener apertures in the ends of cross beam segments 116. An X-shaped top cap 291 (FIG. 39) is attached to the upper flanges 174 of cross beam segments 116 to enclose the X-joint. X-connector 222 provides a sufficiently rigid connection between the interior ends of cross beam segments 116 that cross beam segments 116 can span fully between the perimeter beam segments 115, without requiring any intermediate support.

Beam connectors 220–222 and their associated detachable fasteners permit furniture system 1 to be readily disassembled and reassembled at new sites. This knock-down feature of furniture system 1 is particularly important in supporting team projects, which are typically of rather limited duration. By using relatively short beam segments 115 and 116 interconnected end-to-end by beam connectors 220–222, the overall size of the knocked down furniture system 1 is sufficiently compact that it can be transported within a conventional building elevator, which is an important feature in modern office complexes. When erected, furniture system 1 is rigid, and completely freestanding, such that it can be moved within a selected space without being disassembled. As is apparent from the drawings, furniture system 1 may be provided in many different shapes and sizes. In one working embodiment of the furniture system 1 shown in FIGS. 1–3, the diameter of circular framework is approximately thirty feet, occupying around seven hundred square feet of floor space, and is elevated above the floor surface a distance in the range of 6–7 feet. An elevation of eighty inches has been found suitable to accommodate even tall users, yet permit shorter users to readily manipulate panels 6 on overhead framework 4.

Each panel 6 (FIGS. 43–43*c*) is constructed to permit easy, manual bodily translation of the same by an adult user throughout the furniture system 1, as well as outside furniture system 1. Preferably, panel 6 is generally rigid and lightweight to facilitate manual handling, and in the illustrated example, comprises an open frame 298 extending about the margin of panel 6, and lightweight core 299 mounted within frame 298. The panel 6 illustrated in FIG. 43*a* has a soft wood frame 298, and a foam core 299 positioned within frame 298. Two fabric layers 300, each with an associated underlying polyester layer (not shown) cover the opposite faces of perimeter frame 298 and core 299, and a flexible bumper 301 is attached to the outer edges of frame 298 to protect panel 6. The laminate fabric cover 300 and foam core 299 create tackable surfaces on the opposite sides of panel 6 for information display purposes, and the like. In one working embodiment of the present invention, panel 6 has an overall thickness of approximately one inch, a height of approximately 36–80 inches, and a width of around 30–50 inches, such that its total weight is approximately 15–30 pounds to facilitate manually hanging, and removing the same from overhead framework 4.

Each of the illustrated panels 6 (FIGS. 43–43*c*) includes a pair of panel connectors 8, which are shaped to be received in one of the panel hanger rails 170 and 216 of overhead framework 4 to detachably hang the associated panel 6 at various locations along overhead support 4. In the illustrated example, each panel connector 8 comprises a pair of hanger plates 304 having a substantially Z-shaped side elevation configuration. Hanger plates 304 are interconnected in a back-to-back relationship by means such as the illustrated rivets 305, thereby forming a downwardly opening U-shaped flange 306 at the lower end of panel connector 8. The upper edge of panel 6 is inserted inbetween the opposite sides of U-shaped flange 306, and three fasteners 307 are inserted through the assembly to securely mount each connector 8 on the upper edge of panel 6. Each of the illustrated panels 6 has two panel connectors 8, positioned adjacent opposite sides of the panel 6. A pair of anti-friction glides 308 are mounted adjacent the upper end of each hanger plate 304 on the opposite sides thereof to slidingly support panel 6 on the free edges of panel hanger rails 170 and 216. In the illustrated example, each glide 308 comprises a disc-shaped bearing constructed from an anti-friction material, such as nylon, delrin or the like, with a linear slot 310 extending along the lowermost portion thereof. An axially positioned fastener 311 securely mounts each glide 308 to its associated hanger plate 304, and retains the same in position, with notch 310 facing downwardly, and oriented substantially parallel with the upper edge of panel 6. Circular cover plates 312 are recessed into the exterior ends of glides 308, and serve as decorative washers for fasteners 311.

Figure 44:
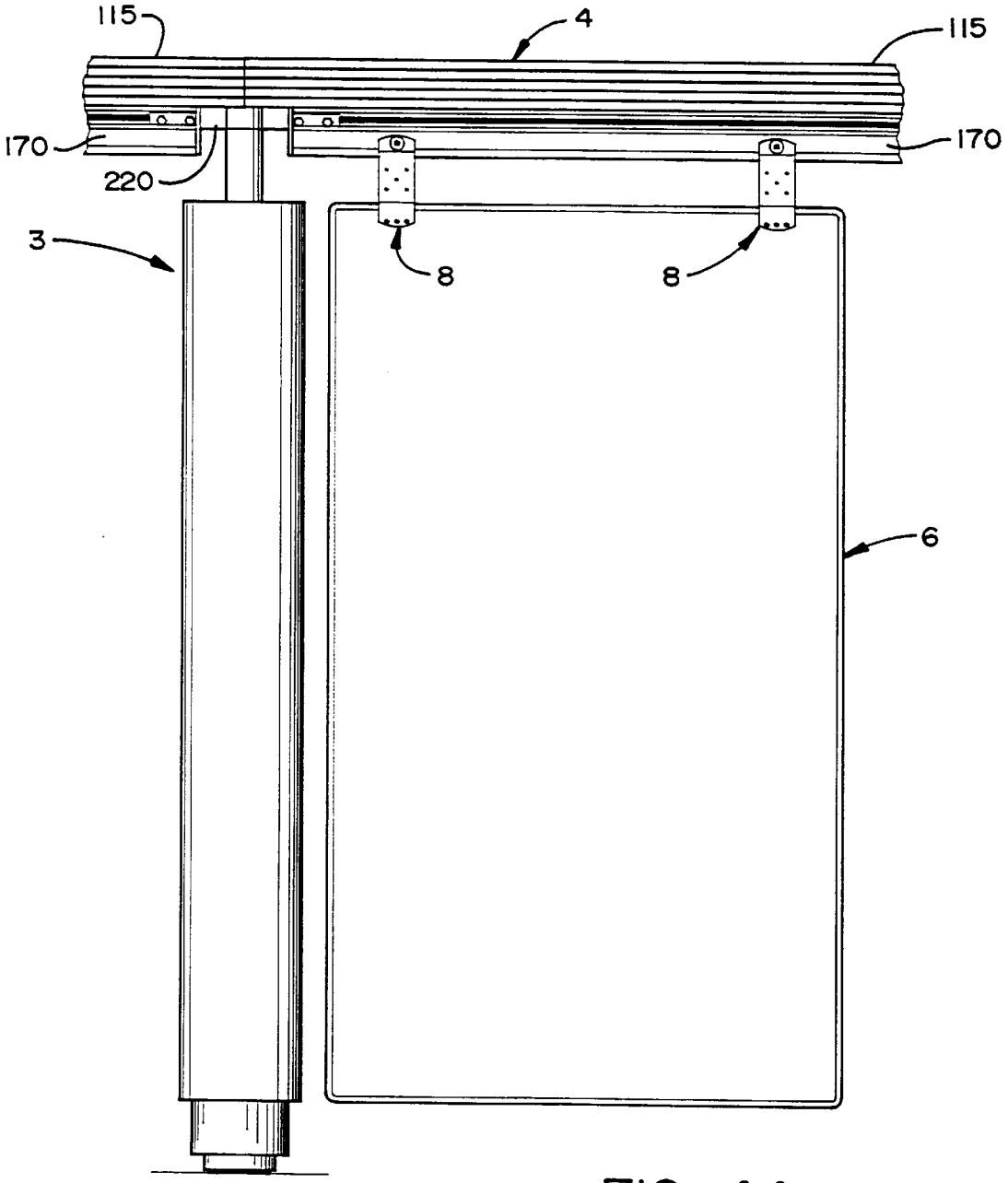
FIG. 44 is a fragmentary, side-elevational view of the furniture system, showing a panel hung from an associated perimeter beam segment.
Figure 45:
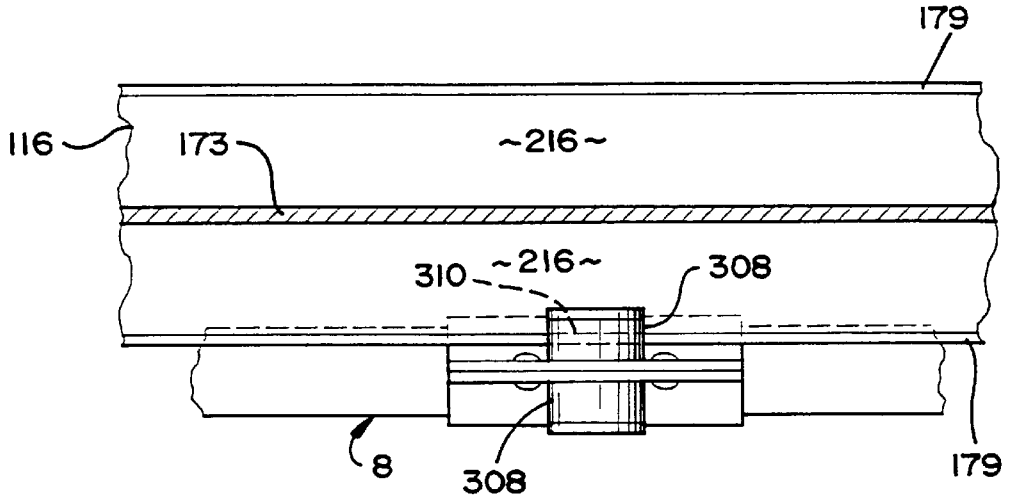
FIG. 45 is a fragmentary, horizontal cross-sectional view of a cross-beam frame segment, showing a panel hanging from a straight rail portion thereof.
Figure 44A:
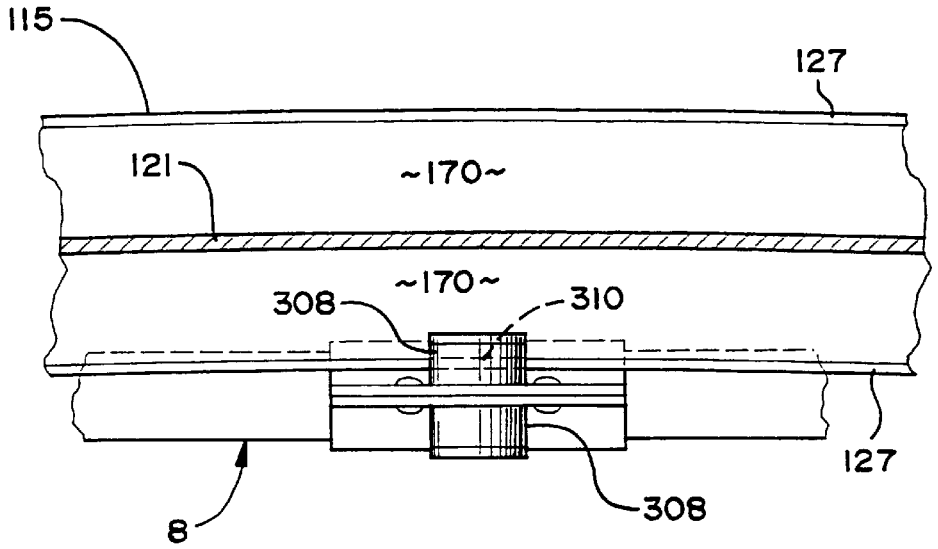
FIG. 44A is a fragmentary, horizontal cross-sectional view of a perimeter beam segment illustrated in FIG. 43, showing a panel hanging from an arcuate rail portion thereof.
Figure 47:
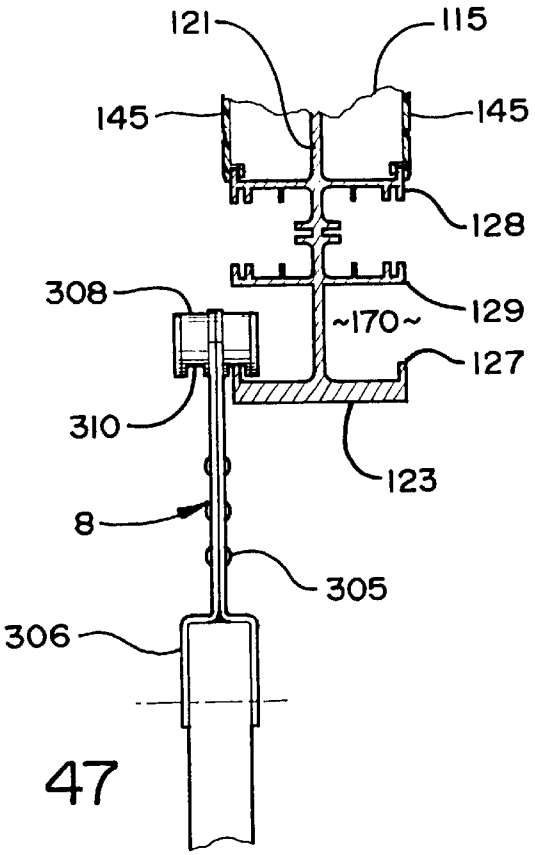
FIG. 47 is a vertical cross-sectional view of the panel and beam segment illustrated in FIG. 46.
Figure 46:
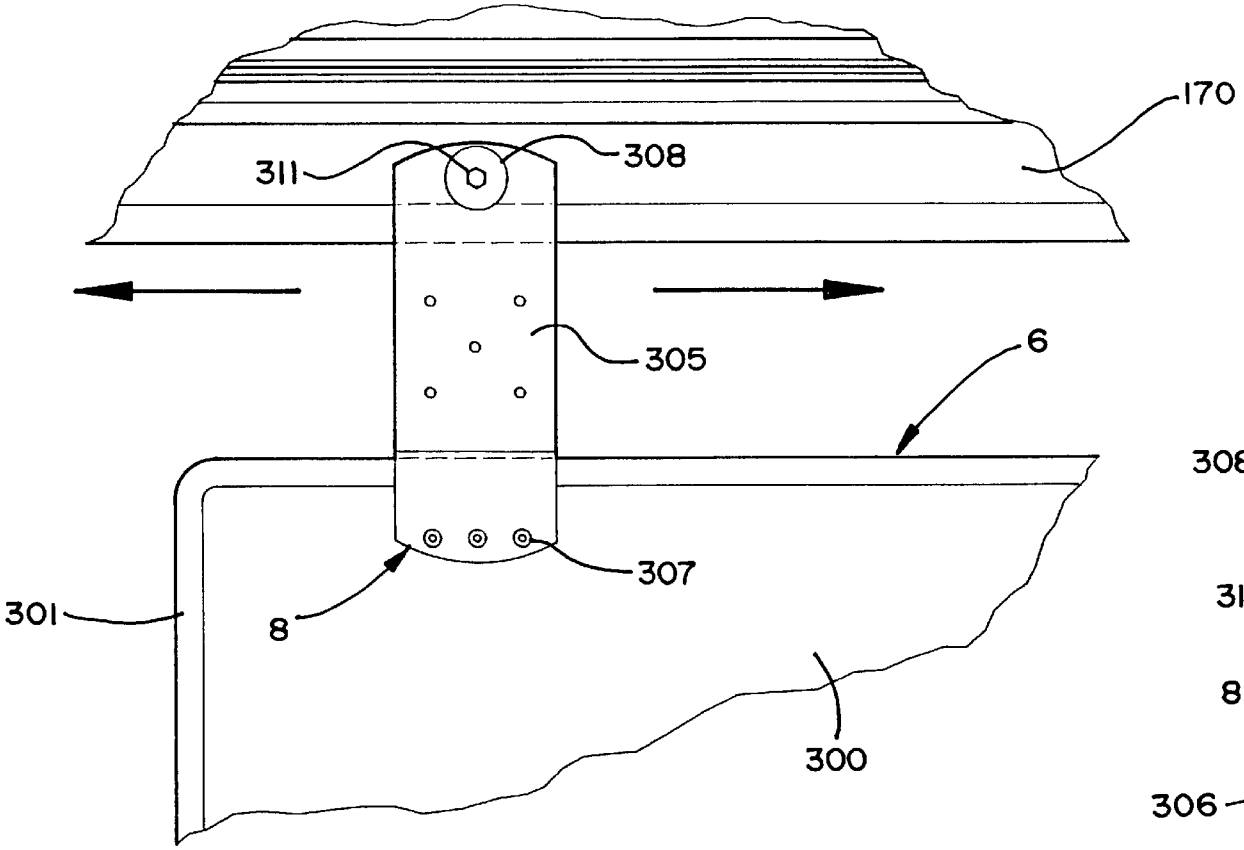
FIG. 46 is a fragmentary, side elevational view of a panel supported on the rail of one of the beam segments.
Figure 86:
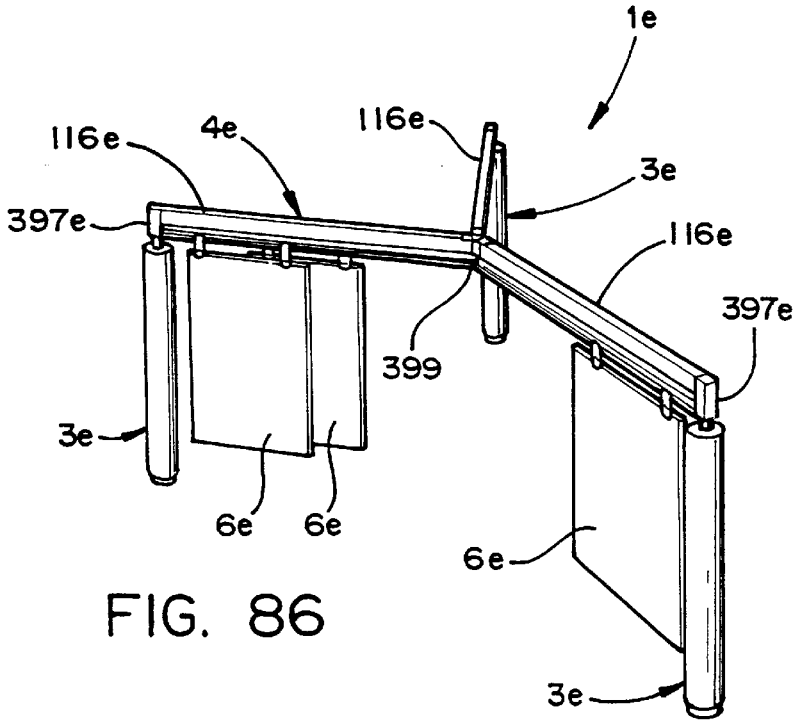
FIG. 86 is a perspective view of yet another embodiment of the present invention, comprising a Y-shaped framework, and shown deployed in an open office plan.
Figure 87:
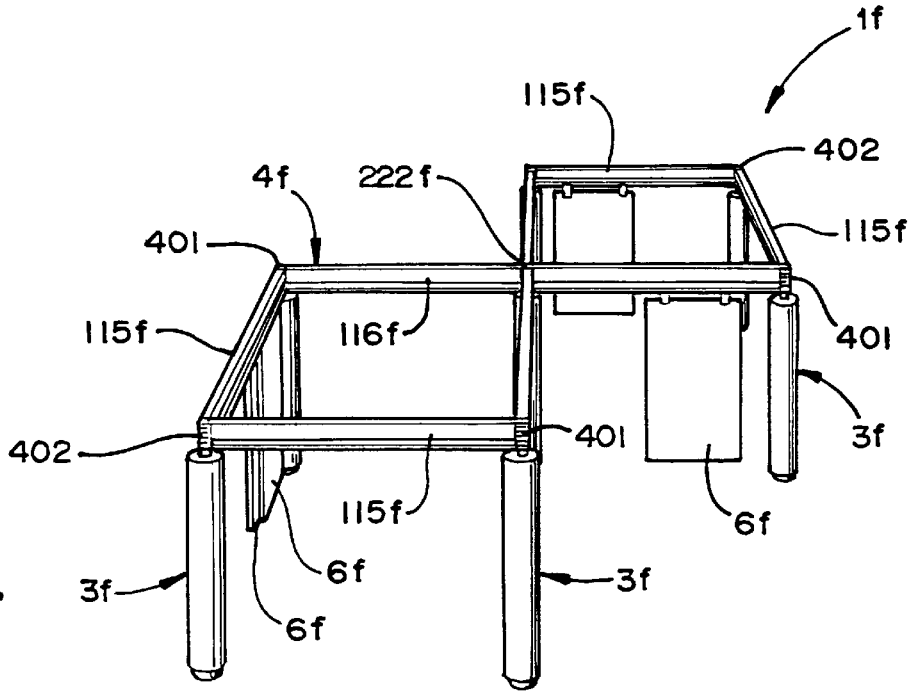
FIG. 87 is a perspective view of yet another embodiment of the present invention, comprising a dual-square framework, and shown deployed in an open office plan.
Figure 88:
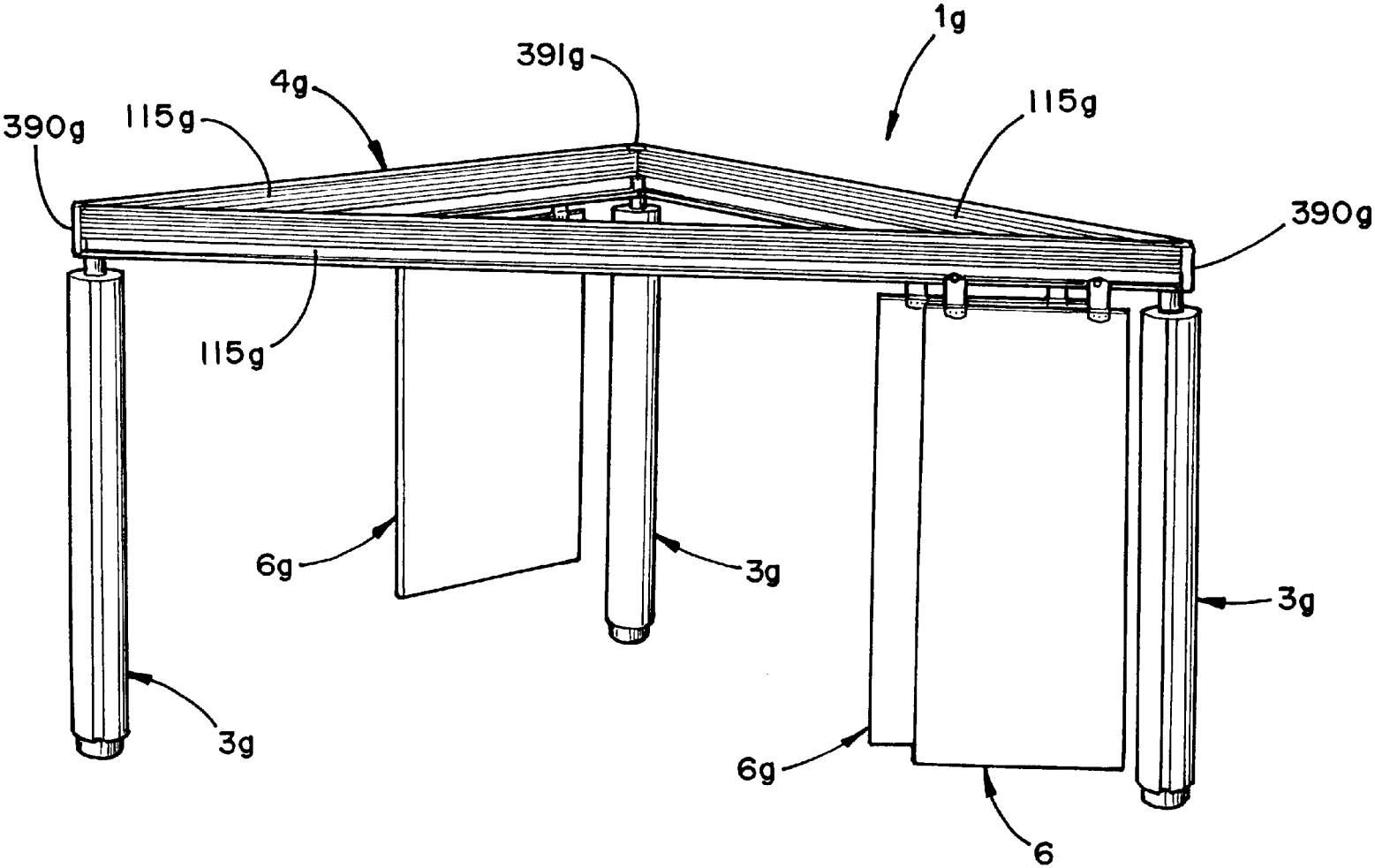
FIG. 88 is a perspective view of yet another embodiment of the present invention, comprising a triangle-shaped framework, and shown deployed in an open office plan.

As best illustrated in FIGS. 44–45, panel 6 can be readily mounted on either side of any perimeter beam segment 155, or cross beam segment 116. The selected panel 6 is manually grasped, and translated to that section of the overhead framework 4 on which the panel 6 is desired to be hung, and the glides 308 on panel 6 are then inserted into the panel hanger rail 170 or 216. For example, when panel 6 is hung on the exterior side of a perimeter beam segment 115, the upper edge 127 of lower beam flange 123 is received within the two notches 310 of panel glides 308. The width of bearing slot 310 is greater than the width of corresponding flange upper edge 127, such that panel 6 can be readily mounted on either a curved, perimeter beam segment 115 (FIG. 44A), or a straight, cross-beam segment 116 (FIG. 45). The shape of panels 6 and their associated connectors 8 in conjunction with hanger rails 170 and 216 also permits panels 6 to be hung back-to-back on opposite sides of beam segments 115 and 116, as illustrated in FIGS. 86–88, without interfering with one another. Antifriction bearings 309 permit each panel 6 to be individually slid horizontally along the overhead framework 4 as illustrated in FIG. 46, to facilitate the configuration and reconfiguration of panels 6.

Figures 43, 43A, 43B, 43C:
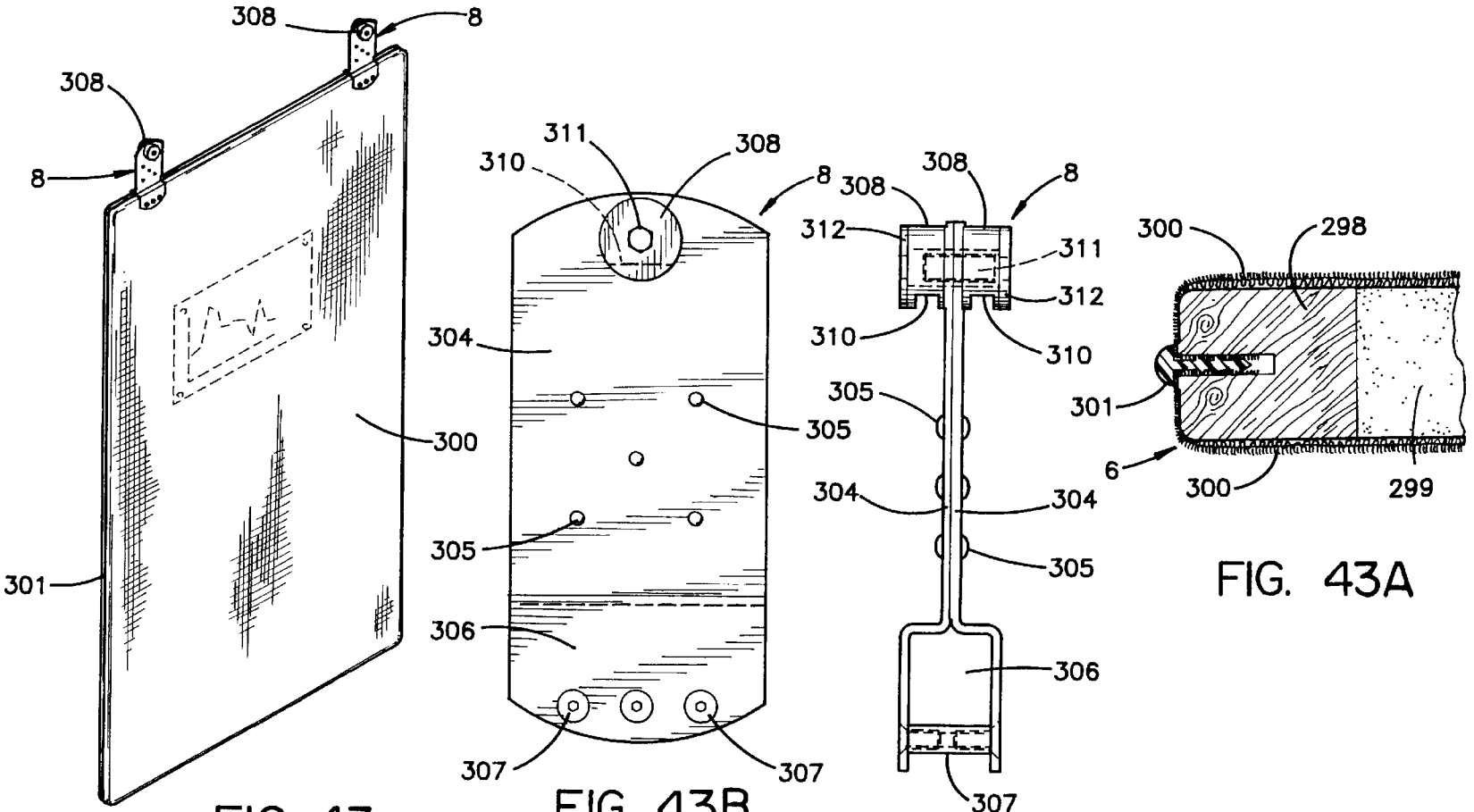
FIG. 43 is a perspective view of a panel.
FIG. 43A is a fragmentary, cross-sectional view of the panel shown in FIG. 43.
FIG. 43B is a front elevational view of a panel connector.
FIG. 43C is a side elevational view of the panel connector.

Panels 6 may be provided with an acoustic interior construction to attenuate the transmission of sound into and out of furniture system 1. One example of such an acoustic construction is illustrated in FIG. 43A, wherein a pair of textile layers 300 overlie a foam core 299. Core 299 may also include a honeycomb panel, sound attenuating bats, and/or other types of sound absorbing devices.

Figure 48:
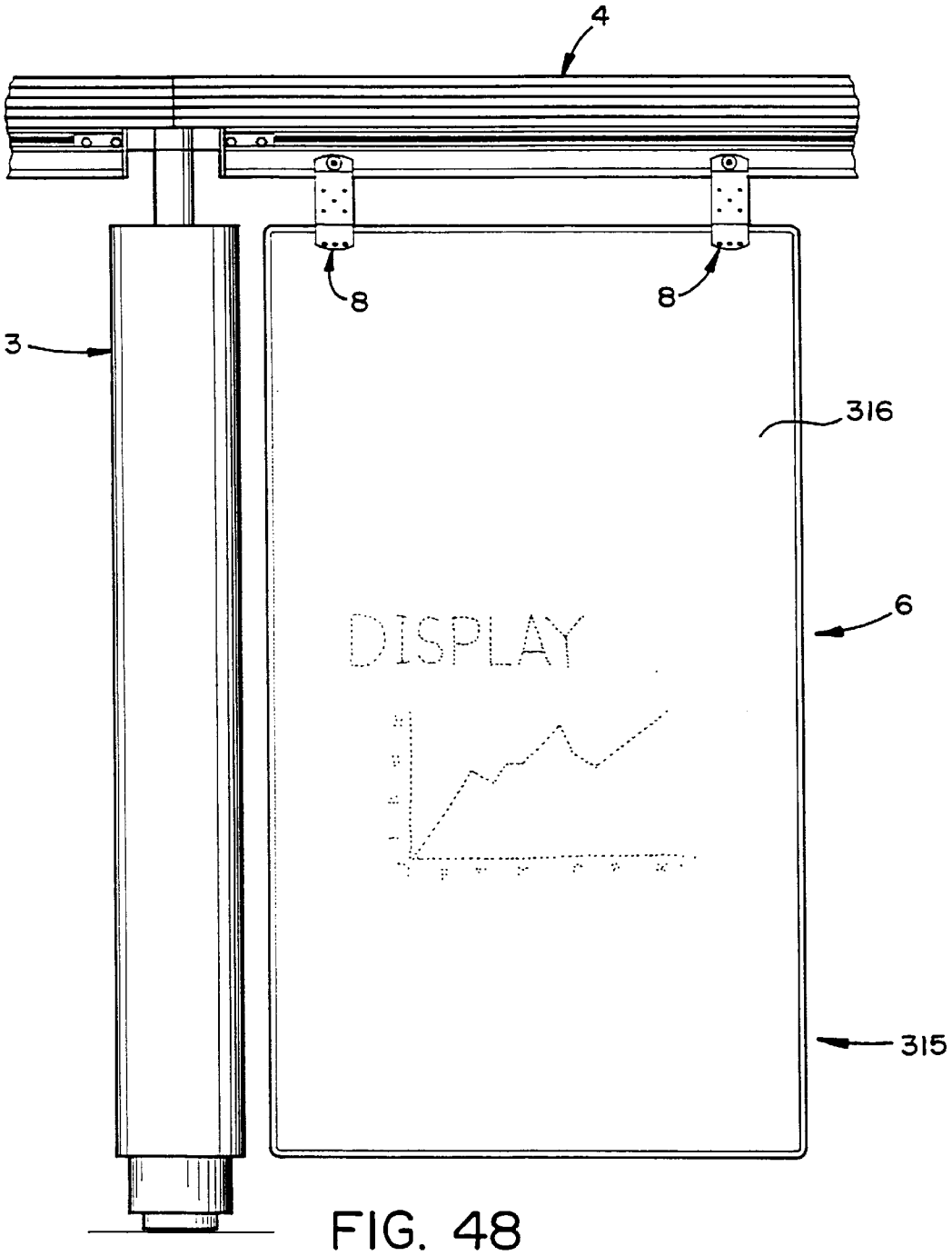
FIG. 48 is a side elevational view of a display panel, shown detachably mounted on the overhead framework.
Figure 48A:
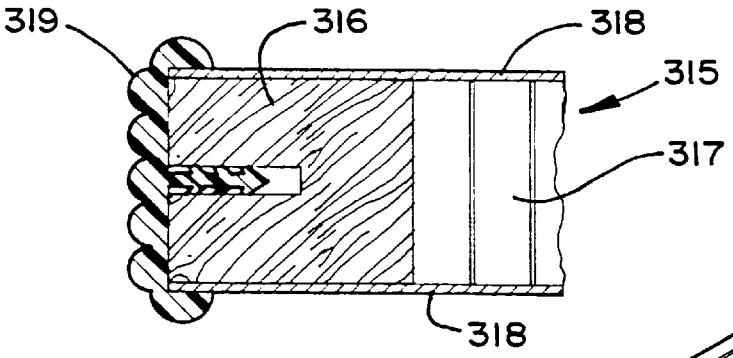
FIG. 48A is a fragmentary, cross-sectional view of the panel shown in FIG. 48.
Figure 49:
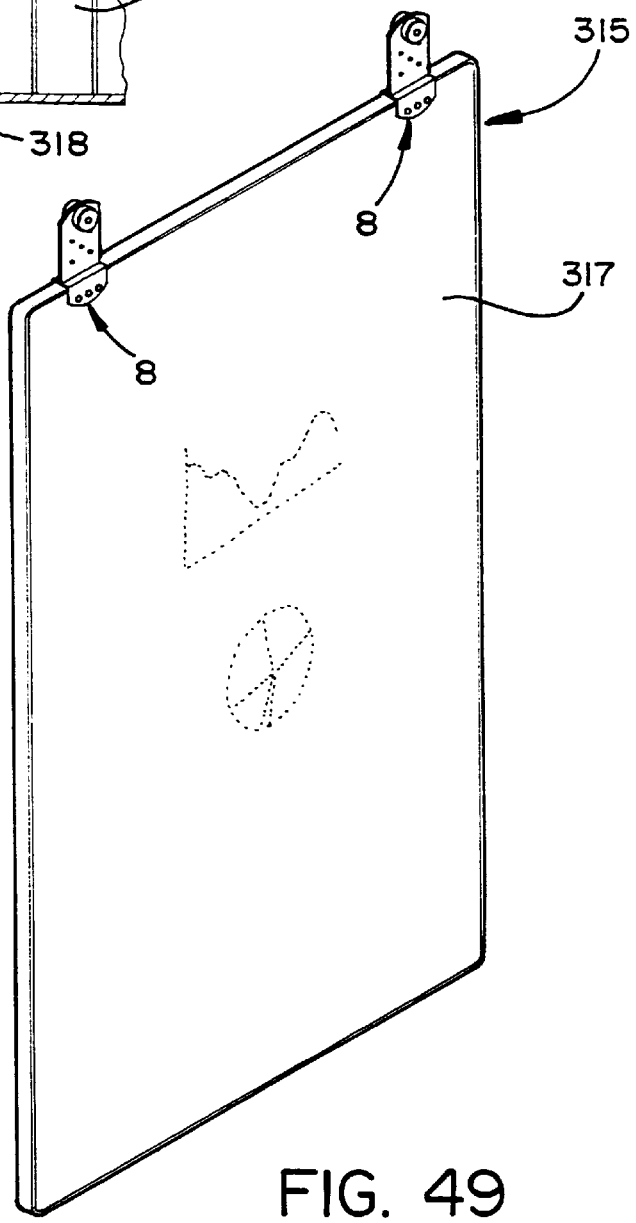
FIG. 49 is a perspective view of the display panel, showing the opposite face thereof.
Figure 50:
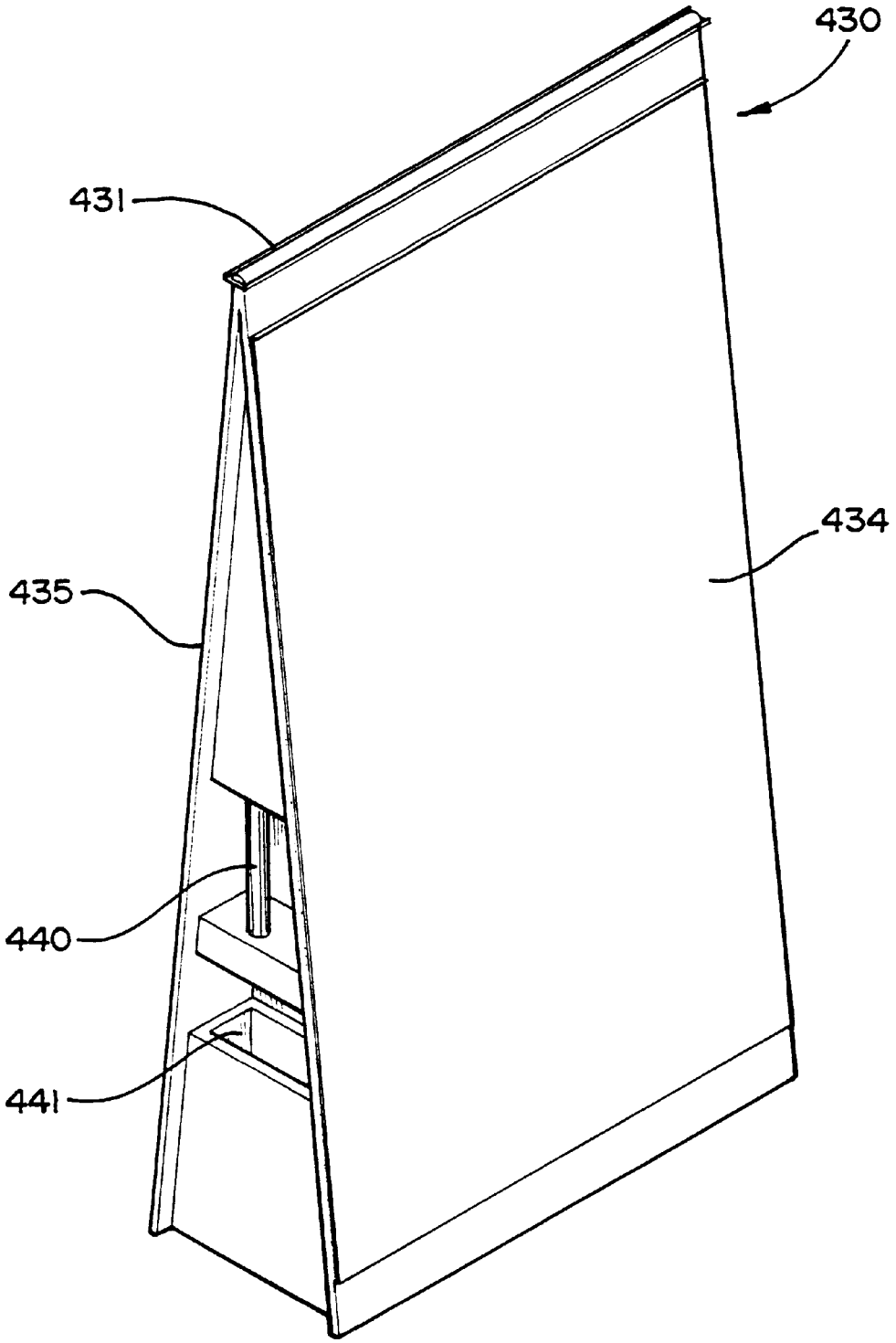
FIG. 50 is a perspective view of a mobile cart.
Figure 51:
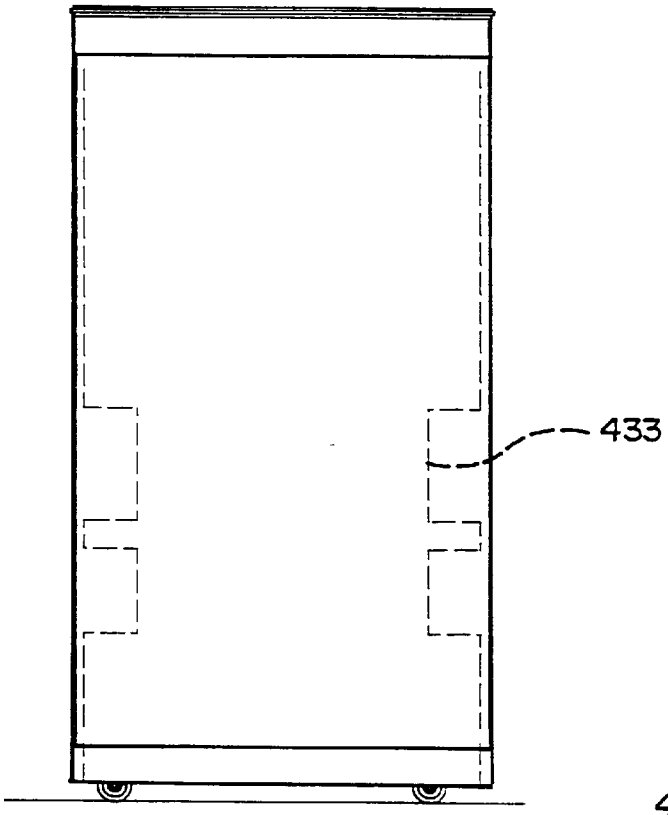
FIG. 51 is a front-elevational view of the mobile cart.
Figure 52:
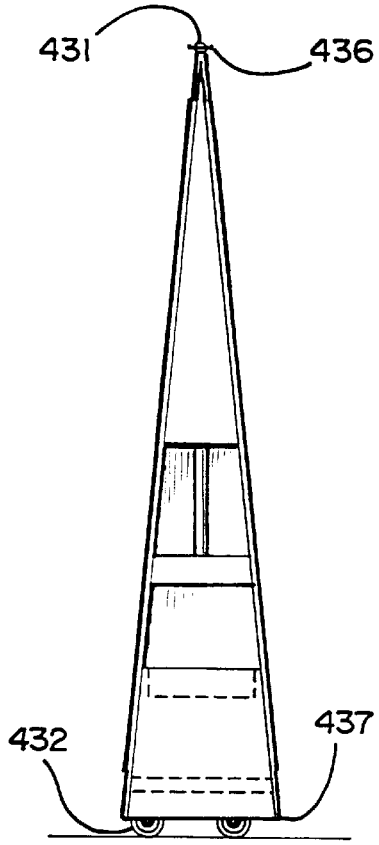
FIG. 52 is a side elevational view of the mobile cart.

Panels 6 may also be provided with one or more display surfaces for storyboarding, and the like, such as the panel 315 illustrated in FIGS. 48–49. Display panel 315 includes an open, lightweight, wood frame 316 with a honeycomb core 317 mounted therein. A pair of marker boards 318 cover the opposite sides of frame 316, and a flexible bumper 319 is attached to and covers the outer edges of frame 316. The illustrated marker boards 318 are erasable, of the type used with felt tipped markers. Display panel 315 may include other types of display surfaces, such as a chalkboard, reflective projector screen and/or electronic or video display (not shown). Display panels 315 are preferably provided in a number of different shapes and sizes to accommodate the various needs of the users. The detachable mounting aspect of display panels 315 in conjunction with their ready portability permits them to be easily moved from one portion of furniture system 1 to another portion thereof, such as when the furniture system is reconfigured for either group or break-out activities. Furthermore, display panels 315 can also be easily transported to other locations, such as the user's permanent workstation, to provide data storage, and thereby avoid duplication, and improve work efficiency. As described below, one or more mobile carts 430 (FIG. 50) may be used to assist in any such transport of display panels 315, and may also be used to temporarily store or support display panels 315, particularly when the display panels 315 are moved outside of furniture system 1.

Figure 56:
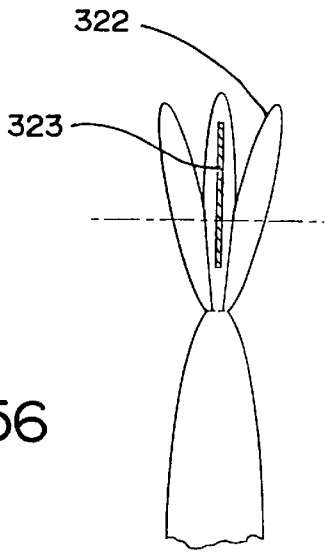
FIG. 56 is a fragmentary, vertical cross-sectional view of the upper portion of the acoustical pad panel, with the associated connector removed.
Figure 55:
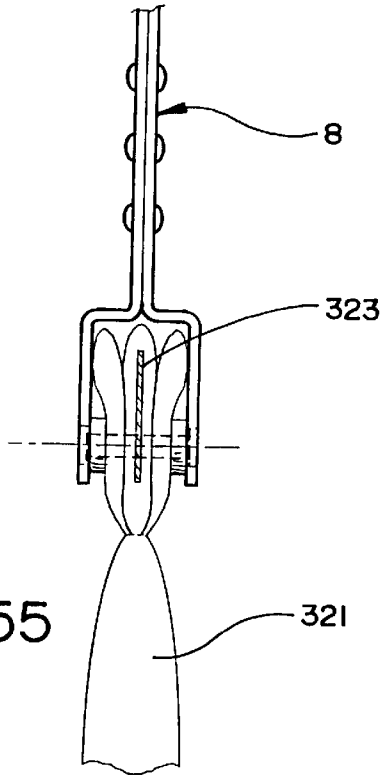
FIG. 55 is a fragmentary, vertical cross-sectional view of an upper portion of the acoustical pad panel.
Figure 54:
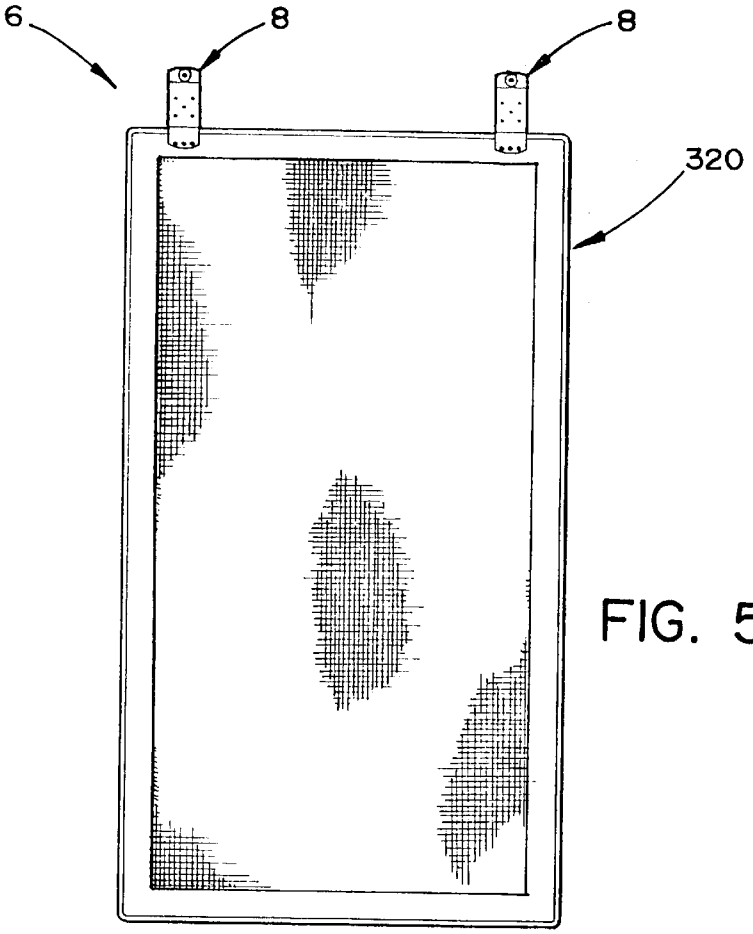
FIG. 54 is a front elevational view of an acoustical pad panel.
Figure 57:
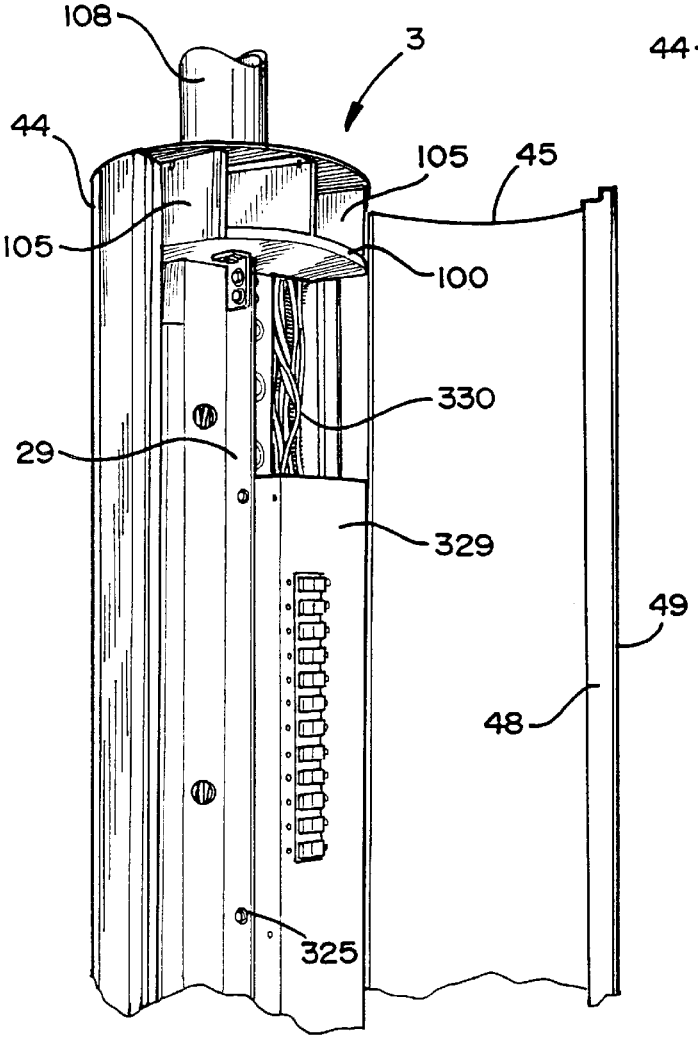
FIG. 57 is a fragmentary, perspective view of a column, shown with the associated cover partially removed to reveal power wiring mounted therein.

Panels 6 may also include an acoustic curtain 320 as illustrated in FIGS. 54–56. Acoustic curtain 320 is constructed from a flexible material, having a sound absorbing core 321 to attenuate the transmission of sound. The upper edge 322 of acoustic curtain 320 is pleated, and includes a reinforcing strip 323 to secure the attachment of panel connectors 8. Acoustic curtain 320 not only absorbs sound, but also functions as a visual barrier or partition.

With reference to FIGS. 50–53, a plurality of substantially identical mobile carts 430 are provided to assist in the configuration of panels 6 on overhead framework 4. Each of the illustrated mobile carts 430 has a generally triangularly shaped side-elevational configuration, with a panel mounting rail 431 positioned along the upper edge thereof, and casters 432 mounted along the bottom thereof to facilitate manual translation of mobile cart 430 over the floor 5 of open office space 2. The illustrated mobile cart 430 includes an interior frame 433 over which a pair of face panels 434 and 435 are mounted at the front and rear of interior frame 433. The upper edges 436 of face panels 434 and 435 are interconnected along mounting rail 431, and their lower edges 437 are spaced apart a predetermined distance by interior frame 433, such that face panels 434 and 435 assume an inverted V-shaped side-elevational configuration.

In the illustrated example, mobile cart 430 includes four casters 432 mounted adjacent each corner of the base of interior frame 433. Interior frame 433 includes a pair of handles 440 which are accessible from opposite sides of mobile cart 430, and facilitate manually translating mobile cart 430 about furniture system 1. Interior frame 433 also includes a pair of receptacles 441 which are adapted to receive and retain selected articles therein, such as markers, erasers, refuse and the like.

Figure 53:
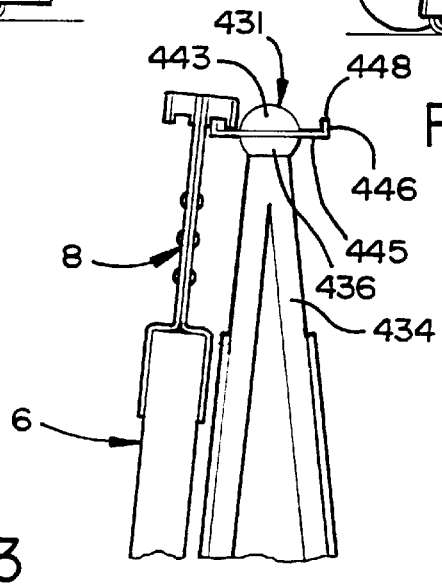
FIG. 53 is a fragmentary, side elevational view of the mobile cart, shown with a panel hung on one side thereon for storage.

The mounting rail 431 of mobile cart 430 is adapted to detachably support any style of panel 6 thereon in a hanging fashion, similar to the manner in which panels 6 are suspended from overhead framework 4. With reference to FIG. 53, mounting rail 431 includes an arcuately shaped bracket 443 attached to the upper edges 436 of face panels 434 and 435. A U-shaped channel 444 is mounted in bracket 443, and comprises a horizontal web 445, with a pair of upstanding flanges 446 along opposite sides thereof. Each of the bracket flanges 446 includes a squared off, upwardly facing free edge 448 that is shaped to be received within the bearing notch 310 of each panel connector 8, so as to securely support associated panel 6 on mounting rail 431 in a hanging fashion. The inwardly oriented one of the faces of a panel 6 hung on mobile cart 430 abuts against the outer surface of the associated face panel 435 of mobile cart 430. The vertical height of the panel hanger edges 448 on bracket 443 is slightly greater than the overall vertical length of panels 6, such that the lowermost edge of a panel 6 stored on mobile cart 430 is positioned above the floor surface to prevent interference with the translation of mobile cart 430 over the floor 5 of the building room. Preferably, the overall height of mobile cart 430, as measured to the top of mounting rail 431, is slightly less than the height of overhead framework 4, as measured to the bottoms of beam segments 115 and 116, such that mobile cart 431 can be readily translated underneath overhead framework 4 to various locations within furniture system 1. The panel hanger edges 448 of bracket 443 are positioned at an elevation substantially equal to, but slightly less than the elevation of panel hanger rails 170 and 216, so that the user's motion in handling panels 6 is generally the same at both overhead framework 4 and mobile cart 430. The inverted V-shape of mobile cart 430 retains stored panels 6 in a vertically angled orientation which permits mobile cart 430 to have a height capable of translating beneath overhead framework 4, yet prevent the bottom edges of the stored panels 6 from touching the floor.

Preferably, each of the mobile cart face panels 434 and 435 includes a display surface, such as the illustrated marker boards 451 and 452, which permit mobile cart 430 to be used independently as a freestanding display, even if there are no display type panels 315 stored thereon. In the illustrated example, marker boards 451 and 452 cover a major portion of their associated face panels 434 and 435, and are adapted for use in conjunction with felt tip markers, and other soft, erasable writing instruments. Face panels 434 and 435 may also be provided with alternative exterior surfaces, such as a tackable surface, an electronic display, a reflective screen, or the like.

Figure 85:
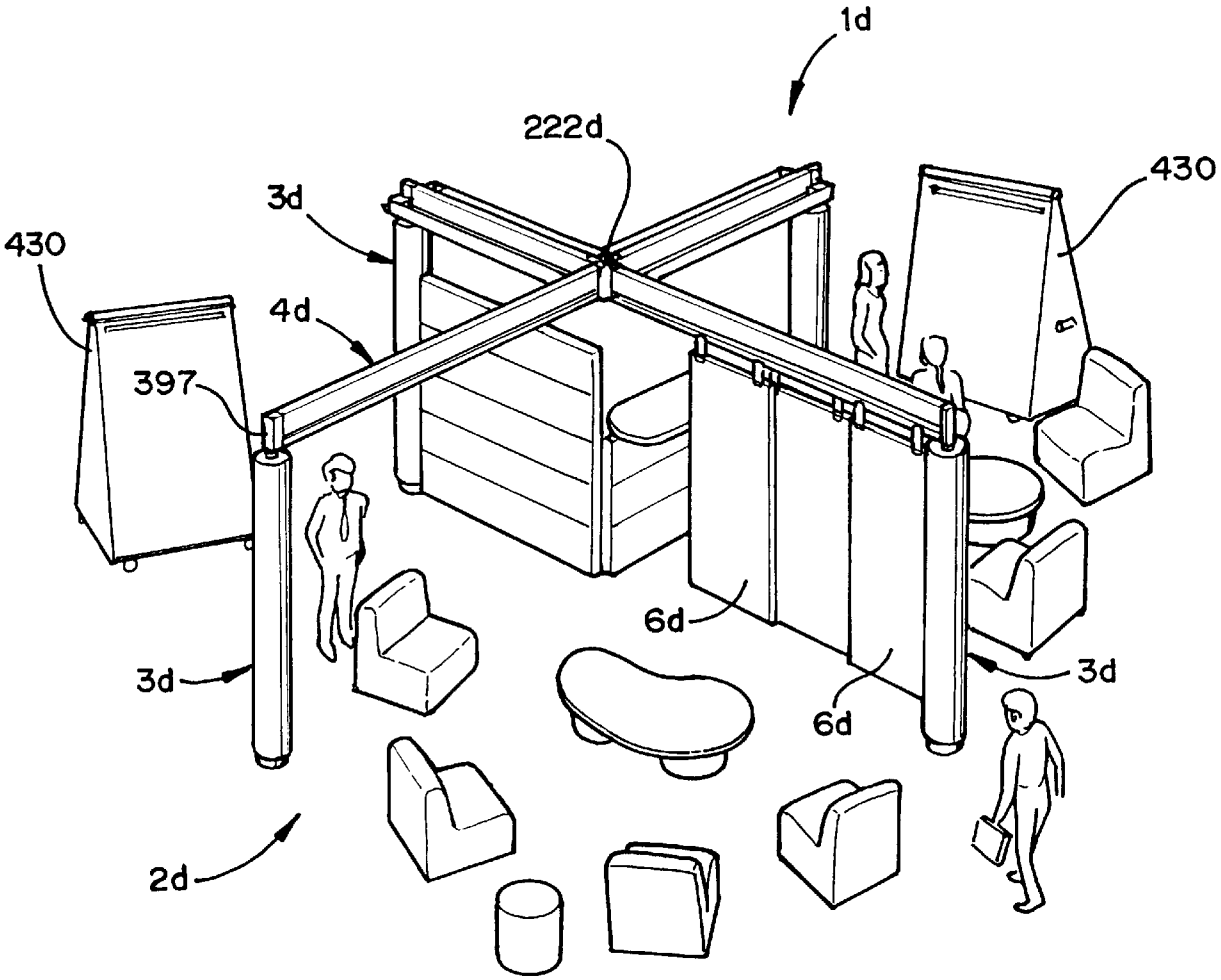
FIG. 85 is a perspective view of yet another embodiment of the present invention, comprising an X-shaped framework, and shown deployed in an open office plan.
Figure 89:
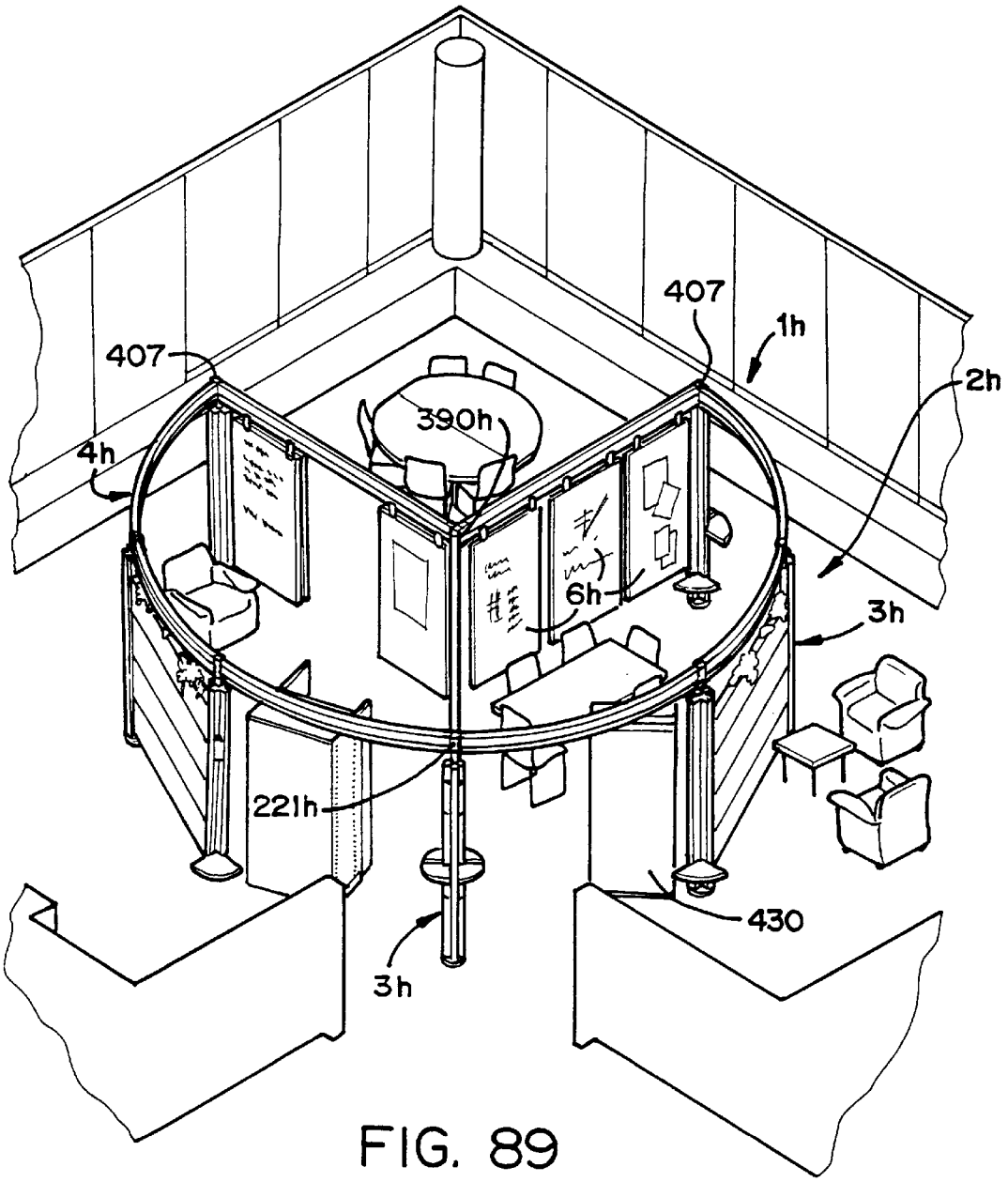
FIG. 89 is a perspective view of yet another embodiment of the present invention, comprising a semi-arcuate framework, and shown deployed in an open office plan.

As best illustrated in FIGS. 1, 85 & 89, mobile cart 430 may also be used with furniture system 1 as an independent, portable partition. In the illustrated embodiments of the present invention, the width of mobile cart 430 is substantially less than the distance between two adjacent columns 3 in overhead framework 4, such that mobile cart 430 can be readily positioned therebetween to partition the associated portion of furniture system 1 from the balance of the building room. Alternatively, mobile cart 430 may be positioned at a location beneath overhead framework 4 to further subdivide the workspace associated with furniture system 1.

Figure 58:
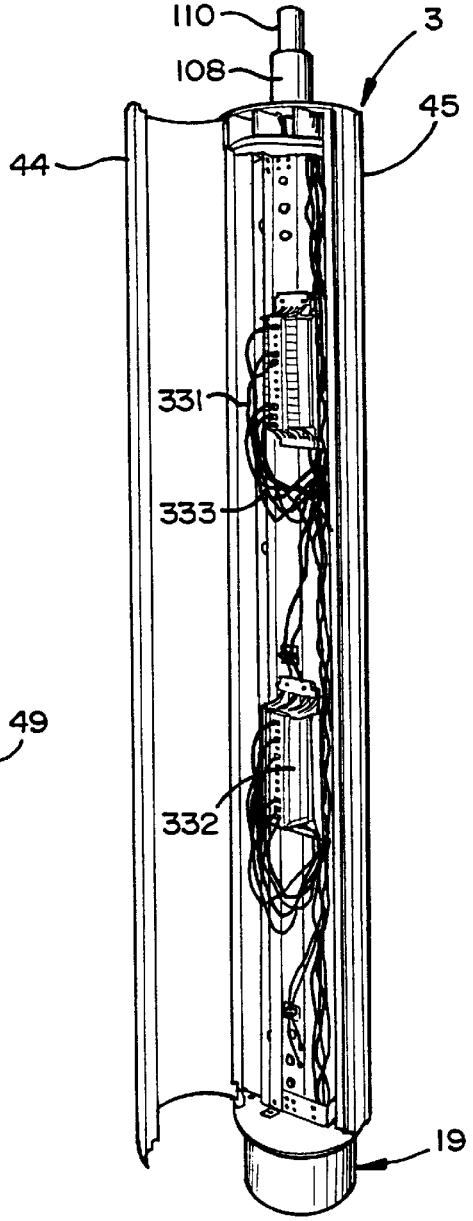
FIG. 58 is a fragmentary, perspective view of a column, shown with the associated cover partially removed to reveal cable wiring mounted therein.
Figure 59:
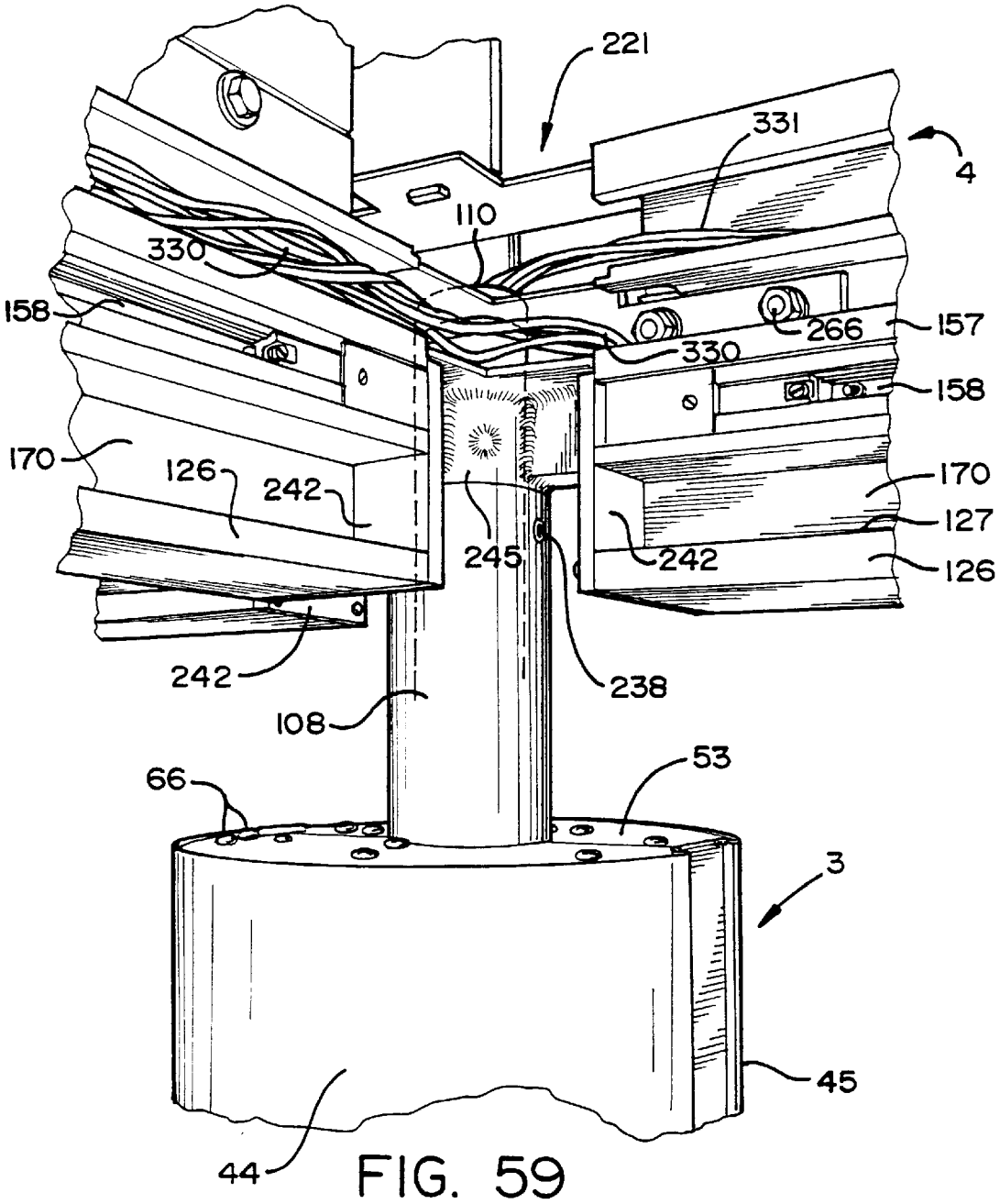
FIG. 59 is a fragmentary, perspective view of a T-connection, with the beam covers removed to reveal the routing of power and communication wires therethrough.
Figure 61:
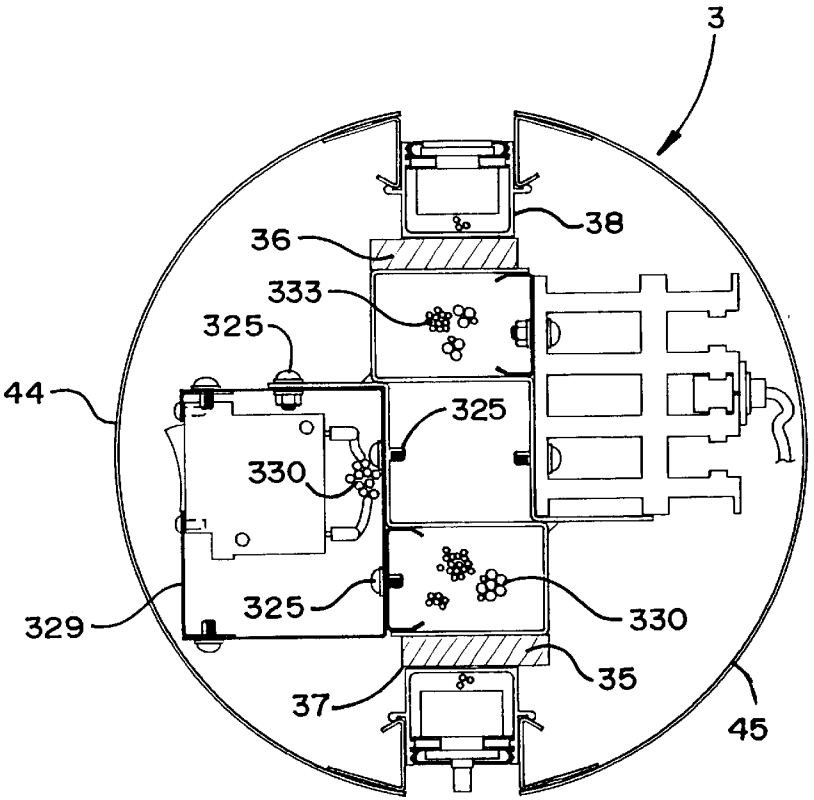
FIG. 61 is a horizontal cross-sectional view of a column, shown with power units and communication units mounted therein, and connected with the associated wires.
Figure 60:
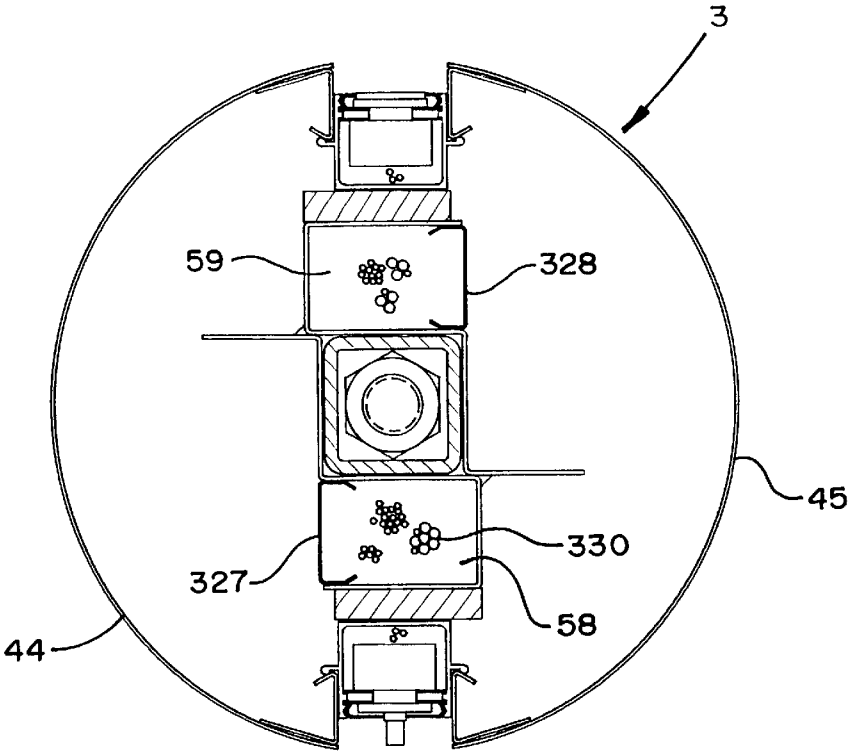
FIG. 60 is a horizontal cross-sectional view of a column, shown with power and communication wires disposed therein.
Figure 64:
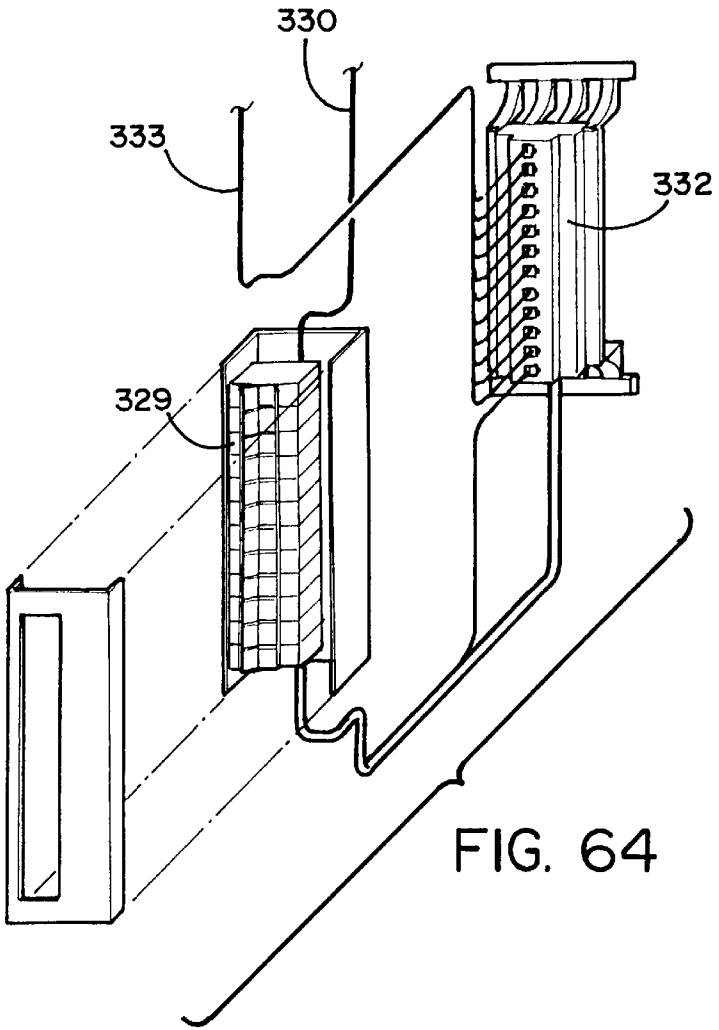
FIG. 64 is a partially schematic, exploded perspective view of power units and communication units for mounting in a column.

Furniture system 1 is preferably capable of routing both power and cable wires throughout columns 3 and overhead framework 4 to facilitate the use of electronic equipment throughout the furniture system, and can even serve as a means to wire open office space 2. As previously noted, the core assembly 18 (FIGS. 60 & 61) of each column 3 includes an internal power raceway 58, and an internal cable raceway 59 through which power and signal cables are routed vertically through a major portion of the associated column 3, and provide structure on which various types of electronic devices can be mounted within the interior of column 3. U-shaped covers 327 and 328 extend continuously along, and enclose the open sides of internal wiring raceways 58 and 59, respectively. In the example illustrated in FIG. 61, a circuit breaker box 329 is mounted adjacent internal power raceway 58 on cover 327, and flanges 28 & 29 of core weldment 21 by fasteners 325, and is electrically connected with multiple power cables 330 routed in internal power raceway 58. A data bus block 331 (FIG. 58) and a voice bus block 332 are shown similarly mounted on adjacent cable raceway 59 (FIG. 61), and are electrically connected with the cable wires 333 therein. As illustrated schematically in FIG. 64, a series of vertically stacked circuit breakers 329 are typically required for furniture system 1, which are connected through power wires 330 to a building power source (not shown), and serve to distribute multiple power circuits throughout the furniture system. The illustrated voice bus 332 is connected to a main system input, and includes multiple ports into which individual communication devices can be connected. Telephone and/or other similar equipment can be mounted directly on columns 3 to conserve space. Column covers 44 and 45 are configured to totally enclose all of the internal electronic devices, such as the illustrated circuit breaker box 329, data bus block 331, and voice bus block 332.

Both power and cable wires 330 and 333 can be routed upwardly from column 3, through the associated connector 220–222, and into one or more beam segments 115–116 in the following fashion. In the example shown in FIGS. 62 and 63, power wires 330 are routed upwardly along internal power raceway 58, and through the window 103 in column top plate 100. Power wires 330 are then routed inwardly between the sides of transition box brackets 107, and then upwardly through the annular power raceway 112 formed between the exterior of cable extender tube 110, and the interior of column connector tube 108. Power wires 330 are then routed along the power raceway 156 or 214 of either perimeter beam segment 115 or cross beam segment 116. The windows 164 in the middle intermediate flanges 129 of beam segments 115 and 116 permit power cables 330 to be inserted therethrough and connected with the electrical bus strips 158 to provide power to lighting fixtures 159.

Figure 63:
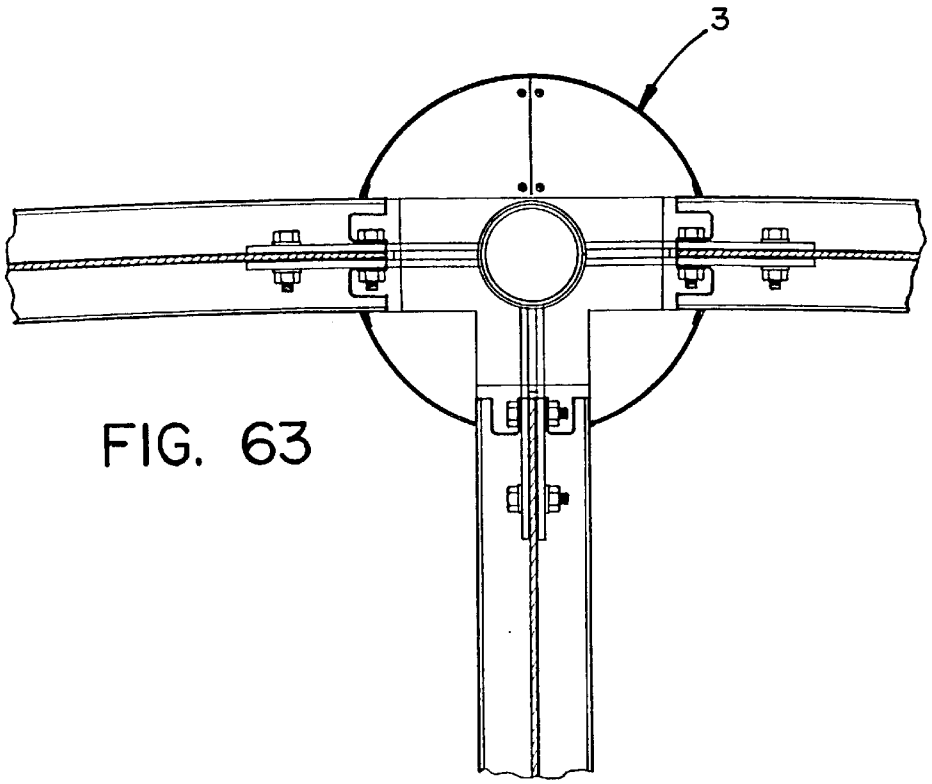
FIG. 63 is a top plan view of a T-connection, shown with portions thereof broken away to reveal the routing of power and cable wires therethrough.

Cable wires 333 can also be routed from column 3 through any one of the connectors 220–222 into either a perimeter beam segment 115, or a cross beam segment 116. With reference to FIGS. 62 and 63, cable wires 333 extend upwardly along interior cable raceway 59, and through the window 104 in column top cap 100. Cable wires 333 are then threaded inwardly between the edges of transmission box brackets 107, and then upwardly through the interior of signal extender tube 110. Cable wires 333 may then be routed horizontally through the cable raceway 155 or 213 of either perimeter beam segment 115, or cross beam segment 116.

Figure 65:
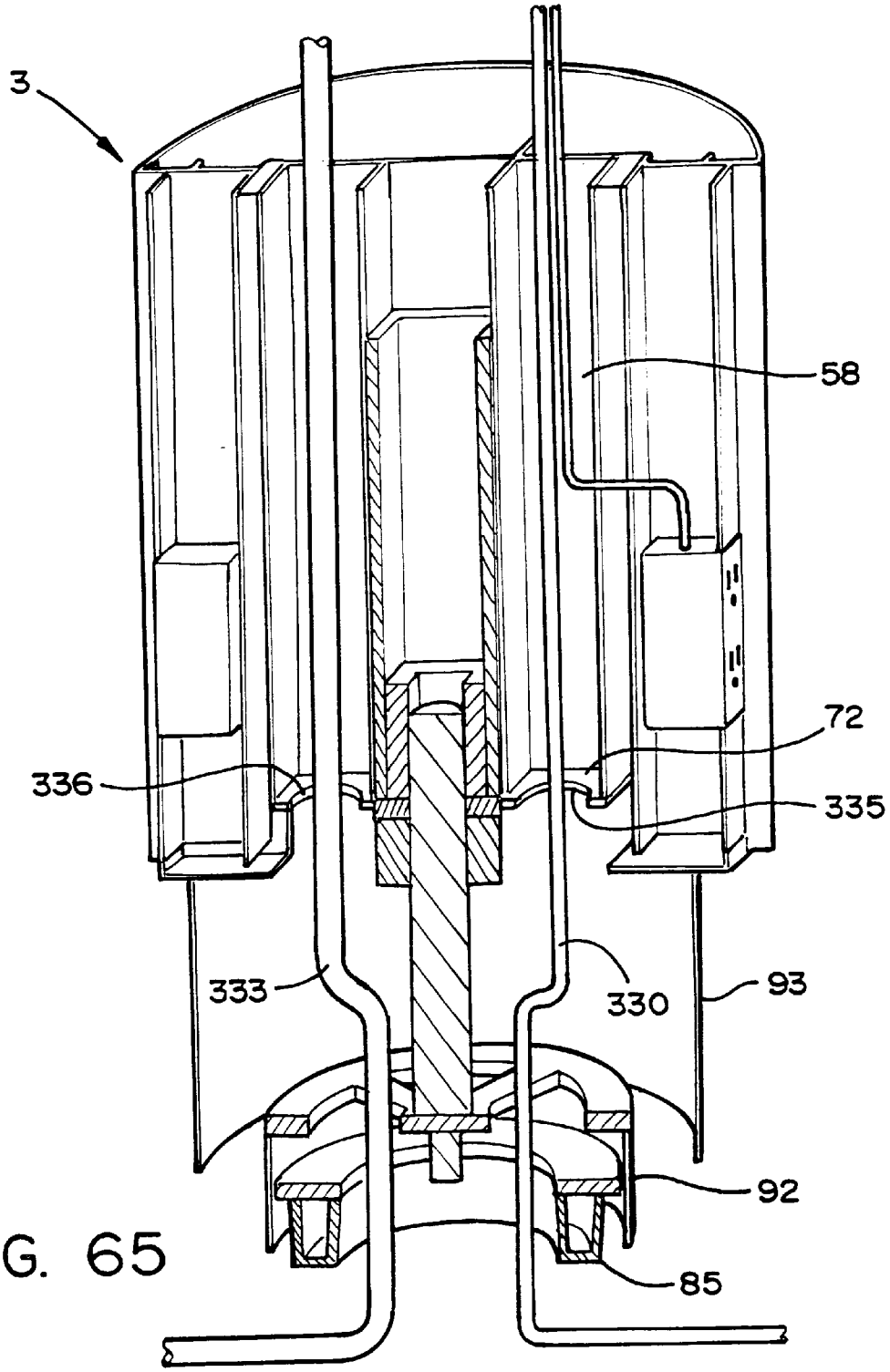
FIG. 65 is a fragmentary, vertical cross-sectional view of the column foot, shown with power and cable wires routed therethrough.

As best illustrated in FIG. 65, power wires 330 and cable wires 333 can also be routed vertically downwardly along column 3, through the foot assembly 19, and connected to associated electrical sources, such as through a platform, access floor, or the floor of the building. Power wires 330 are routed downwardly along internal power raceway 58 through a window 335 in structural base plate 72, then downwardly through one of the openings 91 in upper foot base 88, and lower foot base plate 86, and foot base 85. Similarly, cable wires 333 are routed downwardly along interior cable raceway 59 through window 336 in structural base plate 72, and then downwardly through one of the openings 91 opposite power wires 330 in upper foot base 88, as well as lower foot base plate 86, and foot base 85. In this fashion, power wires 330 are physically separated from cable wires 333 throughout the entire furniture system 1, thereby alleviating electrical interference between the same.

Figure 68:
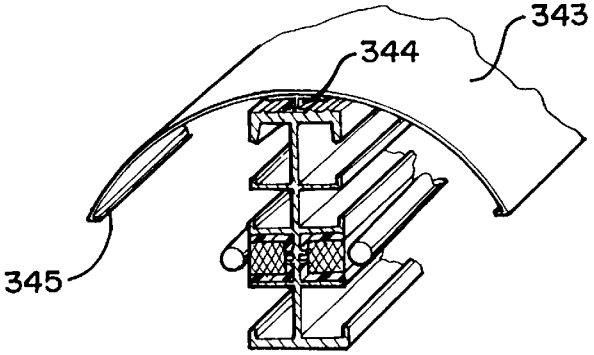
FIG. 68 is a fragmentary, perspective view of a perimeter beam segment with a curvilinear downlighting arrangement mounted thereon.
Figure 67:
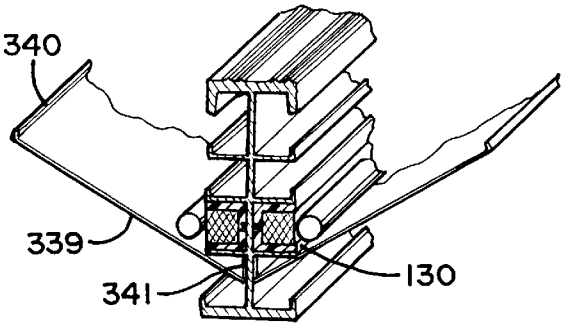
FIG. 67 is a fragmentary perspective view of a perimeter beam segment with a "V" uplighting arrangement mounted thereon.
Figure 69:
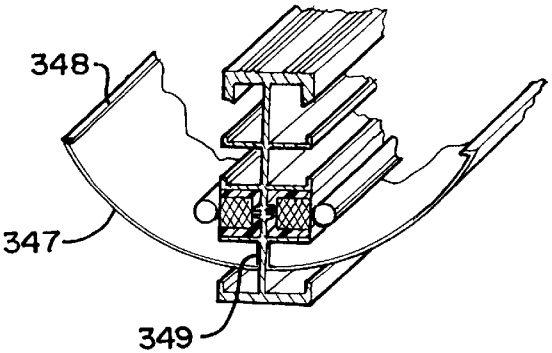
FIG. 69 is a fragmentary, perspective view of a perimeter beam segment with a curvilinear uplighting arrangement mounted thereon.

In addition to the task lighting fixtures 159 illustrated in FIG. 66, furniture system 1 is also adapted to include either uplighting or downlighting as illustrated in FIG. 67–69, by the addition of elongate lighting elements, such as the illustrated fluorescent tubes 338, which are mechanically and electrically connected with the electrical bus strips 158.

A "V" uplighting option is illustrated in FIG. 67, wherein a pair of covers 339 are attached to the web of a selected beam segment 115 or 116. The illustrated covers 339 have a substantially planar configuration, with upturned outer edges 340, and upwardly formed interior edges 341, which are attached to the beam web 121, directly underneath the lower intermediate flange 130. Covers 338 extend outwardly and upwardly from beam web 121 towards the ceiling of the room, and preferably have reflective interior surfaces which provide efficient uplighting for the room.

A curvilinear downlighting option is illustrated in FIG. 68, wherein an arcuate cover 343 is attached to the upper flange 122 of the associated beam segment 115 along its longitudinal center line by a clip 344 having an inverted T-shaped configuration. The outer edges 345 of arcuate cover 343 are turned inwardly, and the interior surface thereof is preferably reflective to direct light downwardly onto the floor 5 of the building room.

A curvilinear uplighting option is illustrated in FIG. 69, wherein a pair of arcuately shaped covers 347 are attached to the web 121 of a perimeter beam segment 115 at a location directly beneath the lower intermediate flange 130. Each arcuate cover 347 includes an inwardly bent free edge 348, and an upwardly turned interior edge 349 connected with beam web 121. The interior surfaces of arcuate covers 347 are preferably reflective, such that light from fluorescent tubes 338 is directed upwardly toward the ceiling of the building room.

It is to be understood that while the lighting arrangements illustrated in FIGS. 67–69 are shown in conjunction with a perimeter beam segment 115, they may also be connected with one or more of the cross beam segments 116.

As illustrated in FIGS. 70–81, furniture system 1 preferably includes some additional, optional accessories, such as different style covers for columns 3 and overhead framework 4, so that the exterior appearance of furniture system 1 can be varied without altering its structural configuration. Alternatively shaped extensions are also available, which replace the covers for beam segments 115 and/or 116 to provide additional storage for wiring.

Figure 72:
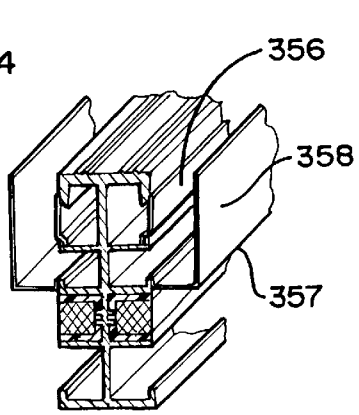
FIG. 72 is a fragmentary, perspective view of a perimeter beam segment with an open raceway extension mounted thereon.
Figure 71:
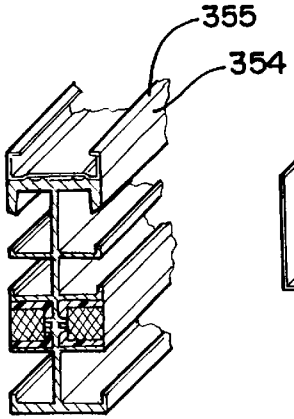
FIG. 71 is a fragmentary, perspective view of a perimeter beam segment with a top cable tray mounted thereon.
Figure 70:
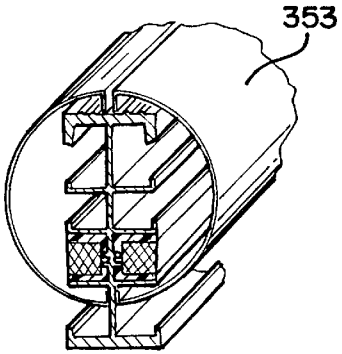
FIG. 70 is a fragmentary, perspective view of a perimeter beam segment with a circular beam cover mounted thereon.

More specifically, a circular beam cover option is illustrated in FIG. 70, wherein the flat covers 145 of a perimeter beam segment 115 are replaced by a pair of arcuate covers 353, which extend from the exterior center line of upper flange 112 to just under the bottom intermediate flange 130. A top cable tray option is illustrated in FIG. 71, wherein a U-shaped channel 354, with inwardly formed free edges 355, is attached to the exterior surface of upper flange 112 by clip-on arrangement (not shown). An open raceway extension option is illustrated in FIG. 72, wherein the flat covers 145 of a perimeter beam segment 115 are replaced by a pair of narrow, cover strips 356 which enclose the sides of beam signal raceway 155, and a pair of U-shaped extensions 357, each of which includes a groove in which the upper edge 134 of middle intermediate flange 129 is received to mount the associated extension 357 in power raceway 156, and an upwardly extending outer flange 358 which extends upwardly to a point substantially parallel to the upper surface of top flange 122.

Figure 74:
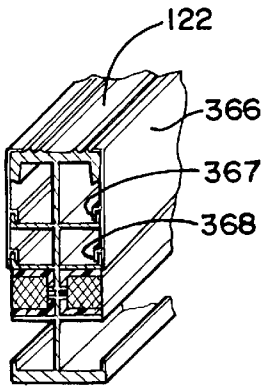
FIG. 74 is a fragmentary, perspective view of a perimeter beam segment with a rectangular beam cover mounted thereon.
Figure 73:
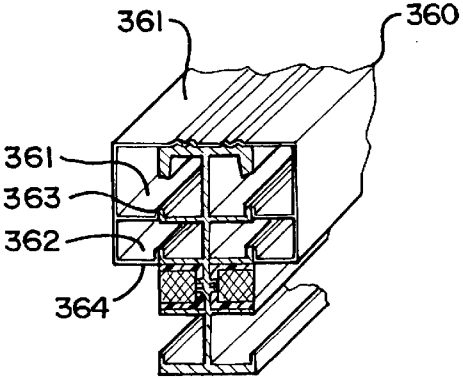
FIG. 73 is a fragmentary, perspective view of a perimeter beam segment with an enclosed raceway extension mounted thereon.

An enclosed raceway extension option is illustrated in FIG. 73, wherein the flat beam covers 145 of a perimeter beam segment 115 are replaced by a pair of enlarged E-shaped covers 360. The upper flanges 361 of E-shaped covers 360 are attached to the exterior surface of upper beam flange 122, while the lower two flanges 361 and 362 of covers 360 include channels 363 and 364 respectively along their free edges in which the free edges 132 and 134 of intermediate flanges 128 and 129 are received. A rectangular beam cover option is illustrated in FIG. 74, which is somewhat similar to the previously described covers 145 and 204 for beam segments 115 and 116, except that each cover 366 has its upper edge attached to the exterior surface of top flange 122, and includes channels 367 and 368, which are similar to channels 363 and 364, and connect the associated cover 366 to the free edges 132 and 134 of intermediate flanges 128 and 129.

Figure 76:
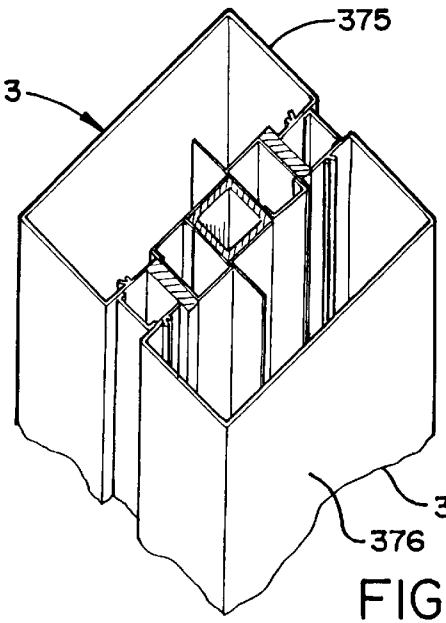
FIG. 76 is a fragmentary, perspective view of a column with a large square cover mounted thereon.
Figure 75:
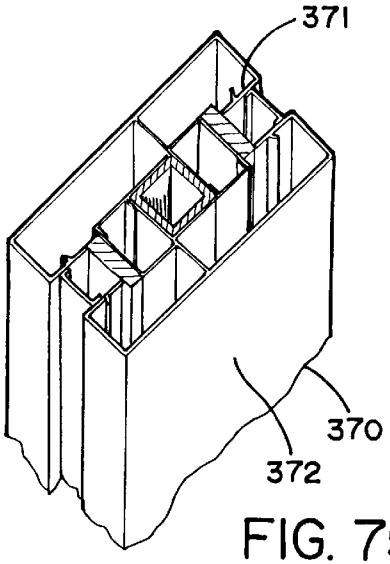
FIG. 75 is a fragmentary, perspective view of a column with a rectangular cover mounted thereon.

Exemplary alternative covers for columns 3 are illustrated in FIGS. 75–80. More specifically, a rectangular column cover option is illustrated in FIG. 75, wherein previously described arcuate covers 44 and 45 are replaced by a pair of U-shaped covers 370, having inwardly turned free edges 371 which engage the hooks 40 on external raceways 37 and 38 in a snap-lock fashion. The center or web portion 372 of each cover 370 is substantially flat, and extends adjacent to the free edges of associated core web 29, such that the exterior of column 3 assumes a substantially rectangular lateral cross-sectional shape. A large square column cover option is illustrated in FIG. 76, wherein arcuate column covers 44 & 45 are replaced by a pair of U-shaped covers 374, which are substantially identical in shape to previously described rectangular covers 370, except that the side flanges 375 are enlarged, such that the web 376 of each cover 374 is spaced apart from the free edge of associated core flange 29, and the exterior of column 3 assumes a substantial square lateral cross section configuration.

Figure 77:
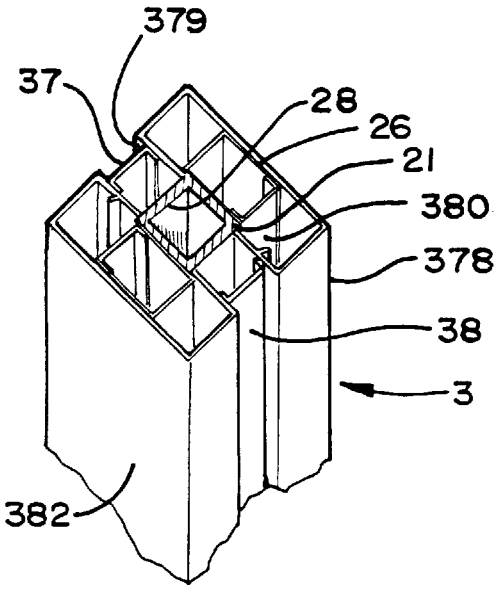
FIG. 77 is a fragmentary, perspective view of a column with a small square cover mounted thereon.

A small square column cover option is illustrated in FIG. 77, wherein the external raceways 37 and 38 are attached to flanges 28 of core weldment 21, so as to define a more compact column construction. The arcuate covers 44 and 45 are replaced by a pair of generally U-shaped covers 378, having one side 379 thereof attached to the side of the associated one of raceways 37 and 38. The opposite side 380 of each cover 378 is formed to define a Z-shaped channel, with its free edge abutting the free edge of associated core weldment flange 26 to enclose internal powerways 58 and 59. The center portion or web 382 of each cover 378 is substantially planar, and is positioned immediately adjacent to the exterior surface of associated core weldment flange 26, such that the exterior of column 3 assumes a substantially square lateral cross-sectional shape.

Figure 78:
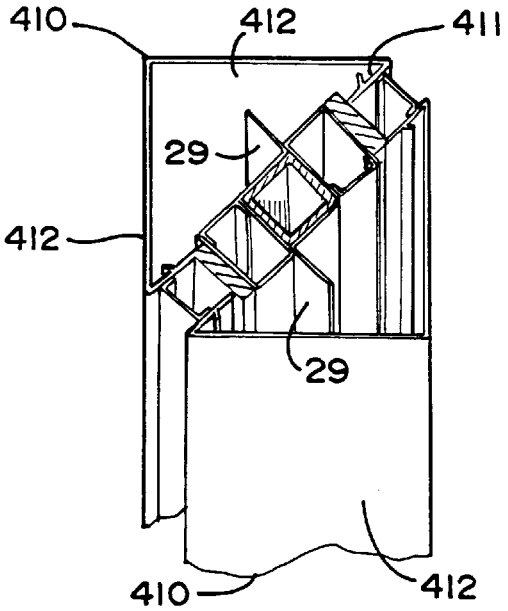
FIG. 78 is a fragmentary, perspective view of a column with a large triangular cover mounted thereon.

A large diamond or triangle column cover option is illustrated in FIG. 78, wherein arcuate covers 45 and 46 are replaced by a pair of V-shaped covers 410, having inwardly turned free edges 411 which engaged the hooks 40 on external raceways 37 and 38 in a snap-lock fashion. The two sides or faces 412 of each cover 410 are substantially flat, and are mutually oriented at an acute angle along their common edge. The outer edges of V-shaped covers 410 extend diametrically outwardly from core weldment 21 along a plane oriented parallel with core weldment flanges 29, and are generally in-line with the axial center of weldment tube 31, such that the exterior of column 3 assumes a substantially triangular lateral cross-sectional shape.

Figure 79:
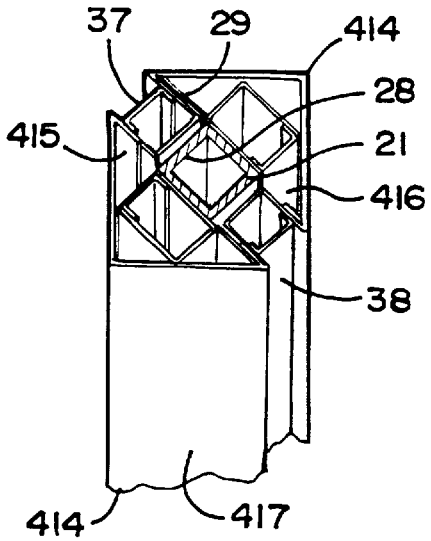
FIG. 79 is a fragmentary, perspective view of a column with a small triangular cover mounted thereon.

A small diamond or triangle column cover option is illustrated in FIG. 79, wherein the external raceways 37 and 38 are attached to flanges 28 of associated core weldment 21, in a manner similar to the small square column cover option illustrated in FIG. 77. The arcuate covers 44 and 45 are replaced by a pair of generally V-shaped covers 414, each having one side edge 415 thereof attached to the side of an associated one of raceways 37 and 38. The opposite side 416 of each cover 414 is formed to define a generally Z-shaped channel, with its free edge abutting the free edge of associated core weldment flange 26 to enclose internal powerways 58 and 59. The opposite sides or faces 417 of each cover 414 are substantially planar, and are mutually oriented at an acute angle along their common edge. The outer edges of V-shaped covers 414 extend diametrically outwardly from core weldment 21 along a plane oriented substantially perpendicular to core weldment flanges 29, and are generally parallel with the axial center line of weldment tube 31, such that the exterior of column 3 assumes a substantially triangular cross-sectional shape, which is smaller than the triangular shape of a column 3 formed by column covers 410.

A small circle column cover option is illustrated in FIG. 80, wherein external raceways 37 and 38 are attached to the flanges 28 of an associated core weldment 21 in a manner similar to the small square column cover option illustrated in FIG. 77. A pair of arcuate covers 384 are provided to replace previously described arcuate covers 44 and 45, wherein one free edge 385 of each cover 384 is fastened to the sidewall of associated one of the external raceways 37 and 38. The opposite side edge 386 of each cover 384 is formed upwardly into a Z-shaped configuration, wherein the free edge mates with the free edge of core weldment flange 26, such that the exterior of column 3 assumes a substantially circular lateral cross-sectional shape that is smaller than that associated with column covers 44 and 45.

The reference numeral 1*a* (FIGS. 81 & 82) generally designates another embodiment of the present invention, having an octagon-shaped overhead framework 4*a*. Since furniture system 1*a* is similar to the previously described furniture system 1, similar parts appearing in FIGS. 1–80 and FIGS. 81 & 82 respectively are represented by the same, corresponding reference numeral, except for the suffix "a" in the numerals of the latter. In furniture system 1*a*, the perimeter beam segment 115 have a straight or linear shape, unlike the arcuate shape of perimeter beam segments 115. Eight perimeter beam segments 115*a* are interconnected end-to-end into a closed polygon having a top plan shape in the form of a regular octagon.

Figure 82:
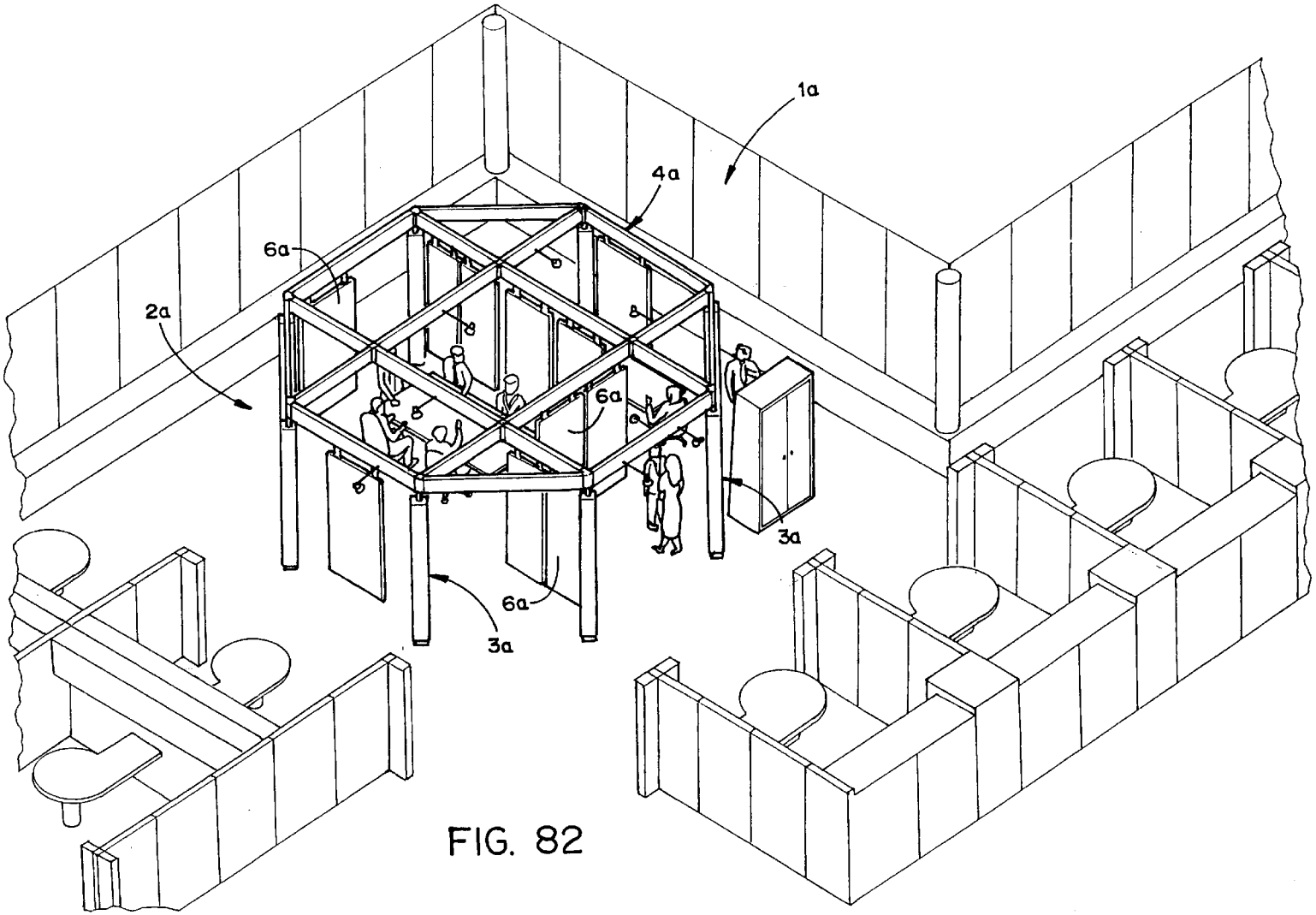
FIG. 82 is a perspective view of the octagonal framework furniture system shown in FIG. 81, wherein the panels have been rearranged to define multiple, smaller, sub-group workspaces for breakout type activities.

Cross beam segments 116*a* are similar to previously described cross beam segments 116, except they are somewhat shorter in length and have a thickness the same as perimeter beam segments 115*a*, with a total of twelve cross beam segments 116*a* provided, instead of the four cross beam segments 116 associated with furniture system 1. Four X-connectors 222*a* interconnect the interior ends of each of the twelve cross beam segments 115*a* in the form of a checkerboard gridwork. Also, the T-connectors 221 of furniture system 1 are replaced by two different styles of Y-connectors 390 and 391 to accommodate for the different angles formed between perimeter segments 115*a* and cross beam segments 116*a*. Y-connectors 390 and 391 are both otherwise substantially identical in construction to T-connector 221. Because of the octagonal shape of overhead framework 4, and the grid shape of the interconnected cross beams 116*a*, the interior of furniture system 1*a* may be divided into a plurality of smaller sub-group workspaces of different sizes and shapes by rearrangement of panels 6 on overhead framework 4, as best illustrated in FIG. 82.

The reference numeral 1*b* (FIG. 83) generally designates yet another embodiment of the present invention, having a serpentine style overhead framework 4*b*. Since furniture arrangement 1*b* is similar to the previously described furniture systems 1 and 1*a*, similar parts appearing in FIGS. 1–80 & 81–82, and FIG. 83 respectively are represented by the same, corresponding reference numeral, except for the suffix "b" in the numerals of the latter. Furniture system 1*b* is designed generally for display purposes, and includes a serpentine shaped overhead framework 4*b*, comprising a plurality of curvilinear beam segments 115*b*, which are interconnected in an end-to-end fashion similar to furniture system 1, but are reversed in direction at every other beam segment 3*b*, such that furniture system 1*b* assumes a lazy "S" or serpentine top plan shape. Previously described in-line connectors 220*b* may be used at every other junction of beam segment 115*b* and column 3*b*, however, a special reverse curve connector 293 is required at the remaining, alternate beam joints to accommodate for the reversal in direction between adjacent beam segments 115*b*. Reverse curve connector 393 is otherwise substantially identical to in-line connector 220*b*.

Figure 83:
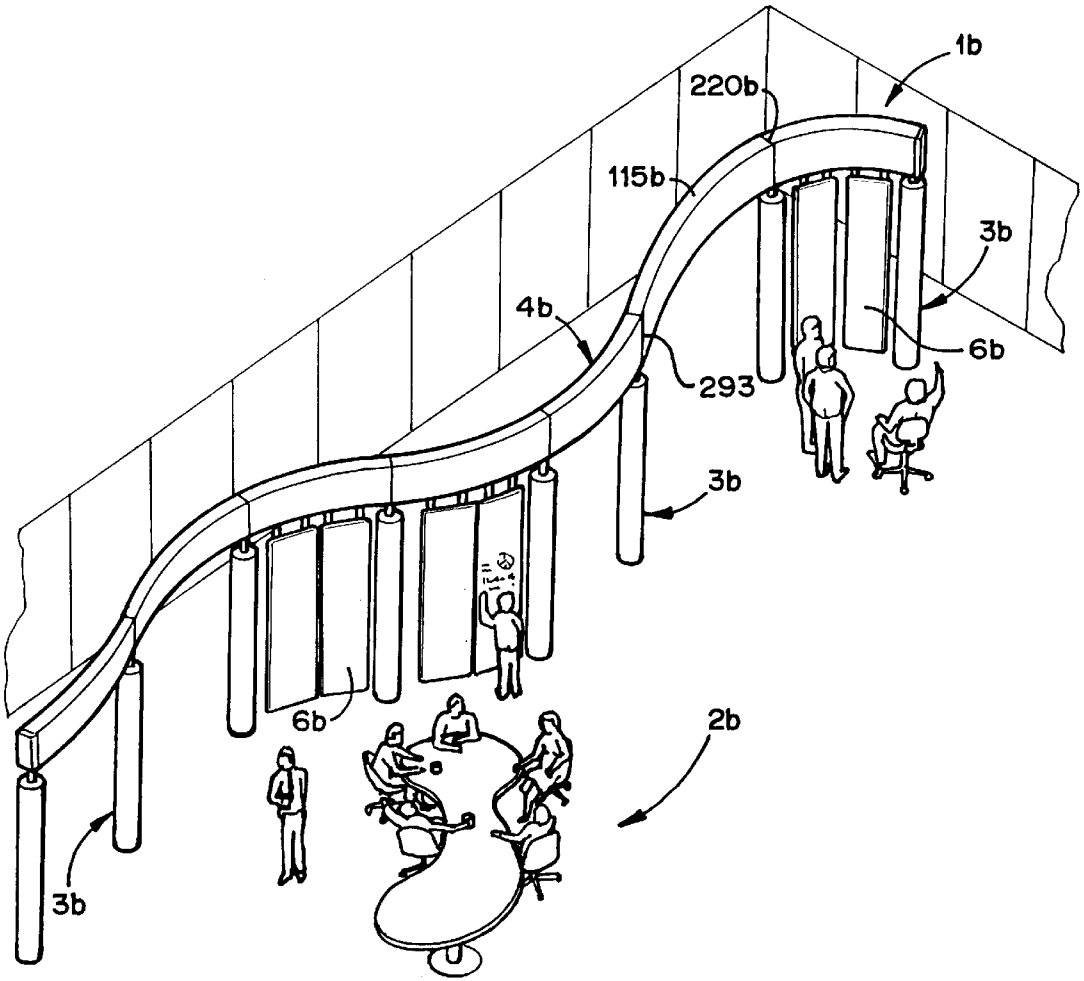
FIG. 83 is a perspective view of yet another embodiment of the present invention, comprising a serpentine framework, and shown deployed in an open office plan, with removable display panels arranged to support multiple group work activities.

It is to be understood that the present invention contemplates use solely as an information display, apart from any partitioning or space dividing function. For instance, the furniture system 1*b* illustrated in FIG. 83 is designed primarily as an information display system to be used with display panels 315, and is arranged in office space 2*b* in a manner which renders any partitioning function rather minimal. The extent to which any given furniture system 1 performs partitioning and/or display function can be easily selected by the space author in determining the size, shape and position of the furniture system within a given floor space, and can also be varied by the space user in selecting the type of panels 6 to be hung on overhead framework 4, and the precise location at which the panels 6 are to be hung. The furniture systems 1*c*–1*j*; described hereinafter are configured in a manner that is capable of providing some degree of both partitioning and display functions, if the space user chooses to use the same.

Figure 84:
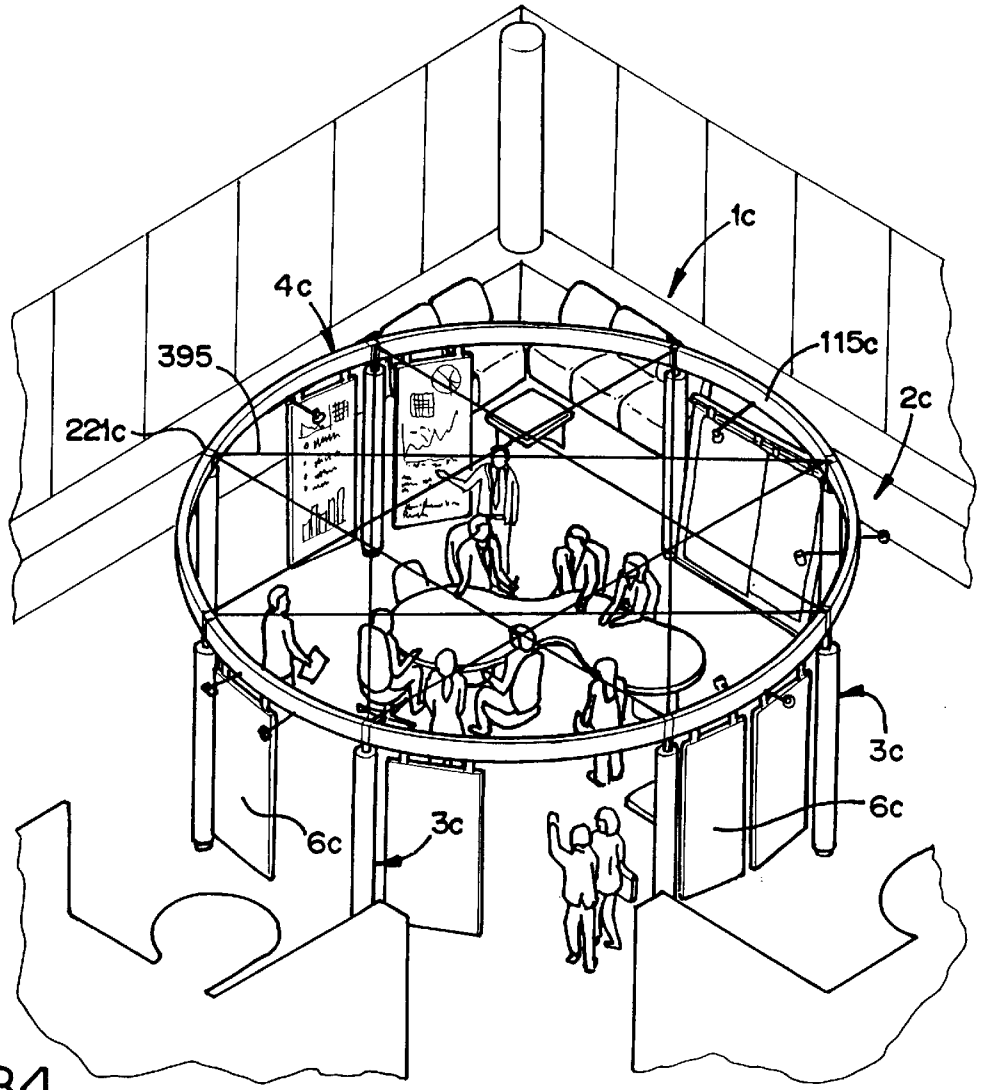
FIG. 84 is a perspective view of yet another embodiment of the present invention, comprising a ring-shaped framework, and shown deployed in an open office plan, with removable panels arranged to define a large, group workspace.

The reference numeral 1*c* (FIG. 84) generally designates yet another embodiment of the present invention, having a ring-shaped overhead framework 4*c*. Since furniture system 1*c* is similar to the previously described furniture systems 1 and 1*a*–1*b*, similar parts appearing in FIGS. 1–80 & 81–83, and 84 respectively are represented by the same, corresponding reference numeral, except for the suffix "c" in the numerals of the latter. The overhead framework 4*c* of furniture system 1*c* is substantially identical to the overhead framework 4 furniture system 1, except that it does not have any cross beam segments 116. Hence, only in-line connectors 221*c* are required to interconnect the perimeter beam segments 115*c* of furniture system 1*c*. In the illustrated example, cables 395 are provided to interconnect oppositely positioned columns 3*c* to provide additional stability to the furniture system 1*c*. Cables 395 may be constructed of sufficient rigidity that at least certain types of panels 6 could be hung thereon.

The reference numeral 1*d* (FIG. 85) generally designates yet another embodiment of the present invention, having an X-shaped overhead framework 4*d*. Since furniture system 1*d* is similar to the previously described furniture systems 1 and 1*a*–1*c*, similar parts appearing in FIGS. 1–80 & 81–84, and FIG. 85 respectively are represented by the same, corresponding reference numeral, except for the suffix "d" in the numerals of the latter. Furniture system 1*d* is similar to the circular framework furniture system 1, except that it does not include any perimeter beam segments 115, but rather includes only four cross beam segments 116*d*, interconnected at their interior ends by an X-connector 222*d*. Four columns 3*d* are provided to support the exterior ends of cross beam segments 116*d*. A special end connector 397 is provided to interconnect the exterior ends of cross beam segments 116*d* with associated columns 3*d*. End connector 397 is substantially identical to T-connector 221, except that it has only a single set of fletch plates (not shown) oriented toward the center of furniture system 1*d*.

The reference numeral 1*e* (FIG. 86) generally designates yet another embodiment of the present invention, having a Y-shaped overhead framework 4*e*. Since furniture system 1*e* is similar to the previously described furniture systems 1 and 1*a*–1*d*, similar parts appearing in FIGS. 1–80 & 81–85, and FIG. 86 respectively are represented by the same, corresponding reference numeral, except for the suffix "e" in the numerals of the latter. Furniture system 1*e* is substantially similar to furniture system 1*d*, except that it has only three cross beam segments 116*e*, which are arranged in a "Y" top plan configuration. A special center connector 399 interconnects the interior ends of cross beam segments 116*e*. Center connector 399 is substantially similar to X-connector 222, except that it includes only three sets of fletch plates (not shown) which are oriented in a "Y" configuration. End connectors 397*e* are used to attach the exterior ends of cross beam segments 116*e* to three, associated columns 3*e*.

The reference numeral 1*f* (FIG. 87) generally designates yet another embodiment of the present invention, having a dual-square overhead framework 4*f*. Since furniture system if is similar to the previously described furniture systems 1 and 1*a*–1*e*, similar parts appearing in FIGS. 1–80 & 81–86, and FIG. 87 respectively are represented by the same, corresponding reference numeral, except for the suffix "f" in the numerals of the latter. The illustrated overhead framework 4*f* includes four perimeter beam segments 115*f*, and four cross beam segments 116*f* which are interconnected at their interior ends by an X-connector 222*f*. The exterior ends of cross beam segments 116*f* are connected to four, associated columns 3*f* by a special cross beam right angle connector 401. Cross beam right angle connector 401 is substantially identical to T-connector 221, except that it includes only one set of perimeter beam fletch plates (not shown). A perimeter beam right angle connector 402 is also provided to interconnect the ends of perimeter beam segments 115*f* with the remaining, two columns 3*f*. Perimeter beam right angle 402 is substantially identical to in-line connector 220 except that the fletch plates (not shown) are oriented in an mutually perpendicular relationship.

The reference numeral 1*g* generally designates yet another embodiment of the present invention, having a triangle-shaped overhead framework 4*g*. Since furniture system 4*g* is similar to the previously described furniture systems 1 and 1*a*–1*f*, similar parts appearing in FIGS. 1–80 and 81–87 and FIG. 88 respectively are represented by the same, corresponding reference numeral, except for the suffix "g" in the numerals of the latter. The overhead framework 4*g* associated with furniture system 1*g* has no cross beam segments 116, and only three perimeter beam segments 115*g*. The opposite ends of perimeter beam segments 115*g* are connected with associated columns 3*g* by Y-connectors 390*g* and 391*g*.

The reference numeral 1*h* (FIG. 89) generally designates yet another embodiment of the present invention, having a partially arcuate overhead framework 4*h*. Since furniture system 1*h* is similar to the previously described furniture systems 1 and 1*a*–1*g*, similar parts appearing in FIGS. 1–80 & 81–88, and FIG. 89 respectively are represented by the same, corresponding reference numeral, except for the suffix "h" in the numerals of the latter. Furniture system 1*h* is quite similar to furniture system 1, except that two adjacent perimeter beam segments 115 and their associated column 3 are removed to form a pie-shaped area exterior of furniture system 1*h*. Further, furniture system 1*h* has only three cross beam segments 116*h*, unlike the four cross beam segments 116 incorporated into furniture system 1. The interior ends of cross beam segments 116*h* are interconnected by a center Y-connector 390*h*. The exterior end of the middle cross beam segment 116*h* is connected with associated column 3*h* by a T-connector 221*h*, while the exterior ends of the remaining, two cross beam segments 116 are connected with associated columns 3*h* by a special end connectors 407. End connectors 407 are substantially identical to T-connectors 221, except that one set of perimeter fletch plates (not shown) is removed.

Figure 90:
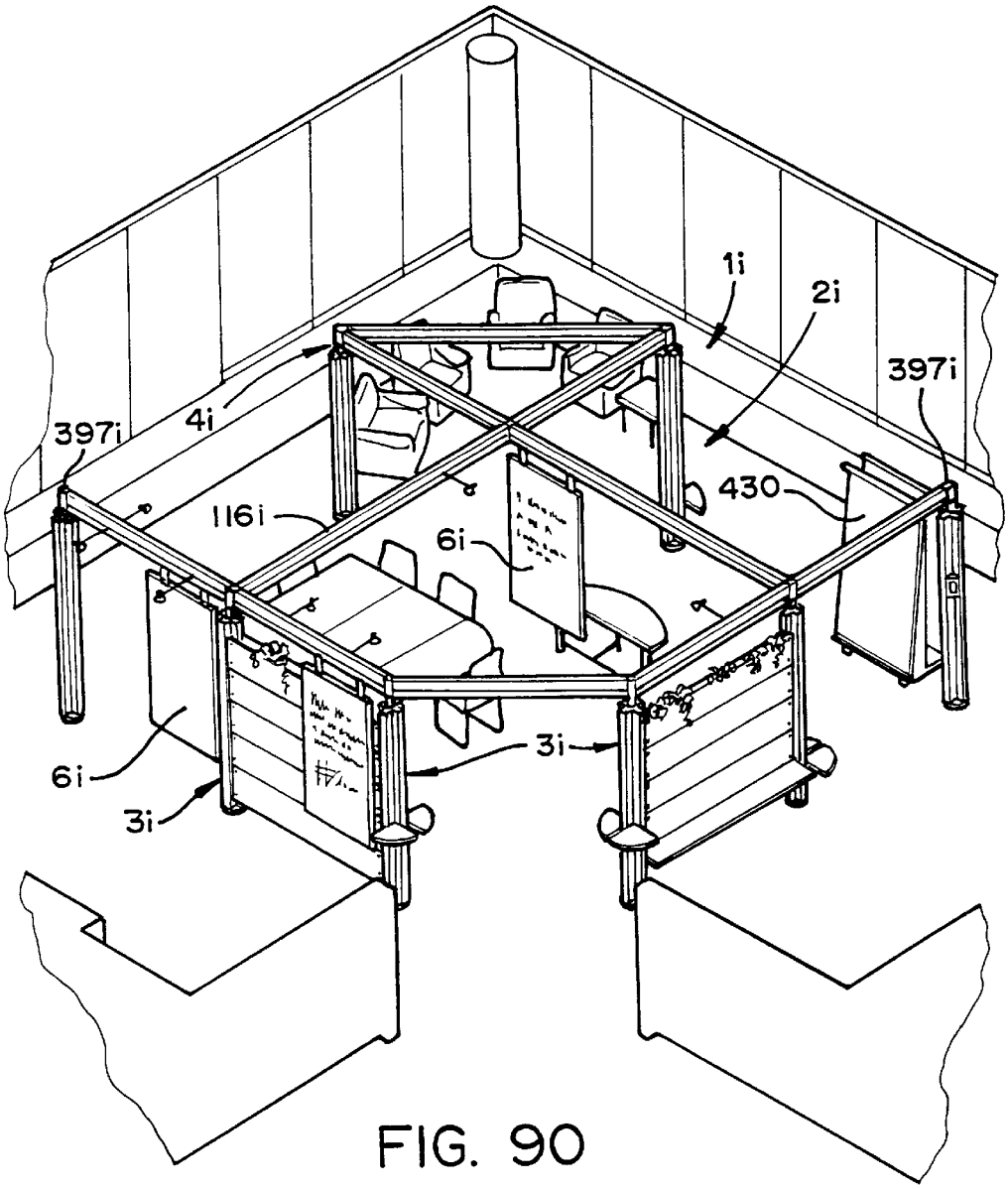
FIG. 90 is a perspective view of yet another embodiment of the present invention, comprising a dual-triangle framework, and shown deployed in an open office plan.

The reference numeral 1*i* (FIG. 90) generally designates yet another embodiment of the present invention, having a dual-triangle overhead framework 4*c*. Since furniture system 1*i* is similar to the previously described furniture systems 1 and 1*a*–1*h*, similar parts appearing in FIGS. 1–80 & 81–89, and FIG. 90 respectively are represented by the same, corresponding reference numeral, except for the suffix "i" in the numerals of the latter. Furniture system 1*i* includes six straight perimeter beam segments 115*i*, and four cross beam segments 116*i*. The interior ends of cross beam segments 116*i* are interconnected by an X-connector 222*i*. The exterior ends of the two, longer cross beam segments 116*i* are connected with associated columns 3*i* by perimeter T-connectors 402*i*, while the exterior ends of the remaining two cross beam segments 116*i* are interconnected with associated columns 3*i* by Y-connectors 390*i* and 391*i*. The outermost columns 3*i* are connected with a straight perimeter beam segment 115*i* by perimeter Y-connectors 390*i* and 391*i*, so that overhead framework 4*i* assumes a partial octagon shape. The free ends of outboard perimeter beam segments 115*i* are connected to associated columns 3*i* by end connectors 397*i*.

Figure 91:
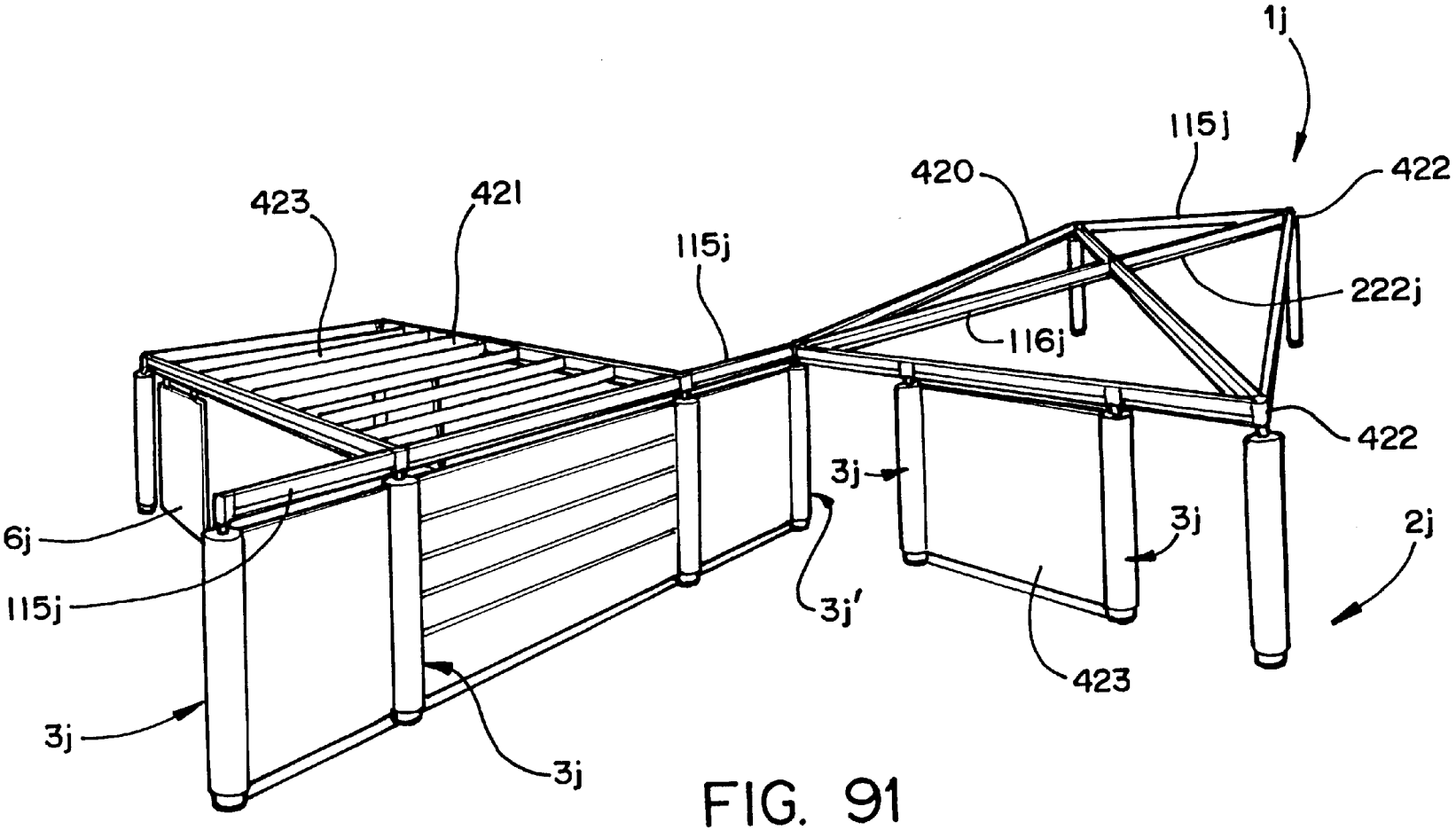
FIG. 91 is a perspective view of yet another embodiment of the present invention, comprising a combination framework, and shown deployed in an open office plan.

The reference numeral 1*j* (FIG. 91) generally designates yet another embodiment of the present invention, having a combination overhead framework 4*j*. Since furniture system 1*j* is similar to the previously described furniture systems 1 and 1*a*–1*i*, similar parts appearing in FIGS. 1–80 & 81–90, and FIG. 91 respectively are represented by the same, corresponding reference numeral, except for the suffix "j" in the numerals of the latter. Furniture system 1*j* generally comprises two rectangularly shaped frameworks 420 and 421, which are interconnected at a common column 3*j*′. Overhead framework 420 is supported by a total of six columns 3*j*, including the common column 3*j*′, and includes six straight perimeter beam segments 115*j*, and four cross beam segments 116*j*. The interior ends of cross beam segments 116 are interconnected by an X-connector 222*j*, which is substantially identical to X-connector 222, except that the legs are oriented at a slightly different included angle to accommodate the rectangular shape of overhead framework 420. The exterior ends of cross beam segments 116*j* are connected with associated columns 3*j* by V-connectors 422, which are substantially identical to T-connectors 221, except for the mutual orientation of the three sets of fletch plates (not shown). A series of horizontal partition panels 423 are mounted between the front two interiormost columns 3*j*, and have their side edges captured within the external grooves 62 of the associated columns 3*j*. Partition panels 423 are stacked vertically on one another, and extend generally from the floor to the overhead framework 420.

Overhead framework 421 also has a substantially rectangular plan shape, and is supported by four columns 3*j* at each of the four corners thereof. Overhead framework 421 includes a rigid trellis 423, which incorporates a series of ceiling beams that extend between opposite perimeter beam segments 115*j* in a generally parallel and spaced apart fashion to partially partition the underlying workspace from the overhead portion of the building. A pair of straight, outboard perimeter beam segments 115*j* extend outwardly from the opposite front corners of overhead framework 421, and horizontal partition panels 423 are mounted between all three pairs of front columns 3*j* to further partition the associated space.

As is apparent from the foregoing description, the size and shape of furniture system 1 can be varied greatly to complement and/or cooperate with the architectural configuration of the room in which the furniture system is to be erected and used. The modular or kit nature of furniture system 1 requires relatively few different parts, such as columns 3, beam segments 115 & 116, and connectors 117, to design and construct virtually any type or style of system desired. This kit type of construction not only minimizes manufacturing and distribution costs, but also results in substantial savings to the end user. Since group work projects are typically temporary, the need for the associated support furnishings is also normally of limited duration. When a specific furniture system 1 is no longer required to support its associated authoring group, it may be readily disassembled and stored for future uses. Because of its modular construction, the disassembled furniture parts can be used at some future date to construct a similar style furniture unit, or can be used with other parts to construct a completely different style furniture system 1. The user simply creates an inventory of modular furniture pieces, which can be used repeatedly in different furniture system layouts to achieve both maximum cost efficiency, and support effectiveness.

In one contemplated example of furniture system 1, even after the selected system has been designed and erected at a selected location, should the needs of the users change, such as to require more group meeting space, more break-out space, more display capability, smaller individual workspaces, etc., the selected furniture system 1 can be readily altered to accommodate for these new needs. In another example of furniture system 1, the designer may elect to arrange the modular pieces in a manner which complements or imitates the shape of the space in which the furniture system is to be used. Hence, an effective custom furniture system can be readily provided for even irregularly shaped building spaces, or other such spaces that are not readily adapted for use with conventional furnishings.

Furniture system 1 is extremely dynamic, and is particularly adapted to efficiently and effectively support group work activities in open plans and the like. As best illustrated in FIG. 1, furniture system 1 can perform a partitioning function by hanging panels 6 about at least selected portions of the perimeter beam segments 115, so as to separate the interior of furniture system 1 from the remainder of the open office space 2. In this configuration, the space defined by furniture system 1 is particularly adapted to support group communications and activities, such as lectures and team meetings. When the problem solving team needs to breakout into smaller sub-groups, or even individual workers for further, more specific activities, the existing panels 6 can be easily reconfigured, and/or additional panels 6 can be readily hung on beam segments 115 and 116 to sub-partition the space within furniture system 1, as illustrated in FIG. 2, for breakout communications and activities. When the team is not meeting, all panels 6 may be removed from overhead framework 4 to permit free movement throughout the floor space occupied by furniture system 1. Mobile carts 430 greatly facilitate the configuration and reconfiguration of panels 6 on overhead framework 4, and can also serve as an independent partition and/or display. Display panels 315 may also be hung from overhead framework 4 to assist in group communications. Task lighting 159 may be either reoriented, or removed bodily from overhead framework 4 and reattached at new locations to provide adequate lighting for both group and/or breakout activities.

Since many of the accessories associated with furniture system 1 can be user manipulated and/or adjusted, such as partition panels 320, display panels 316, lighting fixtures 159, mobile carts 430, as well as any associated furniture, the users gain a sense of space ownership by virtue of their ability to personalize the space being used. The users can create their own office environment by simply selecting and incorporating the furniture accessories desired. The number and location of panels 6 is adjusted to achieve that precise balance of worker privacy and worker interaction as the specific occasion warrants, and/or is desired. The office environment so created is not static, but rather can be readily altered by either the space author to meet changing needs, or by a different user to accommodate new tasks and/or likings. This flexibility promotes worker creativity and encourages teamwork and collaboration, which in turn enhances group performance.

Furniture system 1 may be used in a wide variety of different ways, and is particularly adapted for conferencing, brainstorming, training, decision making, and other similar activities. The flexibility of furniture system 1 is beneficial not only for these types of planned group functions, but also supports spontaneous or ad-hoc interaction among colleagues.

The open configuration of overhead framework 4 prevents interference with other building facilities, such as building lighting, fire detection and suppression equipment, HVAC, etc. Appliances, such as telephones, computers, copiers, coffee makers, and other similar equipment can be plugged into the power and communication taps on columns 4, such that furniture system 1 is completely self-sufficient, and is versatile and adaptable to tailor the same to the specific needs of the occasion.

In the foregoing description, it will be readily appreciated by those skilled in the art that modifications may be made to the invention without departing from the concepts disposed herein. Such modifications are to be considered as included in the following claims, unless these claims by their language expressly state otherwise.

The embodiments of the invention in which an exclusive property or privilege is claimed are defined as follows:

1. A furniture based partition system particularly adapted to support group activities in open plans, and the like, comprising:

an overhead support disposed in a generally horizontal orientation above an open floor surface of an associated building room;

a plurality of overhead support columns, disposed in a generally vertical orientation, each said column having an upper portion thereof connected with said overhead support, and a lower portion thereof abutting the open floor surface thereby supporting said overhead support in a freestanding fashion within the building room at a predetermined elevation above average user height, with the floor surface beneath said overhead support being generally unobstructed to facilitate user passage thereunder;

a plurality of partition panels, each being shaped to visually divide one portion of the building room from another portion thereof, and being constructed to permit easy, manual, bodily translation of the same by an adult user; said partition panels each including a connector mounted thereon which detachably connects the same with said overhead support in a manner in which each of said partition panels hangs downwardly from said overhead support in a generally vertical orientation, and is readily and easily manually removable therefrom by the user;

an open sided hanger supported on said overhead support, and detachably engaging the connector of said partition panels for detachably suspending each of said individual partition panels on said overhead support at various locations therealong; and said overhead support being configured to permit said partition panels to be removably hung therefrom and reconfigurable between at least a first arrangement wherein said partition panels define a group workspace portion of the floor surface which is at least spatially and visually distinct from the rest of the floor surface, and is sufficiently large to comfortably accommodate a plurality of adult users therein for communal communications and actions, and a second arrangement wherein said partition panels subdivide the group workspace into at least two, sub-group workspaces which are at least spatially and visually distinct from one another, and are sufficiently large to accommodate at least one adult user therein for breakout-type communications and actions.

2. A furniture based partition system as set forth in claim 1, wherein:

at least one of said partition panels has an acoustic construction to attenuate sound transmission into and out of said furniture system.

3. A furniture based partition system as set forth in claim 2, wherein:

said at least one partition panel is rigid.

4. A furniture based partition system as set forth in claim 3, wherein:

said at least one partition panel includes a flexible bumper attached to at least one outer edge of said panel.

5. A furniture based partition system as set forth in claim 4, wherein:

said at least one partition panel has an open frame about a margin of said partition panel and a lightweight core mounted within said open frame.

6. A furniture based partition system as set forth in claim 5, wherein:

said panel frame defines opposite faces of said at least one partition panel and further wherein at least one of said faces is covered with a fabric layer.

7. A furniture based partition system as set forth in claim 6, wherein:

said lightweight core comprises an acoustic attenuating core.

8. A furniture based partition system as set forth in claim 7, wherein:

said acoustic attenuating core is a honeycomb panel.

9. A furniture based partition system as set forth in claim 7, wherein:

said acoustic attenuating core is a foam core.

10. A furniture based partition system as set forth in claim 7, wherein:

said acoustic attenuating core comprises sound attenuating bats.

11. A furniture based partition system as set forth in claim 5, wherein:

said panel frame defines opposite faces of said at least one partition panel and further wherein at least one of said faces is covered with a display surface.

12. A furniture based partition system as set forth in claim 11, wherein:

said display surface is an erasable marking board surface.

13. A furniture based partition system as set forth in claim 2, wherein:

said at least one partition panel is flexible.

14. A furniture based partition system as set forth in claim 13,wherein:

said flexible partition panel comprises an acoustic curtain.

15. A furniture based partition system as set forth in claim 14, wherein:

said acoustic curtain includes a sound absorbing core.

16. A furniture based partition system as set forth in claim 1, wherein:

said detachable connector includes an anti-friction bearing.

17. A furniture based partition system as set forth in claim 16, wherein:

said anti-friction bearing is a glide which interfaces with and glides along a portion of said hanger means when one of said partition panels is translated.

18. A furniture based partition system as set forth in claim 17, wherein:

said glide defines a linear slot extending along a lowermost portion of said glide, and further wherein said slot glides upon an upwardly facing edge of said hanger means.

* * * * *